US011022124B2

(12) United States Patent
Ward et al.

(10) Patent No.: US 11,022,124 B2
(45) Date of Patent: Jun. 1, 2021

(54) WHOLE HOME WATER APPLIANCE SYSTEM

(71) Applicant: Logical Concepts, Inc., Indianapolis, IN (US)

(72) Inventors: Thomas Owen Ward, Greenwood, IN (US); David Lee Brown, Greenwood, IN (US); Casey Wayne Hampton, Martinsville, IN (US); Gage Herbert Wilkinson, Indianapolis, IN (US)

(73) Assignee: LOGICAL CONCEPTS, INC., Indianapolis, IN (US)

( * ) Notice: Subject to any disclaimer, the term of this patent is extended or adjusted under 35 U.S.C. 154(b) by 478 days.

(21) Appl. No.: 15/949,895

(22) Filed: Apr. 10, 2018

(65) Prior Publication Data

US 2018/0291911 A1 Oct. 11, 2018

Related U.S. Application Data

(60) Provisional application No. 62/483,915, filed on Apr. 10, 2017.

(51) Int. Cl.
*F04B 49/025* (2006.01)
*F04D 15/02* (2006.01)
(Continued)

(52) U.S. Cl.
CPC ..... *F04D 15/0218* (2013.01); *E03B 5/06* (2013.01); *E03B 7/12* (2013.01); *E03F 5/22* (2013.01);
(Continued)

(58) Field of Classification Search
CPC ..... F04D 15/0218; F04D 15/00; F04D 13/12; F04D 15/029; F04D 25/04;
(Continued)

(56) References Cited

U.S. PATENT DOCUMENTS 3,963,376 A * 6/1976 Miskin ..... F04B 49/04 417/40
4,309,157 A * 1/1982 Niedermeyer ..... F04D 13/068 200/83 R
(Continued)

OTHER PUBLICATIONS

"Ion+ Connect, Digital Level Controller with Ion Sensor and Text Notifications," indicated as revised Feb. 1, 2018, pp. 1-2, Metropolitan Industries, Inc., Romeoville, IL.
(Continued)

*Primary Examiner* — Devon C Kramer
*Assistant Examiner* — Thomas Fink
(74) *Attorney, Agent, or Firm* — Brinks Gilson & Lione

(57) ABSTRACT

A whole home water appliance system includes controller circuitry, a primary sump pump driven by an electric motor, and a secondary sump pump driven with a flow of water. The system also includes a water control actuator operable as a water main control device for a domestic water distribution network and a flow meter to measure the flow of municipal water supplied to the network. The controller circuitry selectively energizes the primary sump pump to extract liquid from a sump pit based on a liquid level in the sump pit. The secondary sump pump independently controlled by a hydraulic level sensor to extract liquid from the sump pit. The water control actuator controlled by the controller circuitry to shut off a municipal water supply to the domestic water distribution network in response to detection of a leak. Communication circuitry included in the whole home water appliance may wirelessly communicate.

18 Claims, 36 Drawing Sheets

(51) Int. Cl.

| | |
|---|---|
| ***E04B 1/70*** | (2006.01) |
| ***E03B 5/06*** | (2006.01) |
| ***F04D 13/12*** | (2006.01) |
| ***F04D 25/04*** | (2006.01) |
| ***F04D 25/06*** | (2006.01) |
| ***E03F 5/22*** | (2006.01) |
| ***F04D 15/00*** | (2006.01) |
| ***F04F 5/10*** | (2006.01) |
| ***F04F 5/00*** | (2006.01) |
| ***F04B 23/04*** | (2006.01) |
| ***F04B 23/08*** | (2006.01) |
| ***E03B 7/12*** | (2006.01) |
| ***F04B 49/035*** | (2006.01) |
| ***F04B 17/03*** | (2006.01) |
| *F04B 49/04* | (2006.01) |

(52) U.S. Cl.

CPC ..... *E04B 1/7023* (2013.01); *F04B 17/03* (2013.01); *F04B 23/04* (2013.01); *F04B 23/08* (2013.01); *F04B 49/035* (2013.01); *F04D 13/12* (2013.01); *F04D 15/00* (2013.01); *F04D 15/0077* (2013.01); *F04D 15/029* (2013.01); *F04D 25/04* (2013.01); *F04D 25/0686* (2013.01); *F04F 5/00* (2013.01); *F04F 5/10* (2013.01); *F04B 49/025* (2013.01); *F04B 49/04* (2013.01); *F04B 2205/09* (2013.01)

(58) Field of Classification Search

CPC .... F04D 25/0686; F04D 15/0077; F04F 5/10; F04F 5/00; F04B 23/04; F04B 23/08; F04B 49/035; F04B 17/03; F04B 49/025; F04B 49/04; F04B 2205/09; E03B 7/12; E03B 5/06; E04B 1/7023; E03F 5/22; E03F 2201/20; G05D 7/06; H01H 36/02; G08B 21/18–24; H04B 7/0608; H04W 4/00–90

USPC ..... 340/5.61, 10.1, 10.5, 12.5, 13.24, 13.25, 340/605

See application file for complete search history.

(56) References Cited

U.S. PATENT DOCUMENTS

| | | | | |
|---|---|---|---|---|
| 4,949,626 | A * | 8/1990 | Townsend | E02D 31/008 454/341 |
| 5,793,294 | A * | 8/1998 | Schepka | G01F 23/243 340/450 |
| 8,474,477 | B1 * | 7/2013 | Melisz, Jr. | E02D 29/12 137/363 |
| 8,591,198 | B2 | 11/2013 | Kochan, Jr. et al. | |
| 8,907,789 | B2 | 12/2014 | Kochan, Jr. et al. | |
| 9,033,686 | B2 | 5/2015 | Kochan, Jr. et al. | |
| D740,698 | S | 10/2015 | Cummings | |
| D741,815 | S * | 10/2015 | Cummings | D13/163 |
| 9,200,630 | B1 * | 12/2015 | Huff | F04D 15/0218 |
| 9,404,501 | B2 | 8/2016 | Cummings | |
| 9,523,366 | B2 | 12/2016 | Cummings et al. | |
| 9,525,309 | B2 | 12/2016 | Cummings | |
| 9,528,512 | B2 | 12/2016 | Cummings | |
| 9,528,520 | B2 | 12/2016 | Cummings | |
| 9,528,522 | B2 | 12/2016 | Cummings | |
| 9,528,523 | B2 | 12/2016 | Cummings | |
| 9,528,873 | B2 | 12/2016 | Cummings | |
| 9,534,593 | B2 | 1/2017 | Cummings et al. | |
| 9,534,606 | B2 | 1/2017 | Cummings | |
| 9,534,929 | B1 * | 1/2017 | Stamatakis | F24F 11/30 |
| 9,680,401 | B2 | 6/2017 | Kochan et al. | |
| 9,696,360 | B2 * | 7/2017 | Rothbart | G01R 31/343 |
| 9,709,431 | B1 * | 7/2017 | Kinney | G08B 21/20 |
| 9,912,492 | B2 * | 3/2018 | McCarthy, III | H04L 12/2825 |
| 9,958,878 | B2 | 5/2018 | Kochan, Jr. et al. | |
| 9,967,145 | B2 * | 5/2018 | Kim | H04L 41/082 |
| 10,073,428 | B2 * | 9/2018 | Bruhn | H04N 21/4131 |
| 10,102,585 | B1 * | 10/2018 | Bryant | G06Q 30/0278 |
| 2004/0035471 | A1 * | 2/2004 | Harwood | F04D 13/16 137/565.29 |
| 2006/0045105 | A1 * | 3/2006 | Dobosz | H04L 12/2898 370/401 |
| 2006/0093492 | A1 * | 5/2006 | Janesky | F04D 29/708 417/366 |
| 2007/0258827 | A1 * | 11/2007 | Gierke | F04D 13/068 417/6 |
| 2008/0150750 | A1 * | 6/2008 | Parris | G07F 15/10 340/870.02 |
| 2009/0058088 | A1 * | 3/2009 | Pitchford | G01F 15/063 290/50 |
| 2010/0024541 | A1 * | 2/2010 | Schindler | G01M 3/26 73/199 |
| 2011/0085919 | A1 * | 4/2011 | Williams | F04D 15/0218 417/63 |
| 2011/0311370 | A1 * | 12/2011 | Sloss | F04B 49/02 417/1 |
| 2012/0085688 | A1 * | 4/2012 | Schmidt | F04D 29/2288 210/119 |
| 2012/0193559 | A1 * | 8/2012 | Benson | G01F 15/005 251/129.01 |
| 2012/0325923 | A1 * | 12/2012 | Hartfelder | A01G 25/16 239/1 |
| 2013/0113631 | A1 * | 5/2013 | Pitchford | G08C 17/02 340/870.02 |
| 2015/0143897 | A1 * | 5/2015 | Cummings | F04D 13/12 73/168 |
| 2015/0144818 | A1 * | 5/2015 | Cummings | F04D 15/0088 251/129.04 |
| 2015/0240803 | A1 * | 8/2015 | Knight | F04B 51/00 73/168 |
| 2015/0292501 | A1 * | 10/2015 | Knight | F04B 17/03 324/511 |
| 2016/0041565 | A1 * | 2/2016 | Edwards | G05D 23/1919 700/282 |
| 2016/0161940 | A1 * | 6/2016 | Max | E03B 7/071 700/282 |
| 2016/0163177 | A1 * | 6/2016 | Klicpera | G08B 21/18 137/59 |
| 2016/0356026 | A1 * | 12/2016 | Engler | F16K 37/005 |
| 2017/0030528 | A1 * | 2/2017 | Dietzen | G08B 21/20 |
| 2017/0175746 | A1 * | 6/2017 | Mayleben | F04D 13/14 |
| 2017/0184417 | A1 * | 6/2017 | Pedreiro | G01D 4/002 |
| 2017/0335550 | A1 * | 11/2017 | Sterling | E03B 7/072 |
| 2017/0356779 | A1 * | 12/2017 | Stuyvenberg | F16K 31/086 |
| 2018/0163730 | A1 * | 6/2018 | Wilds | H04W 48/20 |
| 2018/0168119 | A1 * | 6/2018 | Hartfelder | A01G 25/16 |
| 2018/0292248 | A1 * | 10/2018 | Heizenroeder | G01D 4/002 |
| 2019/0234786 | A1 * | 8/2019 | Klicpera | G01F 15/063 |
| 2019/0281371 | A1 * | 9/2019 | Klicpera | H04L 12/2827 |
| 2020/0003217 | A1 * | 1/2020 | Wilds | F04B 23/04 |

OTHER PUBLICATIONS

"Ion Genesis, Smart Controller and Sensors," indicated as revised Mar. 4, 2019, pp. 1-2, Metropolitan Industries, Inc., Romeoville, IL.

Prindle, D., "Does Cold Weather Have You Worried About Bursting Pipes? Water Hero Has Your Back," dated Nov. 22, 2014, pp. 1-3, Digital Trends, available at URL: https://web.archive.org/web/20160811110129/http://www.digitaltrends.com.

"Water Hero Quick Start Guide," dated Feb. 13, 2018, pp. 1-2, Water Hero, Inc., Beverly, MA.

* cited by examiner

WHOLE HOME WATER APPLIANCE SYSTEM

CROSS-REFERENCE TO RELATED APPLICATIONS

The present application claims priority under 35 U.S.C. § 119(e) to U.S. Provisional Application No. 62/483,915, filed Apr. 10, 2017 the entire contents of which are hereby incorporated by reference.

TECHNICAL FIELD

This disclosure relates to a water appliance and more particularly to a whole home water appliance system.

BACKGROUND

Water damage to homes and businesses can be significant. For example, water damage to insured homes of large insurer's customer base, such as a national insurance company, results in multimillion dollar/year claimed losses. According to the National Flood Insurance program, this is a 3 billion dollar/year problem in the United States. Some examples of causes of water damage include frozen water pipes, water line breaks due to non-freeze situations, and sump pump failures.

SUMMARY

In the presently described examples of a whole home water appliance (WHWA) system, water damage avoidance/protection is provided throughout an entire water distribution system of a building structure, such as a home, from a single appliance positioned in a sump pit. The whole home water appliance system is a self-contained unitary structure, which provides continuous monitoring, automated scheduled testing/recalibration and automated control using a controller/controller circuitry and cooperatively but independently operable primary and backup pumping systems, and wireless communication, all contained within the structural frame of the appliance. The primary and backup pumping systems are coordinated by the appliance system to be driven by different energy sources to operate independently or cooperatively in accordance with operational availability, operational performance, the projected efficiency of appliance system operation, and the needed pumping volume.

The functionality of the appliance system may be fully performed using automated electrically operated pump control for the primary pump, automated hydraulically operated pump control for the secondary pump, and electronic liquid level sensing system with automated recalibration. Thus, user installation, maintenance and operation activities of the whole home water appliance system are minimized. In addition, the appliance system may include a single point or multipoint water sensor and one or more water control actuators, such as electrically operated shutoff valves, that are supplied incoming sources of water to the building structure. In addition, wireless communication via cellular, Wi-Fi, Bluetooth™, or satellite communication is provided by the system to monitor and control the system using a reliable and robust communication path.

In the past, the cellar in a home was typically used only for storing excess supplies. The basement in a modern home is no longer a cellar. A basement, today, is commonly the lowest cost way for a builder or homeowner to add a large square footage space to a home, and as such, can become a main gathering room for a family because of its size. Today, a basement can also hold expensive furniture and equipment, things that were in the past reserved for the living room in a home. However, basements typically come with a stigma of getting wet or smelling musty, because of constant groundwater seepage in high water table terrains, and poor basement ventilation.

The whole home water appliance system removes the stigma of the musty, or flooding, basement by providing the peace-of-mind that basement flooding and musty smells are being adequately monitored and controlled. Generally speaking, this one piece appliance is installed in a standard existing sump pump pit, utility connections are made, and this single appliance provides 1) a primary electric pedestal-style sump pump, 2) a back-up water powered sump pump (venturi or eductor), 3) a domestic water meter and shut off valve to monitor domestic water use throughout the entire home, and if a leak or abnormal water use is detected anywhere in the home, the water shutoff valve can shut off the domestic water flow, 4) a chemical dehumidification section, with air freshener, to give the basement a fresh smell and lower the relative humidity, and 5) User selectable Wi-Fi, cellular, Bluetooth™, or satellite telemetry to notify the homeowner of critical water events, and domestic water usage patterns, via text messaging and/or a smart phone app. Thus, this one-piece appliance protects the entire home from the most common water damage problems.

Today, the basement, may be a large family gathering place which can hold thousands of dollars in expensive furniture, pool tables, bars, entertainment centers, exercise equipment, home theatre rooms, and more, are frequently protected from ground water seepage by a single, low cost, submersible sump pump. Many first-time home owners don't know where their sump pump is located, or what it does until typically the pump fails for the first time, and water is backed up in their basement, causing water damage that can cost thousands of dollars to repair. At this point, many home owners are educated after the fact about how the sump pump removes basement seepage water, and rain water, from the basement or crawlspace foundation, and pumps it to a safe outdoor location. The sump pump is literally the last line of defense to prevent basement flooding from exterior groundwater. Nevertheless, the basement or crawlspace sump pump is considered an "out of sight, out of mind" product that is not typically considered or maintained until it fails.

The limitations of some systems are primarily in the area that they have not kept up with the changes in basement use. Whereas, flooding groundwater into a basement which is only an unfinished concrete holding room for home repair supplies is frankly not a big deal. Nothing valuable has been damaged, and the concrete floor is simply dried out. However, flooding a basement covered in carpet, drywall, expensive cabinetry, etc. can be an extremely expensive restoration and repair, costing in the thousands of dollars, and many times not covered by the homeowner's insurance policy. Basement flooding is so common, and there are so many "finished" basements today, that many insurance companies will apply limits to what they will repair because frankly it's been a losing proposition for them to insure a fully furnished basement from water damage. Because of how most basements are protected, today, it's simply a matter of time before it floods.

Today, single, submersible sump pumps suffer from the fact that they are the single line, last line of protection preventing a basement from flooding. A single leak into the pump can short-out the winding. This leak can happen through the float-ball control switch, the power cord entry area, or any other place on the pump that is submerged under water. Submerging an electric pump under water is a low-cost way to pump water away, but eventually the seals preventing leaks into the electric motor fail, and subsequently the pump fails.

Single point local water detectors can annunciate with a local siren, however, these devices can detect water only at a single location, and if the homeowner or business owner is not present to hear the siren, then the water/flood condition may continue unabated. Water detectors can provide single point detection and can be connected to a home Wifi system to alert the homeowner when not home. Such systems, however, can typically only detect a single point of water leak, and many owners are not tech savvy enough to successfully connect their water detector to their Wifi router. Additionally, routers can frequently "lock up" and need to be power cycled, and are non-functional during power outage conditions.

Additionally, multipoint local water leak detection systems can alert either via local siren, Wifi text message alert and/or both. Regardless of the number of employed single point sensors, such single point sensors can only detect a water leak in the exact location of the sensor(s). Leaks can occur anywhere; in walls, crawl spaces, inside appliances, and many other locations which are simply not reachable via a single point sensor. It would take a large number of such single point sensors to cover a whole home or other building structure that includes a domestic water distribution network system. Additionally, these single point sensors are typically battery powered. Many times when the sensor is needed the most, such as during a flood event, the sensor battery is dead, and again the event is not detected. Also, a typical homeowner is not a wireless expert, and may not be able to correct wireless reception problems from a battery powered single point sensor as the battery voltage degrades over time. Further, simply moving an object, such as a couch, in front of a single point battery sensor can disable its ability to transmit to a receiver.

In sharp contrast to a monitoring-only system, the whole home water appliance system described herein can include the capability to shut down the main water supply and thus stop a drinking water leak. The whole home water appliance can include one or more water control actuators, such as electrically actuated water shutoff valves, and one or more sump pumps, all in the structural frame so that the system can not only detect a leak occurring anywhere in a building structure to protect the entire building structure, such as a home, and thus minimize damage and insurance claims, but also the system may operate from a reliable power source, such as a micro-hydropower generator so as to not be affected by dead batteries and wireless point sensor connectivity issues.

Thus, the whole home water appliance system can provide a leak protection system that overcomes disadvantages associated with using single and multipoint water sensors. The whole home water appliance can include as internal components, such as an electrically actuated shut off valve, and a sensitive water meter in communication with the cellular radio transmitter; primary and secondary sump pumps, and a micro generator (among other components) all preassembled into the structural frame of the appliance. The electrically actuated shut off valve and water meter system can be included in the appliance and cooperatively operate within the appliance with the other system components. The whole home water appliance can detect excessive water use and alert the user, anywhere in the world, using reliable wireless technology, and substantially simultaneously shut down the water supply to stop the leak by automatically and dynamically actuating the one or more water control actuators. Instead of a single point water detector that merely alerts the homeowner locally on premise, the whole home water appliance may alert locally and remotely, and also substantially simultaneously and automatically shuts down the water source, stopping additional water damage. Additionally, the whole home water appliance can monitor the sump status and level. If the primary sump pump would fail or fall behind for any reason, or the backup water powered secondary pump is started based on failure of the primary pump, or the water meter detects excess water usage, for any reason, the home owner/user is alerted to take action via wirelessly transmitted messages.

The whole home water appliance system includes a multiple redundant sump pump system, that does not rely on a submerged AC motor, and also protects a home from water damage that can happen when a drinking water line freezes and breaks, or a leak develops anywhere in a home domestic water line. Further, redundancy is provided by primary and secondary pumps included in the whole home water appliance system, which are independently controlled from independent prime movers to ensure operation upon electric power loss or equipment failure. In addition to the mechanical pumping redundancy, the whole home water appliance system is equipped with a sophisticated electronic, wireless monitoring system that can alert the home owner via the homeowner's mobile device to "take action" on system issues before a big flood occurs. This is something today's simple sump pumps cannot do.

Features of the Whole Home Water Appliance System

Some of the interesting features of the whole home water appliance system include:

Single appliance with all elements of the system preconfigured, mounted and interconnected within the structural frame of the appliance eliminates the need for complex field installation.

The structural frame is sized, and the elements of the system are operationally arranged within the structural frame, for installation in an existing sump pit with all elements of the system interconnected and positioned (or adjustably positionable) with respect to the liquid in the sump pit for immediate and effective operation.

The primary pedestal mount sump pump electric motor is positioned in the structural frame above the liquid in the sump pit to eliminate pump failures due to seal failures and other water related failure events.

The backup secondary water powered pump provides a redundant pump that is hydraulically powered and controlled to run without electrical power during AC power loss. The secondary pump may also run in parallel with the primary pump to increase water pumping rate during high flow times for a "boost mode". In alternative examples, the secondary pump may be driven by a prime mover provided by an alternative source different from the energy source and/or prime mover used by primary pump and other than water or hydraulic power. For example, the secondary pump may be driven by a prime mover, such as for example an AC or DC motor, supplied by an alternative power source. The alternative power source may be a self-recharging system with energy storage capacity, or a just in time system that when activated or energized may provide the prime mover for the secondary pump. In the example of the prime mover of the secondary pump being a motor, the alternative power source may be an electric power source such as a battery system, a fuel cell system, a generator system, a solar panel system or any other renewable or one-time use system/source of electric power suitable for energizing a motor. Alternatively, or additionally, the secondary pump may be driven by another type of prime mover, such as an engine, compressed air, wind power, or other prime mover that is not an electric motor and provides the operational capability of the secondary pump to provide backup redundancy of operation of the system. The engine may be, for example, a gasoline, diesel, natural gas or any other form of engine.

The primary and secondary pumps may be sized, calibrated and balanced to cooperatively operate to provide optimum pumping, and eliminate field guesswork of trying to match two independent pumps, which are unmatched or otherwise not configured for coordinated cooperative operation.

Emergency pump bypass discharge line monitoring and alarming—the whole home water appliance may include or be coupled with a single common outlet pumping discharge line, that receives a flow of liquid from both the primary pump and the secondary pump. However, immediately after this common outlet discharge line exits the home or structure, to discharge outdoors (outside the structure) to a safe location, this single common outlet discharge line includes a water overflow outlet. The water overflow outlet is an emergency bypass line that enables discharged water to "dump" outside the home if the discharge line downstream of the water overflow outlet is clogged for any reason (i.e. freezing, collapsed pipe, obstruction, etc.). For example, if the common outlet discharge line buried in the homeowner's yard becomes clogged for any reason whatsoever, then the backpressure on the clogged common output discharge line causes the water to reroute through water overflow outlet to the emergency bypass line, in an "emergency mode", and discharge the water at the location of the water overflow outlet, such as directly at the exterior foundation of the home. The advantage of this common discharge line emergency overflow outlet is that both the primary and back-up pumps can both use the same emergency overflow outlet thereby saving on construction and maintenance costs. In addition, even though there is only one discharge line, due to the emergency overflow, the issue of the discharge becoming unusable by the pumps is minimized.

The water overflow outlet may include or be associated with an emergency bypass sensor. The emergency bypass sensor may be a pressure sensor, a conductivity sensor, a flow switch, float switch, a flow meter, a differential pressure sensor, or any other form of sensor capable of identifying a flow of liquid through the water overflow outlet. The emergency bypass sensor may be in communication with the controller circuitry. Communication may be wireless or wired and provide a signal indicative of the presence, or absence of liquid flowing through the water overflow outlet.

At the time the water is re-routed to the emergency bypass line, the controller circuitry senses the flow of liquid in the water overflow outlet and generates an emergency bypass alarm. The controller circuitry may further execute the communication circuitry to wirelessly communicate the alarm message to a mobile device, such as, for example, via a text message. This bypass discharge technique, which works on the principal of back pressure in the discharge line to reroute to the backup emergency discharge, has many advantages over "dedicated" backup pump discharge lines. Either, or both the primary and secondary pumps, can be running separately, or together, and still use this proposed emergency bypass discharge line, whereas with a traditional "dedicated" emergency bypass line, only the backup pump can use the emergency bypass line (i.e. and the backup pump may not be operational). The whole home water appliance system continuously monitors for the flow of water out of the water overflow outlet. In addition, the controller circuitry performs routine tests to confirm the common outlet is unobstructed by monitoring the flow of water out of the water overflow outlet.

Communication circuitry may provide wireless telemetry used as part of the controller circuitry for automatically testing the entire system during non-use times. The wireless telemetry may be used by the controller circuitry to notify a user that the systems are functional. Most home sump pumps are rarely, if ever, tested by the homeowner. The controller circuitry included in the whole home water appliance may automatically test the primary and secondary pumps, and the domestic water shutoff valve on a predetermined, user configurable schedule, such as automatically testing on a monthly basis, so the homeowner knows his systems are working, and action can be taken to correct issues identified during routine testing before a flood occurs. Accordingly, the WHWA can monitor a local or national local weather channel via internet connection, and if a severe storm is predicted for a locale, the system can auto initiate a full system pumping test, and then alert the homeowner, via their smartphone(s), for example "A strong storm is predicted for your area in the next 12 hours. A complete system test of your basement water protection system was performed. Your basement is protected!" Alternatively, if the WHWA did not pass the system test, then the homeowner is alerted accordingly so he can take action before the storm hits. Additionally, or alternatively, the WHWA may be sent an instruction in the form of a text message to perform a self-test and report results that inform of the weather event and the test results. The instruction may be by an entity monitoring the weather that has identified the WHWA as being in the path of an upcoming weather event that pushes a self-test instruction to the identified WHWA. The diagnostic test instruction may be an individual message or a group message to a number of WHWA systems in the area or path of the weather event.

An example of the testing routine includes the controller circuitry automatically filling the sump pit with water from the municipal utility water source, in order to exercise all the pumps. In addition, the controller circuitry may perform water draw-down testing to confirm operation and performance of the primary and secondary pumps. In an example, the controller circuitry may independently and/or in combination time the associated water draw-down time of the primary pump and the secondary pump, and compare the timed draw-downs to predetermined draw-down times for one or both pumps operating to determine that all systems are pumping at a normal capacity, such as rated capacity. In addition, the domestic water shut-off valve may be exercised, and the water flow meter monitored, to ensure the valve close/open is functional, and associated water flow is stopped. Once the pumps are fully tested, other systems variables are also tested, such as battery backup, cellular radio, memory, real time clock, and other variables for a complete system test. In this way, the system is self-diagnosing, and if any aspect of the entire system is not operating correctly, the homeowner is notified via smartphone(s) so they can take corrective action. A full test report of systems may be sent, such as in a text message, automatically, to the homeowners phone app, and if an abnormality occurs, the homeowner is alerted via an alarm, such as a text message, on the homeowner's phone, and audible sound on the appliance. In alternative examples, the system may send a short message, such as a "system self-test passed" text message if the diagnostic tests are successful.

A rechargeable battery may supply power to electronic components in the system, such as the controller circuitry and the communication circuitry in the event of supply power loss. The system may also include a low battery alarm. The low battery alarm may be a visual and/or audible indicator included in the user interface of the whole home water appliance. Alternatively, or in addition, the low battery alarm may be provided in a text message.

A sump pit liquid level sensing system may include, for example, liquid level sensing in the form of a sensorless pump control—in this example, one or more pressure sensing tubes are included in the structural frame and a distal end of the tubes may extend into the sump pit well. The pressure sensing tubes may be connected to respective pressure sensors, such as a low pressure sensor, positioned above the level of liquid in the sump pit, such as in the electronics housing. The pressure sensor is mounted above the water level, and senses the height of the water level using the hydrostatic pressure measurement technique. In an example measurement technique, each 2.31 foot of water height=1 psig of pressure. This is a linear relationship which may be converted into water level by the controller circuitry included in the whole home water appliance system.

Alternatively, or in addition, the sump pit liquid level sensing system may include water level sensing by one or more laser pump controls, such as a dual laser pump control. The system may include one or more time of flight (TOF) sensors that include lasers positioned to generate a beam of light energy down a vertical shaft or vertical sensing tube, such as one (or multiple) frame side support elements included in the whole home water appliance system. The vertical shaft or vertical sensing tube may be included in a column included in the structural frame. One or more columns are positionable with a distal end of the columns immersed in the liquid at the bottom of a sump pit. Multiple TOF sensors may be positioned toward a proximate end of respective columns. The multiple TOF sensors may be used to provide backup or redundancy to guard against hardware failure or an erroneous level reading. During operation, the light energy emitted by the laser(s) may reflect off a float that's "trapped" in the vertical sensing tube. The float will rise/fall as the water level rises/falls in the sump pit. These sensor(s) communicate level information to the controller circuitry included in the whole home water appliance system. In an example, communication may be via two dedicated I2C communications buses. In other examples, other forms of sump pit water level sensing may be used by the controller circuitry to control the primary and/or back up pumps.

The controller circuitry may automatically start and stop the primary pump, as needed, based on the level measurement(s), eliminating the need to continuously monitor a traditional float switch that hangs in the well, and is traditionally a point of failure due to switch failure. A unique aspect of level measurement using the sensing tube in association with the sensorless pump control or the laser pump control is that the controller circuitry can "recalibrate" the level reading at any time by running the pump(s) until the liquid in the sump pit is below the normal shutoff range (i.e. below the bottom of the sensing tube), and thus reintroduce a new air pocket into the sensing tube. In the case of the sensorless pump control, the water level is then allowed to rise to submerge the end of the tube, resetting the pressure applied to the pressure sensor, and resetting the water level starting point, and re-zeroing the pressure sensor, eliminating the need for manual calibration. In the case of the laser pump control, the lasers are "zeroed" by the controller circuitry while the liquid level is below the bottom of the sensing tube and the float is at the bottom of its float travel range in the sensing tube, thereby eliminating the need for manual calibration.

Examples of the sump pit liquid level sensing system may also include as level sensors dual back-up float switches. The dual back-up float switches may be adjustably positioned on the structural frame above (i.e. at a higher elevation) the normal liquid level to provide a backup or redundant hall-effect style dual float switch that can signal the controller circuitry if the liquid level would ever rise to this point, indicating that there is a malfunction in the sump pit liquid level sensing system. These backup floats are redundant, so that if the first low level float is triggered, the primary pump is automatically started and the homeowner is alerted that the system is operating on backup float control. If the liquid level would continue to rise to the second float level, the system may generate an alarm message to notify the homeowner with a critical alarm message indicating a possible flood condition.

The sump pit liquid level sensing system may also include as level sensors a hydraulic float switch. In examples, the backup pump may be a venturi (water powered) pump, which is a completely mechanical pumping system that starts/stops based solely on, for example, the hydraulic float switch included in the sump pit liquid level sensing system. In other examples, the hydraulic float switch may control other forms of prime movers, such as an electric motor or other device by completely mechanical means to drive the secondary pump. With internet hacking and security issues, this mechanical pumping system can operate to keep the basement dry even if the primary electronics, such as the controller circuitry, are completely compromised. The hydraulic float switch for the secondary pump may be a hydraulic float ball adjustably positioned in the structural frame above sump pit at an elevation that is higher than both the operating range of the water level sensors, such as the pressure sensors or the laser level sensors, and the dual back-up float switches. If water level in the sump pit rises to the elevation of the hydraulic float switch, then municipal water supply pressure operates the venturi pump without the need for AC power or battery backup. Additionally, during high flow periods, this water powered (venturi) pump may cooperatively run in tandem with the primary pedestal pump, such as an AC powered pump, to provide a "boost mode" of increased water flow. The primary and secondary pumps in the system have been selected and sized for this purpose, and do not "buck" each other due to incompatible pump curve characteristics.

The system may include a dehumidification system, and in this example the dehumidification system may include a dehumidification tray. The dehumidification tray may hold a desiccant, such as a pouch(s) of calcium chloride which absorbs humidity from the air in the basement. The pouches may be any form of air permeable membrane. A fan on the whole home water appliance draws in basement air, this air is blown across the calcium chloride pouch(s), and fresh air is exhausted from the appliance. The pouches also contain scented beads that scent the exhausting air to the give the air a fresh smell similar to an air freshener. This process eliminates the stigma of the musty smelling basement. As the calcium chloride crystals absorb moisture, they turn into water which is allowed to drip into the sump, and be conveniently pumped away, or remain contained in the pouch for convenient replacement/disposal. The controller circuitry may monitor the pouch, such as with a weight or moisture sensor, and when the desiccant is depleted, the homeowner may be alerted via wireless telemetry that it's time to replace the pouch. This alert can arrive via the phone app or text message, and the message may include an embedded link, so if the customer merely presses the link on their phone, he is brought to a desiccant vendor, such as Amazon™, or other online retailer, for convenient ordering where the pouches are typically delivered the next day to their home, eliminating the need to run to the store to get replacements.

A wireless transmitter included in the communication circuitry of the whole home water appliance system may use an internal battery backup included in the whole home water appliance, and can alert the homeowner of a power loss event. In addition, the one or more electrically actuated shutoff valves may be operated with the internal battery backup. Many times water damage occurs during power loss events when pipes can freeze due to a non-functioning furnace, and the sump pit overflows because the sump pump cannot operate. The battery backed reliable cellular technology coupled with the water control actuators, such as an electrically actuated water shutoff valve, provides the ability for detection of even the tiniest of leaks anywhere in the building structure domestic water piping network, eliminating the need for multiple battery power remote single point sensors. The whole home water appliance, including the water meter and shutoff valve may be powered by reliable AC power during operation, and the internal backup battery automatically powers the whole home water appliance, including the cellular transmitter included in the communication circuitry and the water control actuator, during AC power loss.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Moreover, the examples described herein described different hardware and functionality. In the interest of brevity, such descriptions are not repeatedly discussed throughout. Instead, it should be recognized and understood that the different hardware and functionality configurations described may be interchangeably applied to any of the various examples provided. In addition, such hardware and functionality configurations can be arranged to cooperatively operate in the same example, even in the case where no such cooperation is explicitly described herein.

Figure 1:
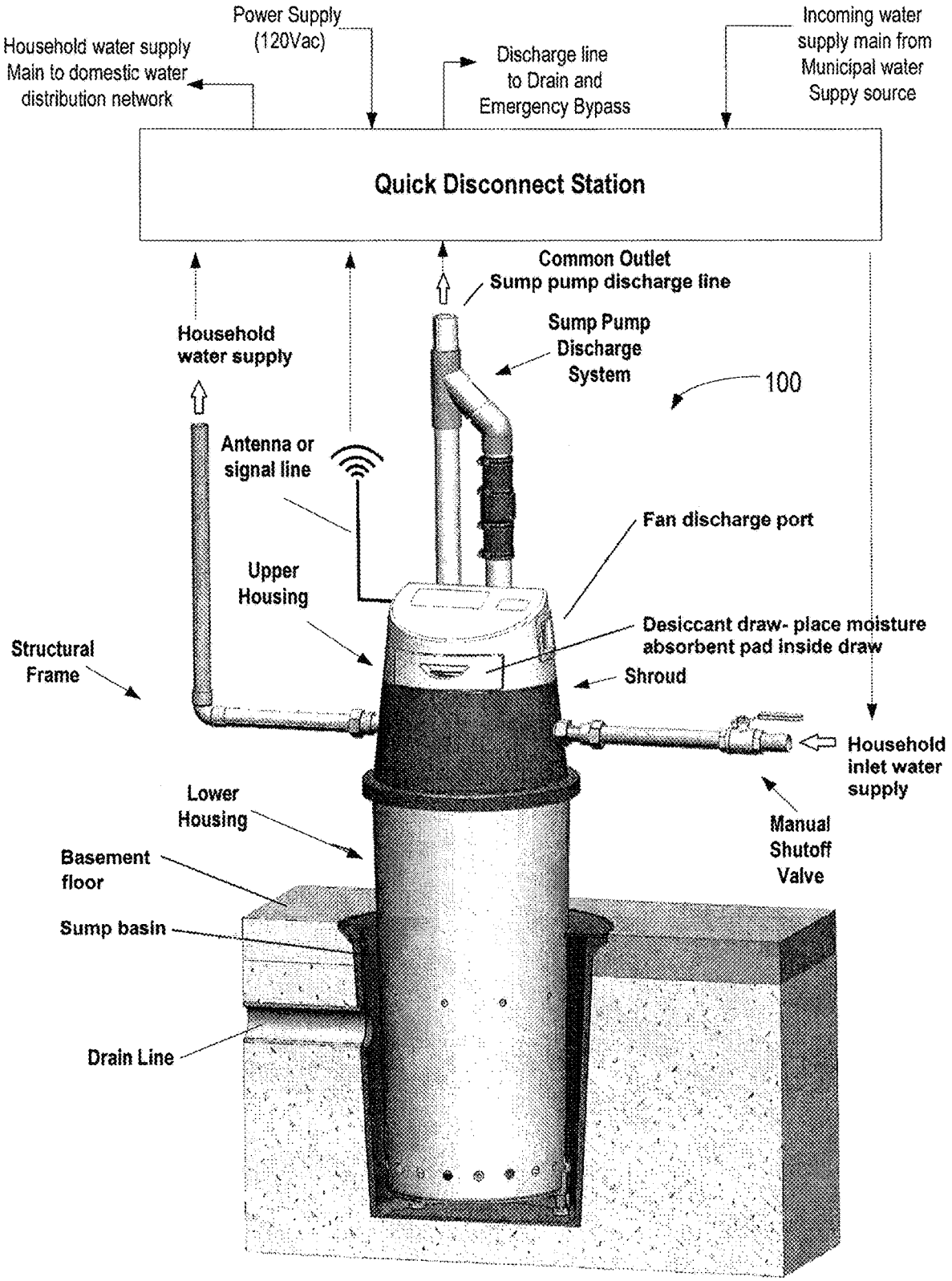
FIG. 1 is a perspective view of an example whole home water appliance system.

FIG. 1 is a perspective view of an example whole home water appliance system 100. The whole home water appliance is illustrated as structural frame in the form of a housing installed in a sump basin or sump pit. In this example, the structural frame includes an upper housing or shroud position above the sump pit and a lower housing positioned in the sump pit. The sump pit may be, for example, formed as a recess in a basement floor to include at least one drain line supplying liquid, such as water to the sump basin. In other examples, the whole home water appliance may be installed in other locations and/or applications so as to receive a flow of drainage liquid, such as water. Although hereinafter described as operative with water, it should be understood that the whole home water appliance may operate with any other flowing liquid. As used herein, the terms "water" and "liquid" are interchangeable when describing the contents in the sump pit. In addition, although described with respect to a residential home or house or household, the whole home water protection application may also be applied in any other form of enclosure, such as a barn, a warehouse, commercial building, a garage or any other structure where water may be present.

The whole home water appliance system 100 may be configured to interface with a quick disconnect station. The quick disconnect station may receive an incoming water supply main line, a power supply line, a discharge to drain line, and an outgoing household water supply main line as permanently installed lines. Interfacing between the whole home water appliance and the quick disconnect station may be via flexible lines with couplings, such as quick disconnect fluid lines and electrical plugs. In this way, construction of the home may be substantially completed, with the permanently installed lines coupled with the quick disconnect station prior to installation of the whole home water appliance. Upon installation of the whole home water appliance in the sump, connectors included on the whole home water appliance may be coupled with the quick disconnect station to complete the install. The individual connectors may be coded and sized such that only the correct line may be coupled with the quick disconnect inlets and outlets on the quick disconnect station. In FIG. 1, the household inlet water supply line to the whole home water appliance is illustrated as including a manual shutoff valve, however, in other examples, the manual shutoff valve may be included in the quick disconnect station with a manual bypass valve, or in the incoming water supply main prior to the quick disconnect station.

The whole home water appliance may also include a sump pump discharge system. The sump pump discharge system may receive a discharge of sump water from two or more different independently operational sump pumps included in the whole home water appliance. The sump discharge system is configured to allow the cooperative operation of these different sump pumps so that the sump pumps may operate independently, or additively to evacuate the sump basin. The output flow of water from the sump pump discharge system may flow through the common outlet sump pump discharge line and a quick disconnect into the quick disconnect station, and then to the permanently installed common outlet discharge line to a drain located exterior to the structure. Although the sump pump discharge system is illustrated as being external to the structural frame of the whole home water appliance system, in other examples, both the sump pumps and the sump pump discharge system may be included within the structural frame.

The structural frame extends down into the sump basin such that a lower housing portion of the structural frame may be submerged in liquid in the sump basin and an upper portion of the housing extends above the sump basin to remain separated away from the water in the sump basin. The lower portion of the housing may include any form of egress that allows the flow of liquid present in the sump basin into the lower portion of the housing. In FIG. 1, the lower portion is illustrated with a series of holes in the housing to allow the ingress of liquid, however, in other examples, slots, a screen, one or more openings, or any other form of water penetrable ingress may be used to flow liquid present in the sump basin into the lower housing.

The upper housing, or shroud may also include a desiccant drawer access for receipt of air freshening/moisture reducing material, and a fan discharge port to create a positive air flow across the air freshening/moisture reducing material. The upper housing may also include an antenna to provide wireless communication with the whole home water appliance. Alternatively, or in addition, the upper housing may include a quick disconnect signal cable such as a CAT5 cable or a coax cable capable of coupling with a connector included in the quick disconnect station. An antenna cable routed to the quick disconnect station from an external antenna located elsewhere in or on the home, and/or a network cable routed to a home network such as a local area network, a repeater or a router may be permanently connected to the quick disconnect station so that the quick disconnect electrical cable upon being coupled with the quick disconnect station is coupled thereto.

Figure 2:
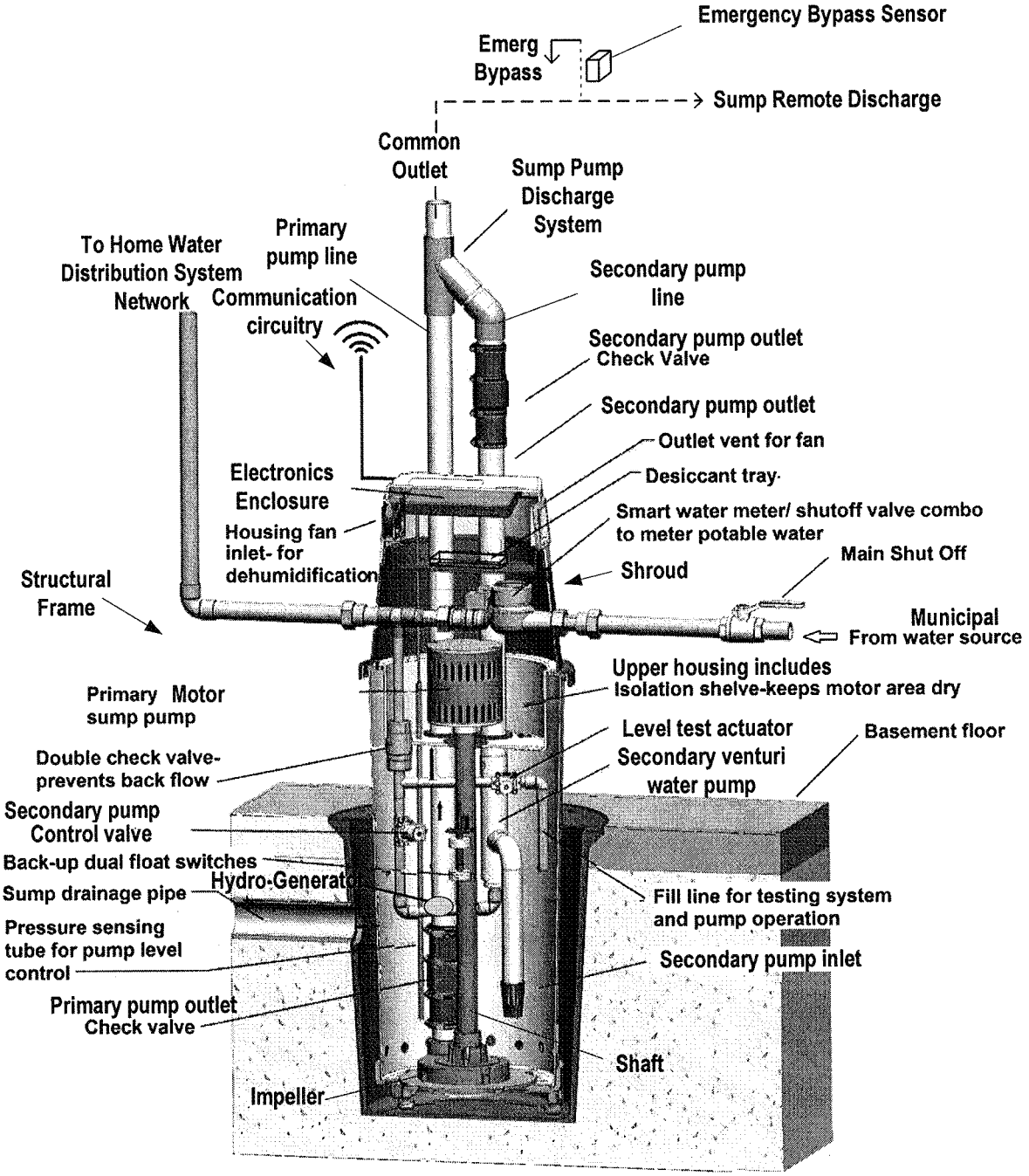
FIG. 2 is a cutaway perspective view of the example whole home water appliance system illustrated in FIG. 1.

FIG. 2 is a cutaway perspective view of the example whole home water appliance illustrated in FIG. 1. The whole home water appliance includes a primary sump pump extending from the lower housing into the upper housing, and a secondary sump pump included in the upper housing and extending a suction tube into the lower housing. The primary sump pump may be a pedestal style pump with a shaft extending between an electric motor, such as an AC (alternating current), or DC (direct current) motor positioned in the upper housing, and an impeller positioned in the lower housing at the base of the sump basin. The primary sump pump may be energized and deenergized by a relay or contactor, or other form of electrically operated switch, positioned in the upper housing based on a sensed level of liquid in the sump basin. The secondary sump pump may be a venturi water pump, which may be energized and deenergized with a prime mover which is a flow of pressurized water from the incoming water supply main controlled with a secondary pump motorized ball valve or hydraulically operated diaphragm valve. In alternative examples, the secondary pump may be driven by a prime mover provided by an alternative source different from the energy source and/or prime mover used by primary pump and other than water or hydraulic power. Accordingly, the pumps may operate independently and autonomously from two different power sources to provide pumping redundancy in the system. The primary pump may be energized by AC power provided by an external supply and/or a rechargeable DC supply, such as batteries.

The primary and second sump pumps may be operated with a controller circuitry included in the electronic enclosure to provide pump level control. In other examples, the controller circuitry may control operation of the primary pump, and the secondary pump may be controlled by mechanical switching, such as by a hydraulic level switch, which is independent of the controller circuitry. The controller circuitry may be hardware such as a processor and/or other device(s) capable of executing logic and directing operational functionality of the whole home water appliance system. The controller circuitry may also include a memory storing commands executable by the controller circuitry and system data. The controller circuitry may also control the overall operation/functionality of the system. In addition, the controller circuitry may operate/control communication circuitry, which includes telemetry. Further, the controller circuitry may initiate and manage automated diagnostic testing of the system. Also, the controller circuitry may control and manage alarming and calibration of the system. In addition, the controller circuitry may manage communication with the user via SMS and/or via voice, or data to push information to the user (such as a homeowner)/maintainer (such as a plumber) of the system, as well as respond to requests from users/maintainers. Also, the controller circuitry may manage data storage and archiving, data analysis of trends, generation of trend graphs and other operational information, report generation to a user, and programming updates received via the communication circuitry. Further, the controller circuitry may sense parameters such as motor current, primary and secondary pressures and/or flow rates, levels and any other parameters and dynamically react accordingly. In addition, the controller circuitry may derive operational parameters from sensed parameters, such as sensing a current flow of the primary AC motor and deriving or extrapolating water flow rates therefrom.

In an example configuration, the controller circuitry may operate the whole home water appliance to evacuate water from the sump basin in any one of three modes in accordance with a sump basin level. The controller circuitry may operate the whole home water appliance in a first mode by activating the primary sump pump based on a level of liquid sensed with the pressure sensing tube and the pressure sensor or laser pump controls. As the liquid level rises, the pressure in the pressure sensing tube increases or the float rises. Upon the pressure or the vertical position of the float reaching a first predetermined threshold corresponding to a level of water in the sump basin, the controller circuitry may electrically energize the primary sump pump to evacuate the sump basin at a first evacuation rate. If the liquid level continues to increase to a second predetermined threshold, the system may enter a "boost mode" in which the secondary sump pump is energized by water as the prime mover to cooperatively operate with the primary sump pump to increase the rate of liquid evacuation from the sump pit at the first evacuation rate to a second evacuation rate greater than the first evacuation rate. In other examples, other forms of level sensing may be used.

The system may also include a backup sump basin level detection in the form of, for example, a hall-effect style dual back-up float switches. The backup sump basin level may be triggered at a level of water in the sump basin that is above the first and second predetermined threshold levels. In an example, the backup sump basin level may be multiple float switches such that a first float switch being triggered energizes the first sump pump, and a second float switch being triggered energizes the secondary sump pump in the boost mode. A detected failure of the primary sump pump may also initiate energization of the secondary sump pump.

In addition, or alternatively, the choice of energizing the primary sump pump or the secondary sump pump, or both, may be performed by the controller circuitry based on operational factors. Such operational factors may include: 1) the rate at which the water level in the sump basin is increasing/decreasing; 2) the availability of the power sources (electricity for the primary sump pump and municipal water pressure/flow for the secondary sump pump); 3) the financial cost of operation of the primary and the secondary sump pumps (electric vs. municipal water utility costs); 4) the effective flow rates of the primary and secondary sump pumps; and/or 5) external factors such as the weather (predicted rainfall) provided to the controller circuitry, a user input, or some other factor outside the operation of the whole home water appliance that may affect sump basin water level, evacuation rate, and or fill rate. External factors may be user entered, such as cost per KWH of electricity and cost per gallon for municipal water, or may be sensed, or retrieved by the controller circuitry.

The system may include a miniature hydro-power generator or micro generator to provide backup power. The hydro-power generator may be positioned in the housing in the water supply line to the secondary pump, after the secondary pump motorized ball valve that runs the venturi pump. In this way, electricity may be generated by the hydro-power generator when the ball valve is opened to run the venturi pump. Thus, the flow of water not only runs the secondary pump, but also generates electricity from the micro generator. In this way, when external power is unavailable, the secondary sump pump may operate and the functionality of the whole house water appliance, including the controller circuitry, sensors, and ball valves may remain powered and operational. In addition, the micro generator may charge batteries or other energy storage devices in the system.

The outlet of the primary sump pump from the impeller flows through a primary pump outlet check valve to the common outlet and the sump pump discharge system via a primary output line. In addition, the outlet of the secondary sump pump flows through a secondary pump outlet check valve to common outlet and the sump pump discharge system via a secondary output line. From the common outlet, the liquid may flow through the sump discharge line to a remote drain location. The sump discharge line may include an emergency bypass line monitored by an emergency bypass sensor to indicate when the sump discharge line is clogged.

Flow rate of the primary sump pump may be based on the revolutions per minute of the impeller/AC motor and/or the unobstructed water flow to the impeller, and is sufficient to open the primary pump outlet check valve. The secondary sump pump flow rate may be based on the flow rate and pressure of the municipal water source, since the venturi principal relies on drawing a vacuum at the secondary pump inlet based on the flow rate and pressure of the municipal water source. The secondary sump pump flow rate is sufficient to open the secondary pump outlet check valve.

The sump pump discharge system receives a flow of water from one or both of the outputs from the primary and secondary sump pumps. In FIG. 2, the sump pump discharge system is illustrated as being external to the housing, however, in other example configurations, the sump pump discharge system may be integrated into the housing with the primary and secondary sump pumps and the telemetry, etc. The flow received by the sump pump discharge system from the primary sump pump may have a relatively high volume flow with a relatively low head pressure, and the flow received from the secondary sump pump may have a relatively low volume flow with relative higher head pressure. In an example, since both the primary and secondary sump pumps are in a single structural frame or enclosure, a pump curve of each of the pumps may be matched so that the pumps cooperatively operate, rather than inadvertently closing either the primary pump outlet check valve or the secondary pump outlet check valve due to the respective flow rates and pressures. In other words, the discharge head of the primary and secondary sump pumps may be calibrated to operate at the same time without either pump being shut down due to closure of a respective check valve, or dead head operation. In an example configuration, the highest and lowest possible head discharge pressures of the primary sump pump and the secondary sump pump may be used to develop ranges of cooperative operation where the primary and the secondary sump pumps may operate simultaneously to provide additive flow output.

In another example configuration, the system may include a secondary pump motorized ball valve, or some other style of valve, which may be dynamically adjusted by the controller circuitry to control the flow and pressure of the municipal water source, in order to align or match the pressure of the primary sump pump output flow to the secondary sump pump output flow. As the flow rate and/or pressure of the primary sump pump changes during operation, the secondary pump motorized ball valve may be dynamically actuated by the controller circuitry to effectively match the pressure. In an example configuration, the secondary pump motorized ball valve may be a "V" cut ball valve to control the flow. In this example configuration, the granularity of control of the secondary pump motorized ball valve may be significantly greater than in a ball valve without the "V" cut. Thus, the controller circuitry may be relatively more precise with controlling the flow of the municipal water supply into the system.

Figure 3:
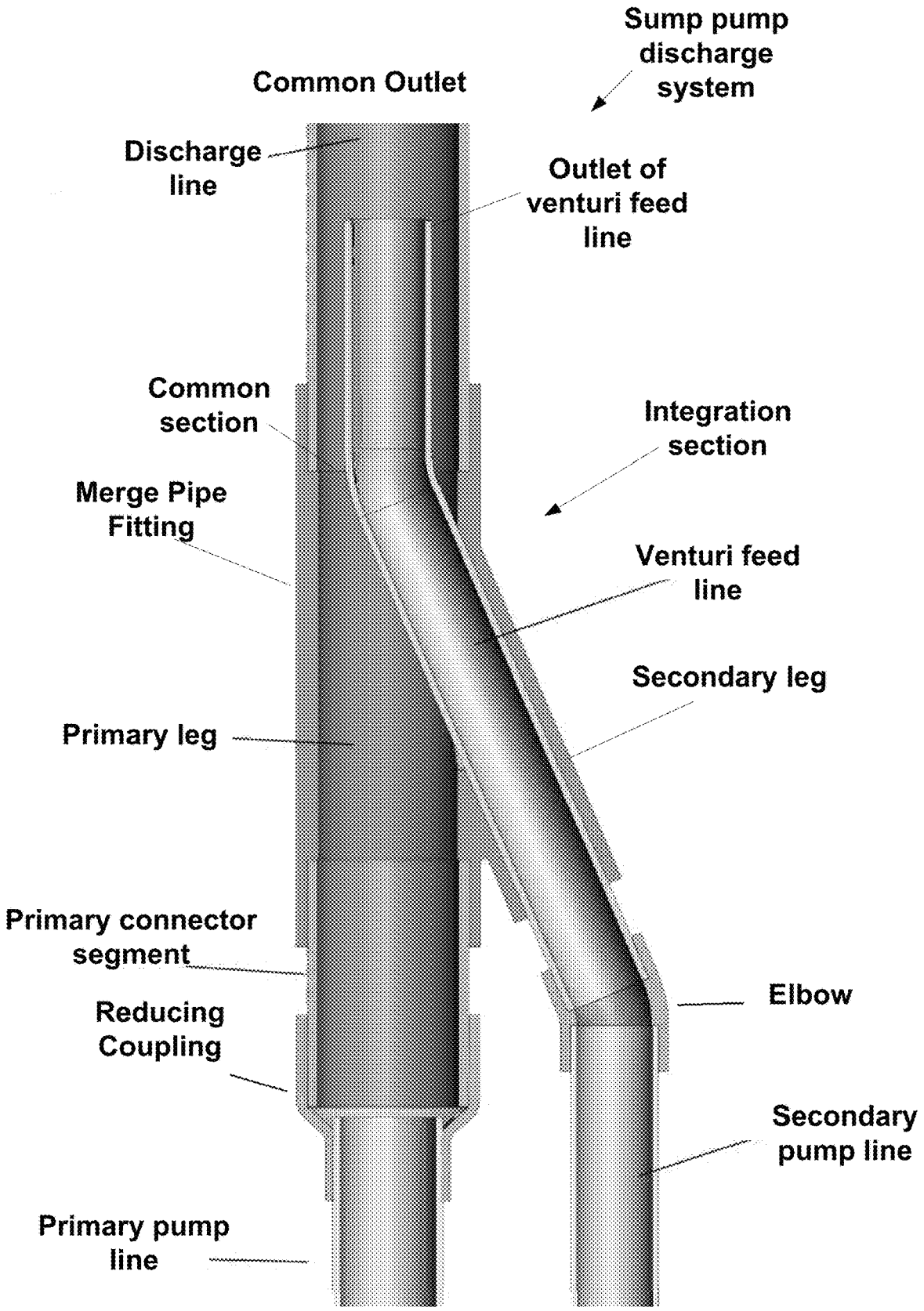
FIG. 3 is a cutaway of an example outlet system useable in the whole home water appliance.

FIG. 3 is an example of a sump pump discharge system. The system may receive a flow of water from one or both of the primary pump line and the secondary pump line. In an example configuration, the primary pump line may be a 2" PVC line resulting in 3.36 square inches of flow area, and the secondary pump line may be 1.5" PVC line resulting in 2.04 square inches of flow area. In the illustrated example, the primary pump line may be coupled with reducing coupling, such as a 2"×3" PVC coupling, in order to increase the line size to 3" and couple with a primary connector segment, which may be, for example, a 3" PVC line. In other examples, other sizes of lines, and materials of construction may be used, such that, for example, the reducing coupling and connector segment may be omitted.

The connector line may couple with a first leg of a merge pipe fitting included in an integration section of the sump pump discharge system. In addition, the secondary pump line may be coupled with an elbow have an angle with a predetermined number of degrees of offset, such as a 1.5" PVC elbow with a 23 degree angle. The elbow may be coupled with a venturi feed line, which is coupled with a second leg of the merge pipe fitting included in the integration section. The venturi feed line may be made of a rigid material such as plastic or stainless steel and may include a first straight section, an elbow section and a second straight section. The venturi line may extend through the integration section such that the first straight section is concentrically positioned in the second leg of the merge pipe fitting, the elbow section may be positioned in a common section of the merge pipe fitting, and the second straight section may be concentrically positioned in the common section and extend into a discharge line of the integration section. The merge pipe fitting may, for example, be formed as two separate halves that may be coupled together to surround a portion of the primary connector segment, the discharge line, and the venturi feed line. With regard to the venturi feed line, the merge pipe fitting may fully surround the elbow segment, and partially surround the first straight section and the second straight section as illustrated in FIG. 3. In an example, the elbow section may include a 23 degree angle such that a central axis of the second straight section is positioned concentrically with a central axis of the primary pump line, and in parallel with a central axis of the secondary pump line. In an example, the common output discharge line may be a 3" PVC pipe providing a flow area of 7.4" square inches. Alternatively, the primary and secondary pumps can be connected with another form of merge pipe fitting.

The integration section may allow cumulative addition of the flow of water from each of the primary pump line and the secondary pump line by introducing or mixing the flow of water from the secondary sump pump into the flow of water from the primary sump pump within the discharge section. Since the flow of water from the primary sump pump surrounds the second straight section prior to the mixing of flows, both flows become laminar in a common flow path prior to the outlet of the venturi feed line positioned within the discharge line. Thus, when the flows from the primary and secondary pumps are cumulatively added neither the flow from the primary or the secondary sump pump is ended. The flows are not ended due to the absence of back pressure at either the primary pump outlet check valve or the secondary pump outlet check valve. Instead, due to the laminar introduction or merge of the two different flows, the combination of the flows from the primary sump pump and the secondary sump pump are cumulatively additive to increase the flow of water being evacuated from the sump basin by at least 1.5 times the flow of water evacuated by with the primary pump or the secondary pump operating alone.

Figure 4:
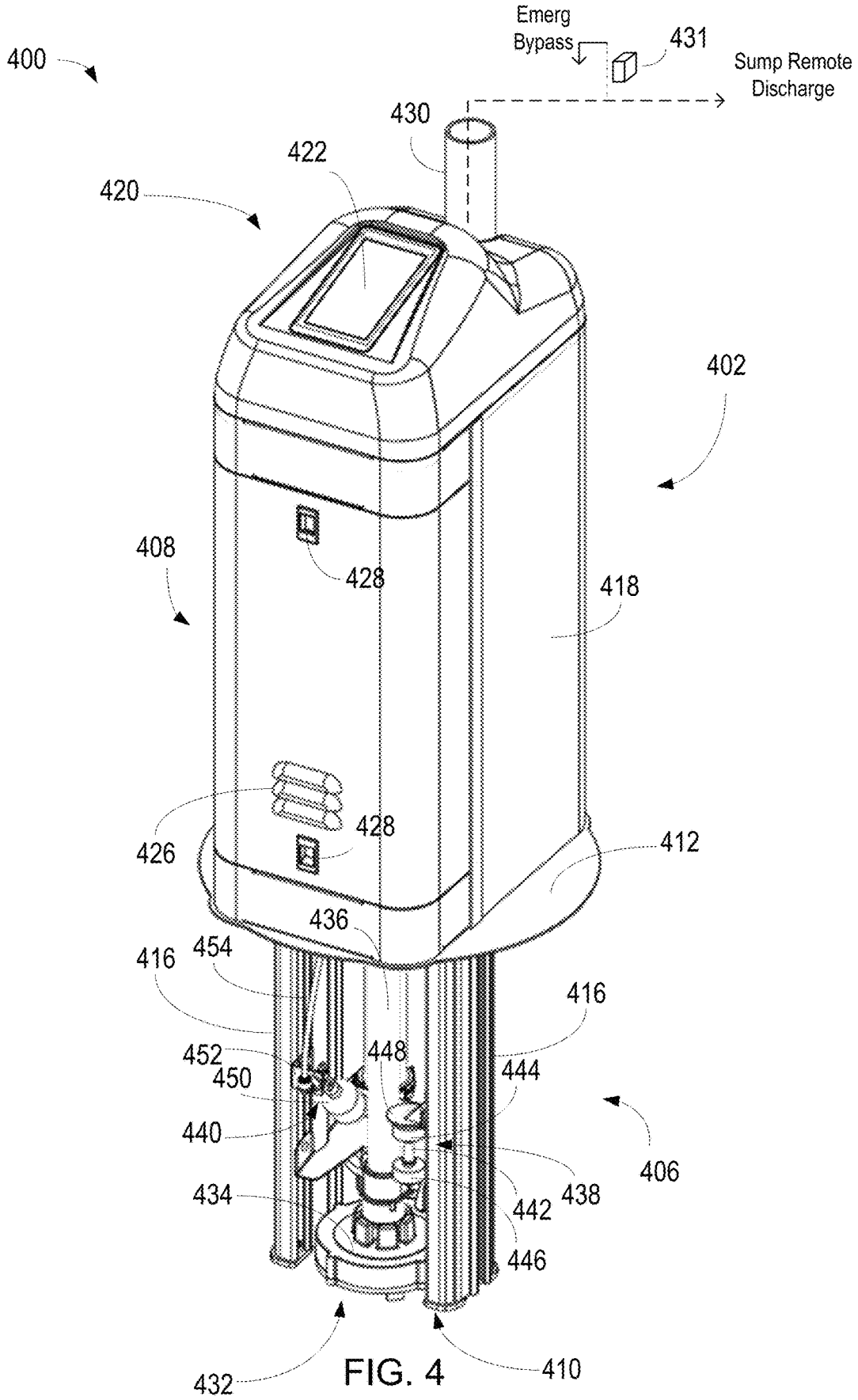
FIG. 4 is a perspective front view of an example whole home water appliance system.

FIG. 4 is an example of a whole home water appliance system 400. The whole home water appliance system 400 includes a structural frame 402 within which the elements of the system are positioned. Elements of the whole home water appliance system 400 include a primary pump and a secondary pump. The prime mover of the primary pump may be different than the prime mover of the secondary pump. In an example configuration, prime mover of the primary pump may be an electric motor, and the prime mover of the backup pump may be pressurized water. whole home water appliance system 400. In alternative examples of the whole home water appliance system 400, the secondary pump may be driven by a prime mover provided by an alternative source different from the energy source and/or prime mover used by primary pump and other than water or hydraulic power.

The structural frame 402 includes a lower portion 406 and an upper portion 408. In this example, the lower portion 408 is sized for receipt in a sump pit such that a distal end 410 of the structural frame 402 rests on a bottom surface of the sump pit, and a cover 412, sized to cover the sump pit and serve as a divider between the lower portion 406 and the upper portion 408 is positioned above the sump pit. The structural frame 402 includes columns 416 positioned on opposing sides and forming the distal end 410 of the structural frame 402. In the illustrated example, the columns 416 are a pair of columns aligned in parallel on opposing sides of the whole home water appliance system 400 and extending between the distal end 410 and a proximate end near the top of the whole home water appliance system 400.

A shroud 418 is disposed to surround the upper portion 408 of the structural frame 402 and is coupled thereto. An electronics enclosure 420 is included within the upper portion 408 of the structural frame 402 and surrounded by the shroud 418. In an example, the electronics enclosure 420 may be included as part of the shroud 418. In this example, circuitry included in the electronics enclosure 420 may be interfaced through connectors, such as quick disconnect connectors, to wiring internal and external to the structural frame 402 of the whole home water appliance system 400 so that the shroud is removable from the structural frame 402.

The electronic enclosure 420 includes user interface functionality, a portion of which is a graphical user interface 422, the controller circuitry, memory, communication circuitry, and other electronic circuitry related functionality within the whole home water appliance system 400. The electronics and/or circuitry included in the whole home water appliance system 400 are not limited to being disposed only in the electronic enclosure, and may also be disposed anywhere within the structural frame 402. Also, electronics circuitry included in the electronic enclosure 420 may extend or be accessible from outside the electronics enclosure 420. In the illustrated example, the graphical user interface 422 extends through an opening in the shroud 418 so as to be readily accessible to a user. The graphical user interface 422 may be a display screen, such as a color touch screen, that includes functionality similar to a mobile device such as a smartphone. In other examples, visual indicators, such as light emitting diodes (LEDs), push buttons, rotary knobs, switches and other such user interface mechanisms may extend through or otherwise be accessible from outside the shroud 418.

The shroud 418 also includes a vent 426, which may provide a source of cooling air, or an intake or exhaust for a fan, such as the fan included in the dehumidification system, for deodorizing or desiccant air flow or both. The vent 426 may also allow light from light emitting diodes LEDs included in the shroud to be emitted, or spill out, from inside the appliance. The LEDS may be energized, for example, upon detection of motion from a motion detector, such as a microwave motion detector to provide light to a user entering the vicinity of the appliance. In other examples, the one or more vents may be formed in the shroud in other locations. The shroud 418 may also include one or more latches 428 to enable removal of all, or a portion of, the shroud 418 for maintenance or inspection.

In the illustrated example, a common outlet 430 may be coupled with the structural frame 402 and extending through the shroud 418. In other examples, the common outlet 430 may be external to the structural frame 402 and/or the shroud 418. The common outlet 430 is coupled to a sump discharge line to carry liquid extracted from the sump pit to a sump remote discharge location, which is outside the structure. The sump discharge line may include an emergency bypass overflow line, which is monitored with an emergency bypass overflow sensor 431. The emergency bypass overflow sensor 431 may generate a signal indicating liquid is flowing in the emergency bypass overflow line.

A primary pump 432 may be included in the structural frame 402 such that an impeller 434 included at the end of a shaft 436 is positioned between the columns 416 at the distal end 410 so as to be immersed in liquid in the sump pit. Also illustrated in FIG. 4 is an example of level sensors includes in the sump pit liquid level sensing system. In FIG. 4, dual back-up float switches 438 and a hydraulic level sensor 440 are shown, which are slidably positioned using respective brackets coupled to the columns 416 within the structural frame 402.

The dual back-up float switches 438 of the illustrated example include a post 442, a first float 444, a second float 446, and a hall effect sensor 448. Each of the first float 444 and the second float 446 include a magnet, and the hall effect sensor 448 operates to provide a digital signal indicating a predetermined level of liquid has been reached. In another example, the dual back-up float switches 438 may include an analog transducer to provide a signal indicative of a distance between the sensor 448 and the first and second floats 444 and 446. The second float 446 is a redundancy backup for the first float 444, in the case of failure or malfunction of either one of the first float 444 or the second float 446, the hall effect sensor 448 will still sense the non-malfunctioning float upon the float dynamically moving vertically away and toward the sensor 448. The digital signal generated by the sensor 448 may be supplied to the controller circuitry. The controller circuitry may execute communication circuitry to wirelessly transmit alarm messages, such as text messages, indicative of a high liquid level in the sump pit. In addition, the controller circuitry may, upon sensing a malfunction, wirelessly transmit an alarm message, such as a text message, indicative of a float malfunction.

The digital signal provided by the hall effect sensor 442 to the controller circuitry represents a position of the respective float based on the corresponding magnetic field of each of the first float 444 and the second float 446 along the vertical length of the post 442. The digital signal may be provided to the controller circuitry for each float 444 and 446 or as a single signal. Thus, as the level of liquid in the sump pit varies, the first and second floats 444 and 446 travel vertically up and down the post 442 and the sensor 448 dynamically provides one or more digital level signals to the controller circuitry. The controller circuitry may monitor the first float 444 and the second float 446 for accuracy and proper function by dynamic comparison of the float digital signal(s) provided by the hall effect sensor 448. In an example, digital signals provided from the respective first and second floats 444 and 446 may be compared to a predetermined threshold deviation value such as +/_5%. In addition, or alternatively, the controller circuitry may, for example, compare the float position signal(s) to level signals provided by, for example, the pressure sensor level signals or the TOF sensor signals.

The hydraulic level sensor 440 includes a hydraulic float 450 and a hydraulic valve 452. The hydraulic float 450 may travel vertically in a range between a maximum and a minimum height based on an upper mechanical stop and a lower mechanical stop, provided by, for example, the hydraulic valve 452. When the hydraulic float 450 is near the lower stop—near the bottom of vertical travel, the level of liquid in the sump pit is below the hydraulic float 450, and the hydraulic valve 452 is closed. When the hydraulic float 450 is near the upper stop—near the top of vertical travel, the level of liquid in the sump pit has floated the hydraulic float 450 vertically since the level is at or above the upper stop, and the hydraulic valve 452 is opened. When the hydraulic valve 452 is open, pressure in a pressure signal line 454 is released and the secondary pump is activated to being extracting a flow of liquid from the sump pit.

The dual backup float switches 450 and the hydraulic level sensor 440 may be adjustably coupled to the dual columns 416 by respective brackets that allow vertical positioning at a desired height. The desired height at which the sensors are positioned may be dependent on the expected height of the liquid in the sump pit. For example, a normal water table from one home to the next could be quite different, and the floats can be vertically adjusted to eliminate excess and unnecessary pump runtime. In example configurations of the WHWA, the dual back up float switches 450 may provide a backup function to main level sensors. Accordingly, in this example, the height of the dual back up float switches 450 would be set above an expected maximum liquid height in the sump pit when the primary pump 432 is operational and fully functional. Thus, the liquid would only reach the backup float switches 450 under conditions where the primary pump 432 was unable to keep up with the liquid being added to the sump pit due to a malfunction, lack of operation, or an overwhelming flow of liquid into the sump pit. In the case where the controller circuitry failed to turn on the primary pump 432 due to a malfunction in the main level sensors, the controller circuitry, upon receiving the level signal change from the dual backup float switches 450 could activate the primary pump 432. The vertical height of the hydraulic level sensor 440 of this example configuration may be vertically higher than the dual backup float switches 450, such that the hydraulic valve 452 would only be actuated upon the level signal supplied to the controller circuitry by the dual backup float switches 450 not resulting in drawdown of the level of liquid in the sump.

Figure 5:
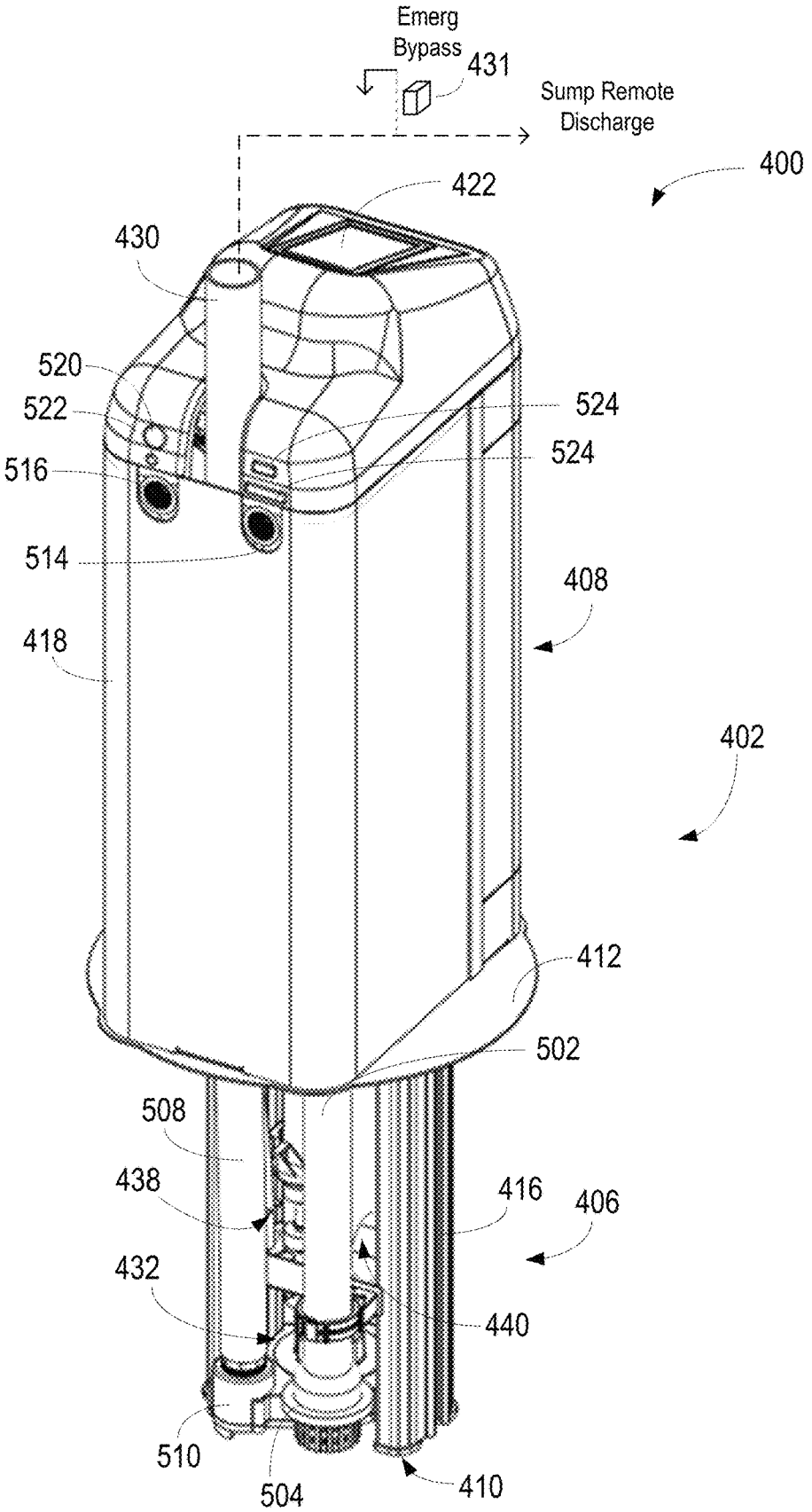
FIG. 5 is a perspective rear view of an example whole home water appliance system.

FIG. 5 is a perspective rear view of an example whole home water appliance system 400. A primary intake line 508 for the primary pump 432 includes an intake 510 positioned in the structural frame 402 near the distal end 410. During operation of the primary pump 432, the impeller 434 rotates to create a suction at the intake 510 rand a corresponding flow of liquid out of the sump pit and into the primary intake line 508. A secondary intake line 502 for the secondary pump has an intake 504 that includes a foot valve at the distal end 410 of the structural frame 402. The foot valve at the intake 504 may include a strainer screen to restrict debris from entering the secondary intake line 502, and a check valve to avoid liquid flowing back into the sump pit from the secondary intake line 502.

In addition to the common outlet 430 penetrating the shroud 418, an inlet main 514 for receipt of a municipal utility water source and a utility water network outlet main 516 that may supply water to a domestic water distribution network may penetrate a back surface of the shroud 418. The domestic water distribution network may supply various fixtures such as sinks, toilets, showers, sill cocks and any other water distribution points connected to the network within the structure(s) were the system 400 is installed. The inlet 514 and outlet 516 may include quick disconnects for coupling with the quick disconnect station (FIG. 1) or may include fittings connectors or any other form of coupling device to couple with water pipes routed to the system 400 within the structure where the system 400 is installed. A number of electrical connection points may also penetrate the shroud 418. In FIG. 5, one or more data communication ports 520, such as USB, Firewire, and the like, an electric power supply port 522, such as a power connector for 120 VAC, and one or more external I/O connections 524, such as two wire, four wire, Cat5 RJ45 connectors, and other such terminations are illustrated. In other examples, any other form of electrical connection points and terminations may be present.

Figure 6:
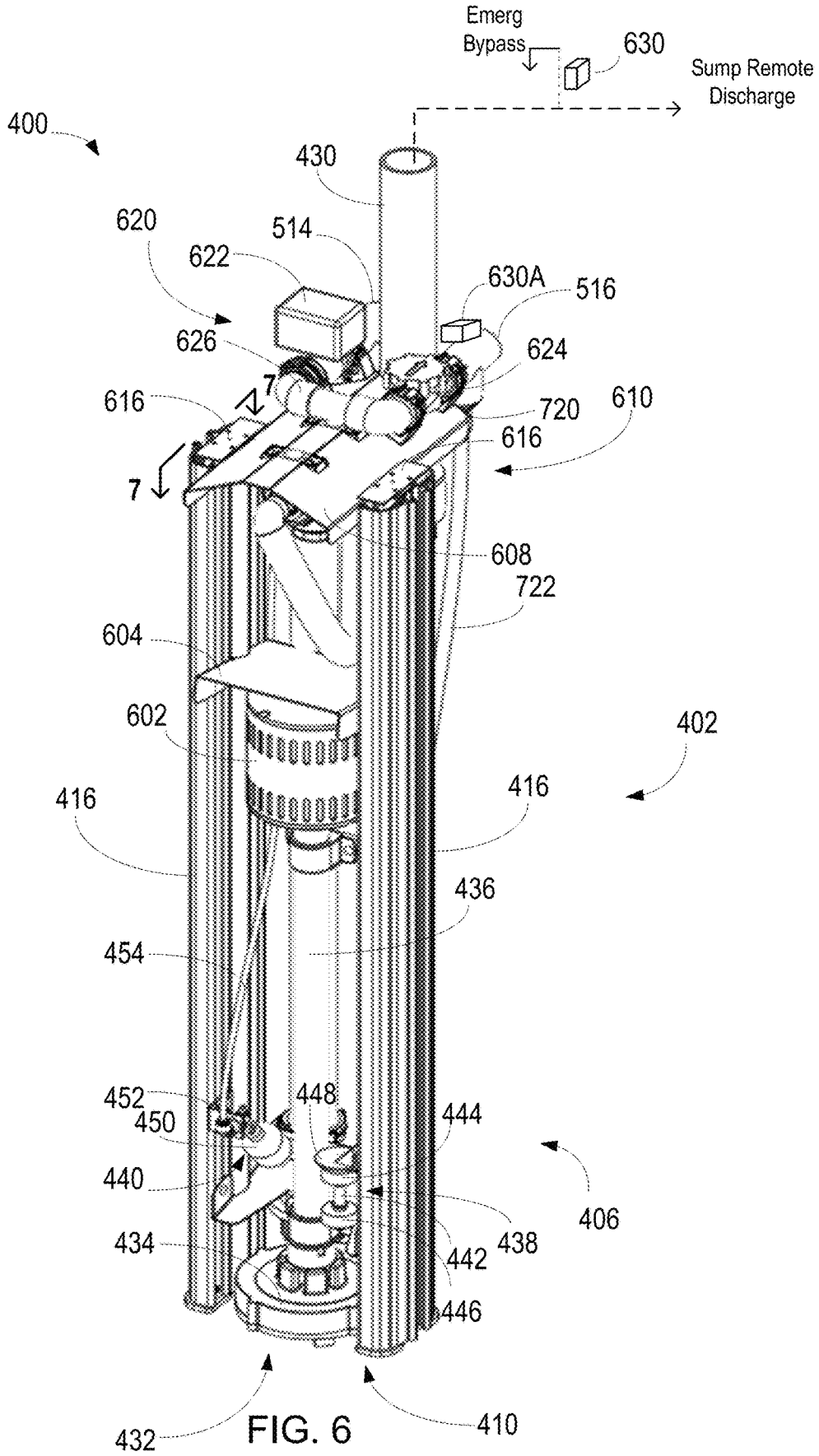
FIG. 6 is a perspective front view of an example whole home water appliance system with a shroud removed.

FIG. 6 is a perspective front view of an example whole home water appliance system 400 with a shroud 418 removed. With regard to the primary pump 432, in addition to the impeller 434 and the shaft 436, the motor 602 is also included in the structural frame 402. A bracket 604 coupled between the columns 416 forms a portion of the structural frame 402 to which the motor 602 is coupled. In addition, the motor 602 may be coupled to the structural frame 402 by one or more vibration isolating fasteners, such as clamps to minimize vibration in the structural frame 402. Also forming a portion of the structural frame 402 is a plate 608 positioned at a proximate end 610 of the structural frame 402, which is coupled between the columns 416. The shaft 436 may also be coupled to the structural frame 402 by a vibration isolating clamp to effectively couple the shaft 436 by both the bracket 604 and a vibration isolating clamp to minimize vibration. The columns 416, the bracket 604 and the plate 406 may be aluminum, steel, plastic or any other rigid material, and may be coupled together by suitable fasteners, welding or some other mechanism to fixedly and rigidly couple the components and form the structural frame 402.

In this example, coupled to each of the columns 416 at the proximate end 610 of the structural frame 402 are time of flight (TOF) sensors 616. The TOF sensors 616 are included in the sump pit liquid level sensing system as main level sensors used by the controller circuitry to control operation of the primary pump 432, and the back-up float sensors 438 are used by the controller circuitry as secondary or back-up level sensors. In other examples, other forms of level sensors, such as the sensor-less pump control system or a camera based level sensing system in which a camera is used to detect a level in the sump pit. Each of the TOF sensors 616 and the back-up float sensors 438 are in electrical communication with the controller circuitry.

Figure 7:
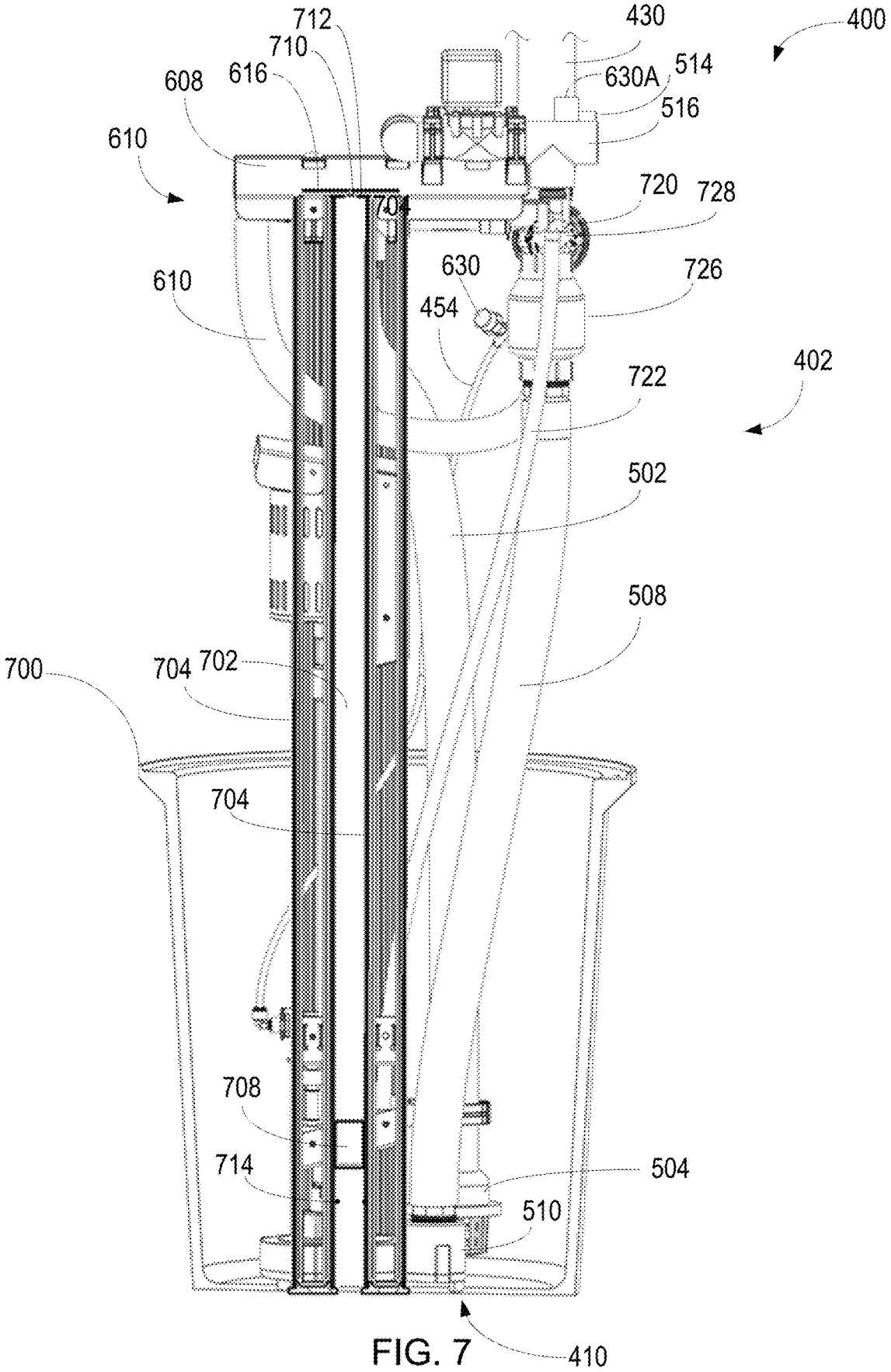
FIG. 7 is a perspective cut-away side view of an example whole home water appliance system with a shroud removed as illustrated in FIG. 6.

FIG. 7 is side view of a whole home water appliance system 400 that includes a cut-away view of the column 416. In FIG. 7, the whole home water appliance system 400 is positioned in an example of a sump pit 700. The column 416 includes a central passageway 702 positioned between carriages 704. Many of the elements position in the structural frame 402 are coupled thereto by being fixedly coupled with the carriages 704 by brackets as illustrated.

Figure 8:
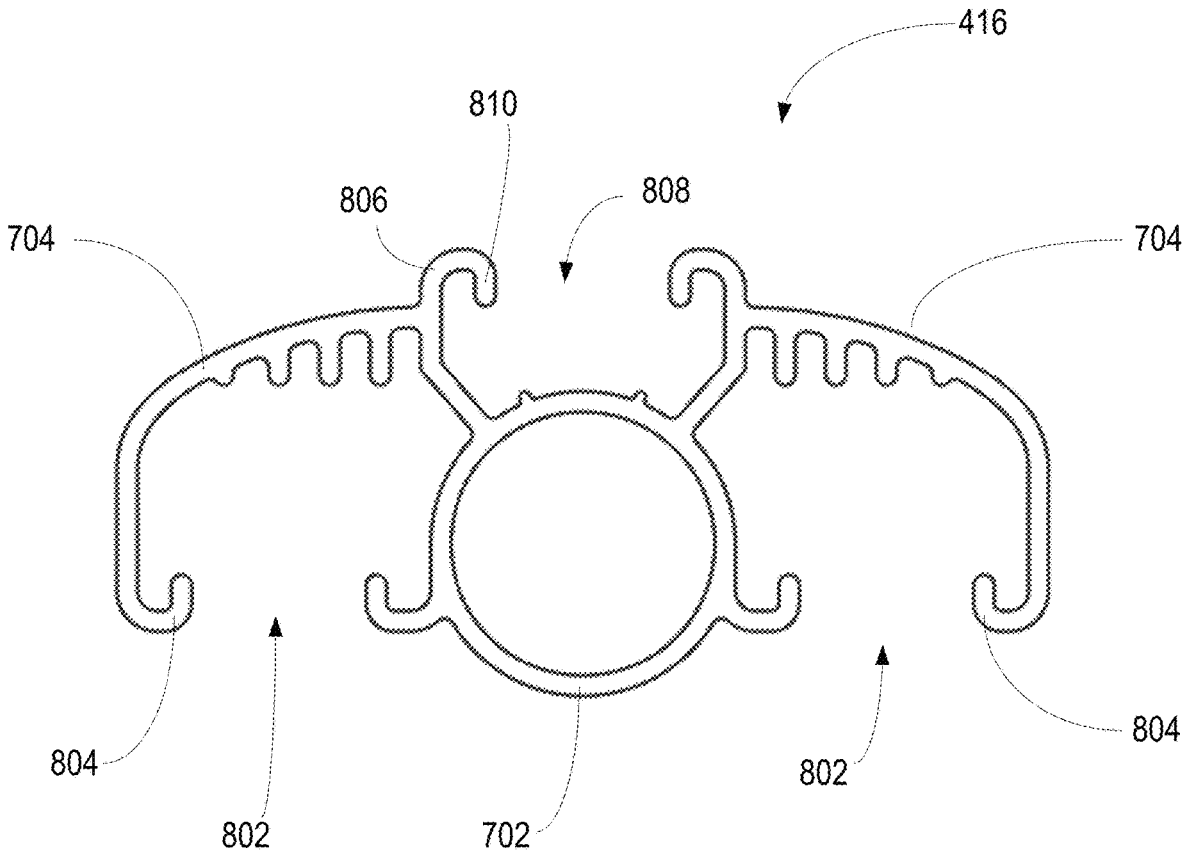
FIG. 8 is an end view of an example column included in the whole home water appliance system.

FIG. 8 is a top view of the column 416 depicting the passageway 702 and the carriages 704. The passageway 702 is formed as a continuous circular fully enclosed passageway between the proximate and distal ends of the structural frame. Each of the carriages 704 are formed to include an opening 802 and flanges 804. The openings 802 may receive brackets, which are coupled with the flanges 804. Since the openings 802 and flanges 804 extend continuously along the columns, brackets for different equipment included in the structural frame may be adjustably coupled along the length of the columns to enable the whole home water appliance system to accommodate varying sizes and depths of sump pits, as well as variations in sizes of equipment mounted in the structural frame 402. The column 416 may also include an external carriage 806 formed with an opening 808 to accommodate receipt of brackets and the like, and flanges 810. The columns 416 may be a single unitary structure. Each of the carriages 704 and 806 may be formed by coupling walls of the carriages with the passageway 702 such that an outer wall of the passageway 702 forms a portion of the walls of the carriages 704 and 806.

Referring now to FIGS. 7 and 8, a float 708 is movably disposed in each passageway 702. The float 708 moves up and down vertically in the passageway 702 as the level of liquid in the sump pit 700 changes. The TOF sensor 616 includes a light source 710 aligned to supply a beam of light in the passageway 702 parallel with the inner walls of the passageway 702 so that the beam of light strikes a top surface of the float 708. The light source 710 may be any device capable of generating electromagnetic radiation that is coherently and spatially focused and controlled to form a collimated beam of light in a predetermined spectrum. The predetermined spectrum may be electromagnetic radiation at any frequency, included in the visible light, infrared, and ultraviolet spectrum.

The top surface of the float 708 may include a reflective surface so that the beam of light, upon striking the top surface of the float 708 is reflected back toward the TOF sensor 616. The reflective surface may be specifically formulated and applied to maximize the amount of light energy reflected from the top surface of the float 708. The passageway 702 may act as a wave guide to the reflected beam of light and channels the reflected beam of light back to a light sensor 712 included in the TOF sensor 616. The interior surface of the passageway 702 may be reflective, and/or coated with a reflective material.

The TOF sensor 616 may be fully controlled by the controller circuitry to generate pulses of light energy, and/or the TOF sensor 616 may generate light energy pulses with a predetermined frequency. The TOF sensor 616, or the controller circuitry, or both, may temporally control emission of the beam of light by the light source 710 in order to detect a period of time between emission of a pulse of light energy by the light source 710 and detection of reflected light by the light sensor 712. From this detected period of time, the TOF sensor 616 may generate a signal to the controller circuitry indicative of the level of the liquid in the sump pit 700 based on the vertical position of the float 708 in the passageway 702. Alternatively, the TOF sensor 616 may provide an indication to the controller circuitry of a time when a pulse of light energy is emitted by the light source 710 and a time when reflected light from that pulse of light energy is detected by the light sensor 712, and the controller circuitry may calculate a depth of the liquid in the sump pit 700 therefrom. The passageway 702 may include a stop 714 to limit the vertical travel of the float 708 when the sump pit 700 is emptied of liquid. The stop 714 may be a predetermined distance from the TOF sensor 614 to enable calibration of the TOF sensor 616 during draw down testing by the controller circuitry.

Each of the columns 416 may include a TOF sensor 616 and a float 708 to provide redundancy of the main level sensors. The controller circuitry may compare the level measurements from each of the main level sensors to detect inconsistencies and/or malfunction based on a predetermined threshold of difference between the level readings.

Referring now to FIGS. 6 and 7, the whole home water appliance system 400 may also include a smart water meter/shutoff valve 620. The smart water meter/shutoff valve may include a water control actuator 622 such as a shutoff valve coupled with a flow meter 624 by a water source connection line 626. Water supplied from a municipal utility water source at the inlet 514 may sequentially pass through the water control actuator 622, the water source connection line 626, and the flow meter 624 before flowing out of the outlet 516 into the domestic water distribution network in the structure in which the whole home water appliance system 400 is installed.

A pressure sensor 630 may be included in the structural frame 402. The pressure sensor 630 may be included on the pressure control line 454 so as to provide the state of the secondary pump's (900) (water powered pump) hydraulic control valve (904). (FIG. 9) When the hydraulic control valve 904 is closed the pressure control line 454 should have the same pressure as the municipal utility water source supplied at the inlet 514. When hydraulic valve 904 is open the pressure in pressure control line 454 will drop significantly, providing an indication to the controller circuitry that the hydraulic control valve 904 is open. Alternatively, or in addition, the pressure sensor 630A may be included in the structural frame 402 on the outlet 516 to monitor the pressure of the water supplied to the domestic water distribution network. The pressure sensor 630 may provide a pressure signal to the controller circuitry. In some examples configurations, the pressure sensor 630 may be omitted or positioned elsewhere in the system.

In the example of FIGS. 6 and 7, the smart water meter/shutoff valve 620 may be included in the upper housing 408 within the structural frame 402 above the plate 608 and coupled thereto. In other examples, the smart water meter/shutoff valve 620 may be omitted. In still other examples, the smart water meter/shutoff valve 620 may be included in the quick disconnect station, or elsewhere in the house or structure.

A level test actuator 720 may be included in the structural frame 402. In the examples of FIGS. 6 and 7, the level test actuator 720 is included in a tee connected between the outlet of the smart water meter/shutoff valve 620 and the outlet 516 to receive the flow of municipal city water. The level test actuator 720 may be an electrically operated valve, such as a ball valve, controlled by the controller circuitry to open and close during performance of diagnostic self-testing of the whole home water appliance system 400. During a diagnostic testing mode, the controller circuitry may actuate the level test actuator 720 to an open position to flow water from the municipal city water source to the sump pit 700 via municipal water fill supply line 722. The controller circuitry may receive signals from the level sensors in the sump pit liquid level sensing system to test the primary and secondary pump functionality, capability and efficiency including testing in the three test modes. In addition, the controller circuitry may test the emergency bypass discharge.

Water from the municipal utility water source supplied at the inlet 514 may also be supplied to the secondary pump as a prime mover to drive (or energize) the secondary pump to extract liquid from the sump pit 700. When the secondary pump is driven by the prime mover, the intake 504 of the secondary pump receives a flow of liquid from the sump pit 700, which is supplied through intake 504 and the secondary intake line 502 to a secondary outlet. When the primary pump is driven by the motor being energized with electric power, the intake 510 receives a flow of liquid from the sump pit 700, which is supplied through the primary intake line to a primary check valve 726 included in the structural frame 402. The liquid is discharged from the check valve 726 to a primary outlet 728. The primary outlet 728 is in liquid communication with the common outlet 430.

Figure 9:
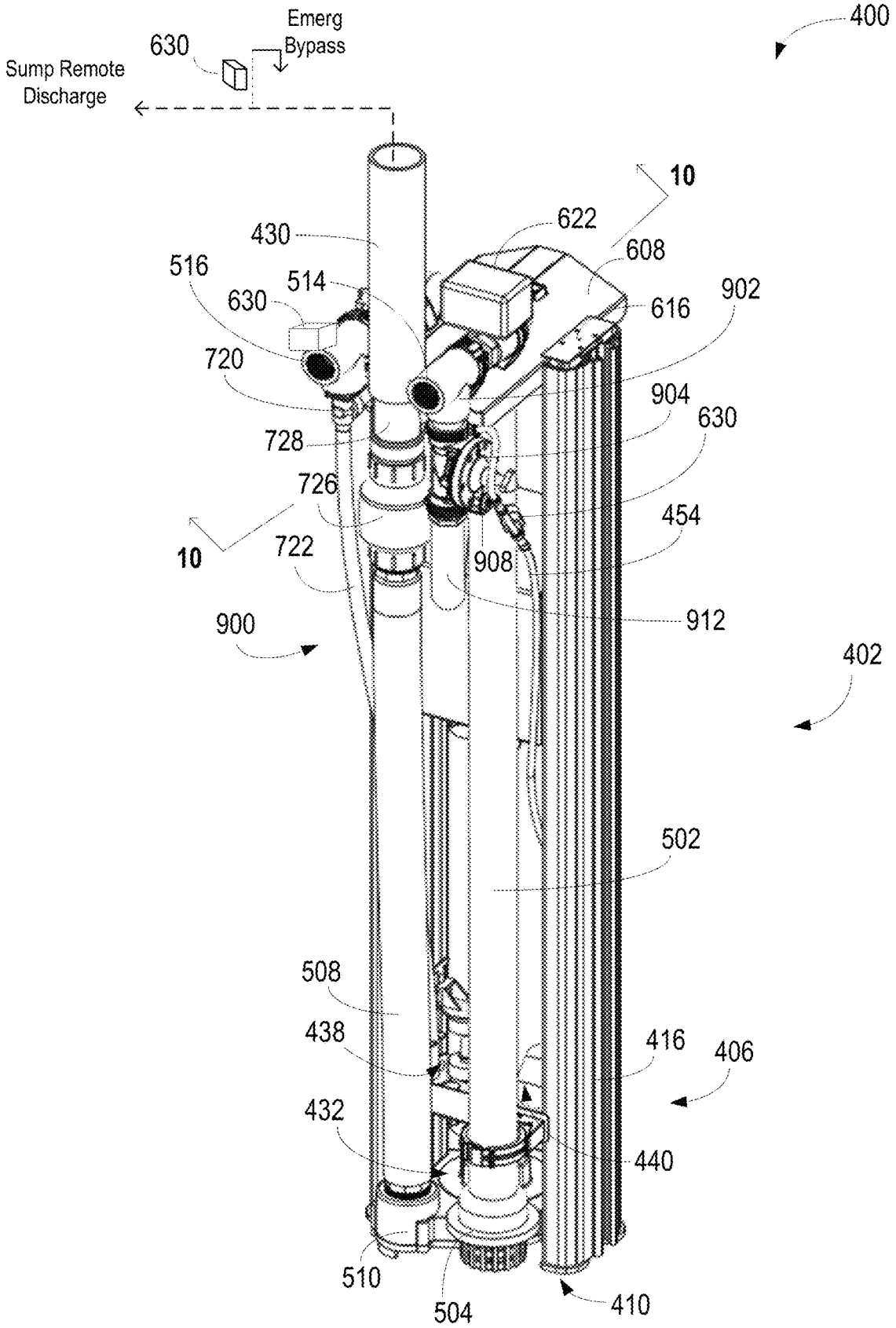
FIG. 9 is a perspective rear view of an example whole home water appliance system with a part of the shroud removed.

FIG. 9 is a perspective rear view of an example whole home water appliance system 400 with a part of the housing removed. A tee fitting 902 included in the structural frame 402 supplies the municipal utility water source to a hydraulic valve 904 mounted in the structural frame 402 and included in the secondary pump 900. The hydraulic valve 904 is controlled by the hydraulic level sensor 440 via the pressure signal line 454. A regulator 908 is included in the pressure signal line 454 to regulate the pressure in the line. When actuated to open via a drop in pressure in the pressure signal line 454 initiated by the hydraulic level sensor 440, the hydraulic valve 904 supplies a flow of the municipal utility water to a prime mover outlet 912 to act as the prime mover to drive the secondary pump 900 to evacuate a flow of liquid from the sump pit. The flow of municipal utility water is not detected by the flow meter 622 since the tee fitting 902 is upstream. In this example, the hydraulic valve 904 is a fully hydraulically operated device. In other examples, the hydraulic valve 904 may include an electric actuator 914 to optionally or solely control the secondary pump 900 with the controller circuitry.

Figure 10:
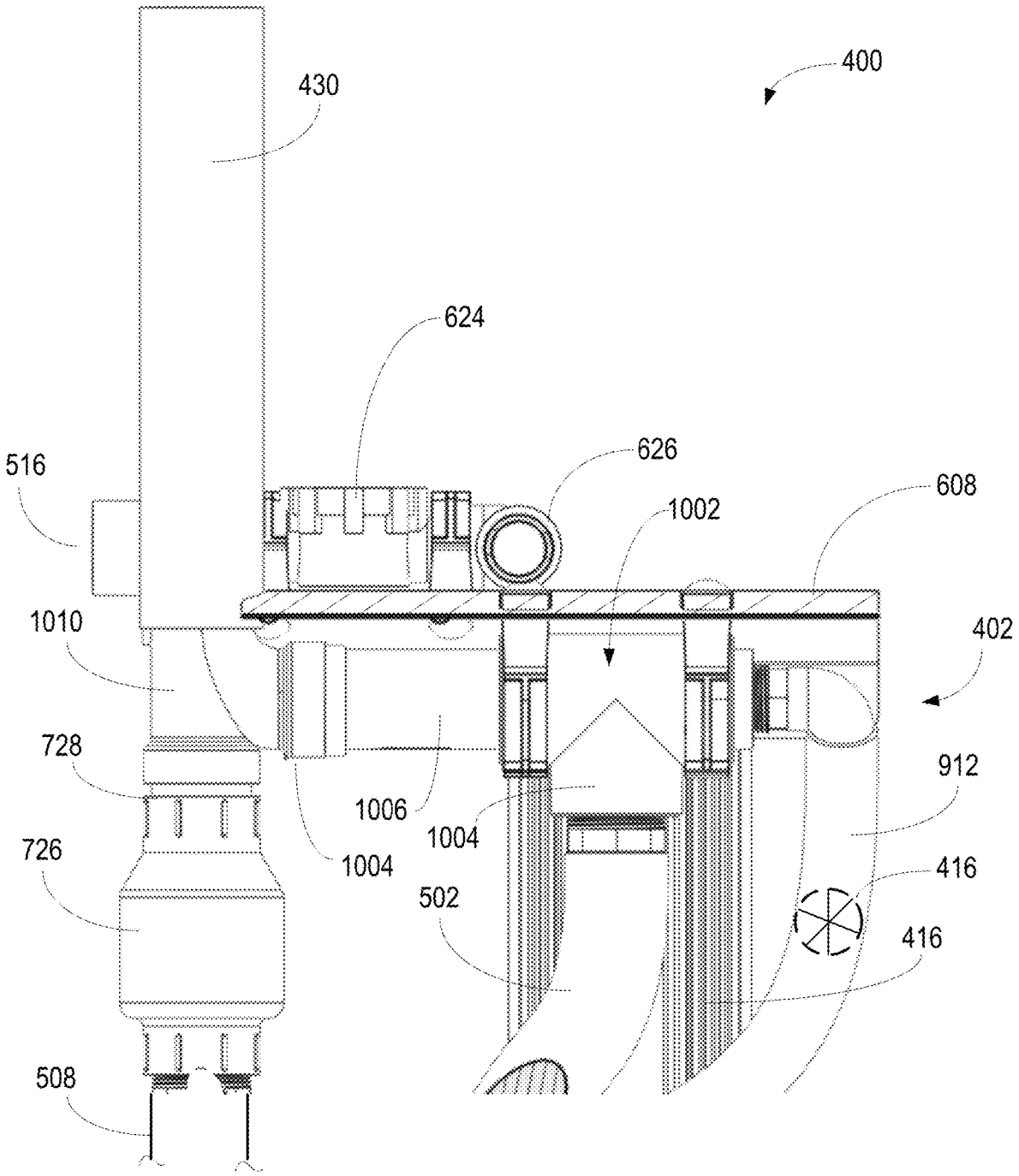
FIG. 10 is a cutaway side view of a portion of an example whole home water appliance system with a shroud removed.

FIG. 10 is a cutaway side view of a portion of an example whole home water appliance system 400. As illustrated in FIG. 10 with reference to FIG. 9, the prime mover outlet line 912 is supplied as an input flow to a prime mover header 1002 which is included in the structural frame 402 as part of the secondary pump 900. The prime mover outline line 912 may include a hydropower generator 1003 which is rotated by a flow of municipal water to generate electric power when the hydraulic valve 904 is open to supply the flow of the municipal water to the prime mover header 1002. In addition, the flow of liquid extracted from the sump pit by operation of the secondary pump 900 and flowing in the secondary intake line 502 is supplied to the prime mover header 1002 via a liquid inlet 1004 of the secondary pump 900.

An eductor 1006 is included in the secondary pump 900. The eductor 1006 provides a prime mover for the secondary pump 900, using a flow of liquid at the outlet of the prime mover header 1002. In some examples, the prime mover header 1002 and the eductor 1006 may be a single unitary structure, which may be referred to as eductor 1006. The flow of water from the municipal utility via the prime mover outlet 912 through the eductor 1006 is the prime mover driving the secondary pump 900. This flow of the municipal water supply through the eductor 1006 is the prime mover that creates a suction at the secondary intake 504 of the secondary pump 900. The suction creates an independent flow of liquid out of the sump pit and through the eductor 1006 to an outlet 1008 of the secondary pump 900. The flow of liquid exiting the eductor 1006 at the outlet 1008 of the secondary pump 900 is a combination of the liquid extracted from the sump pit and the flow of liquid supplied as the prime mover to the eductor 1006. The combination of the flow of liquid extracted from the sump pit via the second intake line 502 and the municipal water flow representing the prime mover for the secondary pump 900 enters a merge pipe fitting 1010 included in the structural frame 402.

The merge pipe fitting 1010 may be formed to allow the cooperative combination of the flow of liquid at the secondary outlet 1008 and the flow of liquid at the primary outlet 728. The liquid flows from the primary and the secondary outlets are combined in the merge pipe fitting 1010 without effecting operation of the primary pump 432 or the secondary pump 900. This is due to the selection and sizing of the primary and secondary pumps to have compatible pump curve characteristics. In addition, the geometry of the merge pipe fitting 1010 provides an angled trajectory of entry of the liquid flow from the secondary outlet 1008 into the liquid flow from the first outlet 728. Thus, the velocities of the liquid flow from the secondary outlet 1008 into the liquid flow from the first outlet 728 are successfully and efficiently merged in the merge pipe fitting 1010. The merge pipe fitting 1010 may be coupled with the common outlet 430.

When the primary pump 432 is operating, the flow of liquid extracted by the primary pump 432 via the primary intake line 508 is supplied through the primary check valve 726 and the primary outlet 728 to the merge pipe fitting 1010. Thus, the combination of the flow of liquid extracted from the sump pit by the secondary pump 900, the flow of liquid extracted from the sump pit by the primary pump 432, and the flow of liquid supplied by the municipal utility water supply as the prime mover in the eductor 1006 is provided to the common outlet 430 when both the primary pump 432 and the secondary pump 900 are operating. When the primary pump 432 is not operating, a combination of the flow of liquid extracted from the sump pit by the secondary pump 900 and the flow of liquid supplied by the municipal utility water supply are output from the merge pipe fitting 1010 to the common outlet 430. In this operational configuration, the primary check valve 726 prevents backflow of liquid into the sump pit via the primary intake 508. When the hydraulic valve 904 is closed such that the secondary pump 900 is not operating and the primary pump 432 is operating, only the flow of liquid extracted from the sump pit and supplied to the primary outlet 728 is provided in the common outlet 430. In this operational configuration, the hydraulic valve 904 and a check valve in the secondary intake line 502, such as in the foot valve 504 (FIG. 9).

In other example configurations, the merge pipe fitting 1010 and the common outlet 430 may be external to the whole home water appliance. In these example configurations, the primary outlet 728 and the secondary outlet may individually extend outside the structural frame 402 before being joined at the merge pipe fitting to form the common outlet. Thus, the common outlet may be within the building structure in which the whole home water appliance is located, or may be located outside the building structure.

The hydraulic level sensor may independently and pneumatically control the operation of the prime mover 1006 as provided by the flow of municipal water through the hydraulic valve 904. As such, the secondary pump 900 is driven by a prime mover, in the form of the municipal water supplied to the eductor 1006, that is other than the electric power source used to drive the primary pump 432. The prime mover supplied to the eductor 1006 invokes extraction of a first flow of liquid from the sump pit via the secondary inlet 504. Accordingly, the secondary pump 900 is driven by prime mover provided by the eductor 1006 to extract a second flow of liquid from the sump pit at a second inlet, which is the inlet 504. When the primary pump 432 is operating, the flow of liquid from the primary outlet 728 provides at least a portion of the flow of liquid in the common outlet 430. Thus, the flow of liquid in the common outlet 430 is at least equal to the flow of liquid extracted by the primary pump 432 and the secondary pump 900 when the primary pump 432 is operating. When the hydraulic valve 904 is open enabling a flow of municipal utility water to provide the prime mover 1006, the flow of liquid in the common outlet 430 is at least equal to the liquid extracted by the secondary pump 900 from the sump pit and the flow of municipal water.

Figure 11:
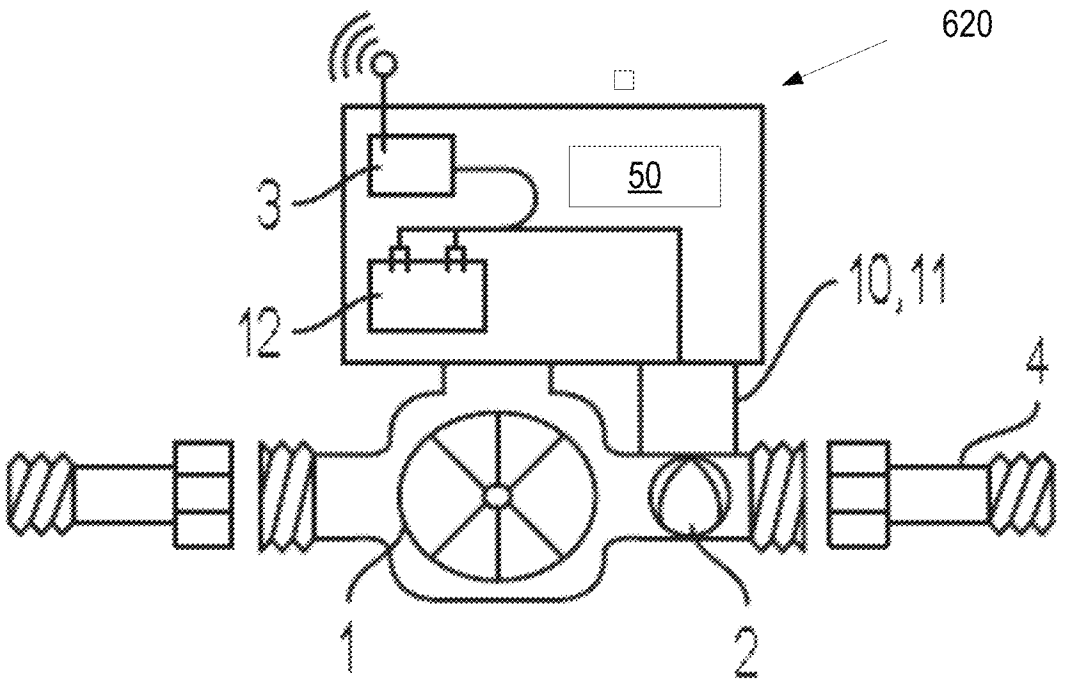
FIG. 11 is a block diagram of an example smart water meter/shutoff valve, which may be included in the whole home water appliance.

Referring to FIG. 11, with reference to FIG. 6, an example of the smart water meter/shutoff valve 620 can include (1) a water flow meter or flow meter 624, (2) a water control actuator or 622, and be in communication with the controller circuitry (50), which includes the user interface and communications circuitry (3). The smart water meter/shutoff valve 620 may control the flow of water into the whole home water appliance system and the domestic water distribution network in the building structure in which the appliance is installed. The (2) water control actuator, the (1) flow meter and the controller circuitry (50) can be included in a unitary or combo water control device, as illustrated. Alternatively, in other examples, similar to the example of FIG. 6, the smart water meter/shutoff valve may be separated elements. Thus, FIGS. 11-15 and the related description is not limited to just one of either a unitary water control device or separated elements forming a water control device. In an example, the smart water meter/shutoff valve can be pre-piped and assembled into a spool (4) which can include, for example, two half unions, or similar, quick connections for easy installation within the housing or the quick disconnect station. The water flow meter (1) can be any form of water flow detection device, such as a mechanical meter, a pressure-based meter, an optical meter, a vortex flow meter, an electromagnetic meter, an ultrasonic meter, a Coriolis meter, and/or a laser Doppler meter. In an example implementation, the water flow meter (1) can be a sensitive water flow meter having a wide flow range to detect very small water flows as well as large water flows. The water control actuator (2) may be an electrically operated valve, such as a motorized shutoff ball valve. In other examples, any other form of water flow control mechanism can be used, such as a solenoid valve, a gate valve, a butterfly valve or any other mechanism to control the flow of water from the municipal water source.

The output from the smart water meter/shutoff valve 620 may be supplied via the outlet 516 to a home water distribution network system such as the water piping feeding sinks, showers and toilets throughout the home. In addition, the output from the smart water meter/shutoff valve 620 may be provided through the level test actuator 720.

The level test actuator 720 may be used to automatically test the level sensors and the primary sump pump and/or the secondary sump pump at predetermined intervals. In addition, the level test actuator 720 may be used to calibrate the sensorless pump control or the laser pump control for primary pump level control. During a diagnostic test of the primary and secondary sump pump and the level sensors, the controller circuitry may automatically actuate the level test actuator 720 to fill the sump basin with water from the municipal water supply line. The controller circuitry may then confirm that the primary sensors for primary pump level control and the primary pump are operational, and also confirm operation of the back-up dual float switches. Also, the controller circuitry may not operate the primary pump in order to test the fully mechanical operation of the hydraulic level, the hydraulic valve and the secondary pump. In addition, the controller circuitry may disregard the different level signals so as to selectively energize the primary sump pump, or the secondary sump pump, or both the primary and the secondary sump pumps in response to the level signals to confirm operation of the sump pumps are within expected performance. Using the level sensors included in the sump pit liquid level sensing system for electrical and hydraulic pump level control the controller circuitry may not only confirm that the primary and secondary pumps are evacuating water from the sump basin, but also estimate a flow rate at which the pumps are operating alone or cooperatively in combination. The estimated flow rate may be compared to a predetermined expected flow rate, such as a table of flow rates, to confirm performance of each of the primary and secondary sump pumps is within an expected range.

In addition, the controller circuitry may automatically perform calibration of the main level sensors used for pump level control of the primary pump by energizing the primary sump pump to evacuate the sump basin until a level of the liquid is sufficiently lowered toward the distal end 410 of the columns 416 unit either the end of the pressure sensing tube is no longer submerged or the float in the passageway has reached the stop 714. The controller circuitry may then calibrate the pressure sensor of the pressure sensing tube, or the time of flight of the TOF sensor for pump level control to zero. Following calibration, the controller circuitry may actuate the level test actuator 720 to fill the sump basin until the end of the pressure sensing tube for pump level control is again submerged in order to capture air within the pressure sensing tube for pump level control, or the float has floated vertically away from the stop 714.

Figure 12:
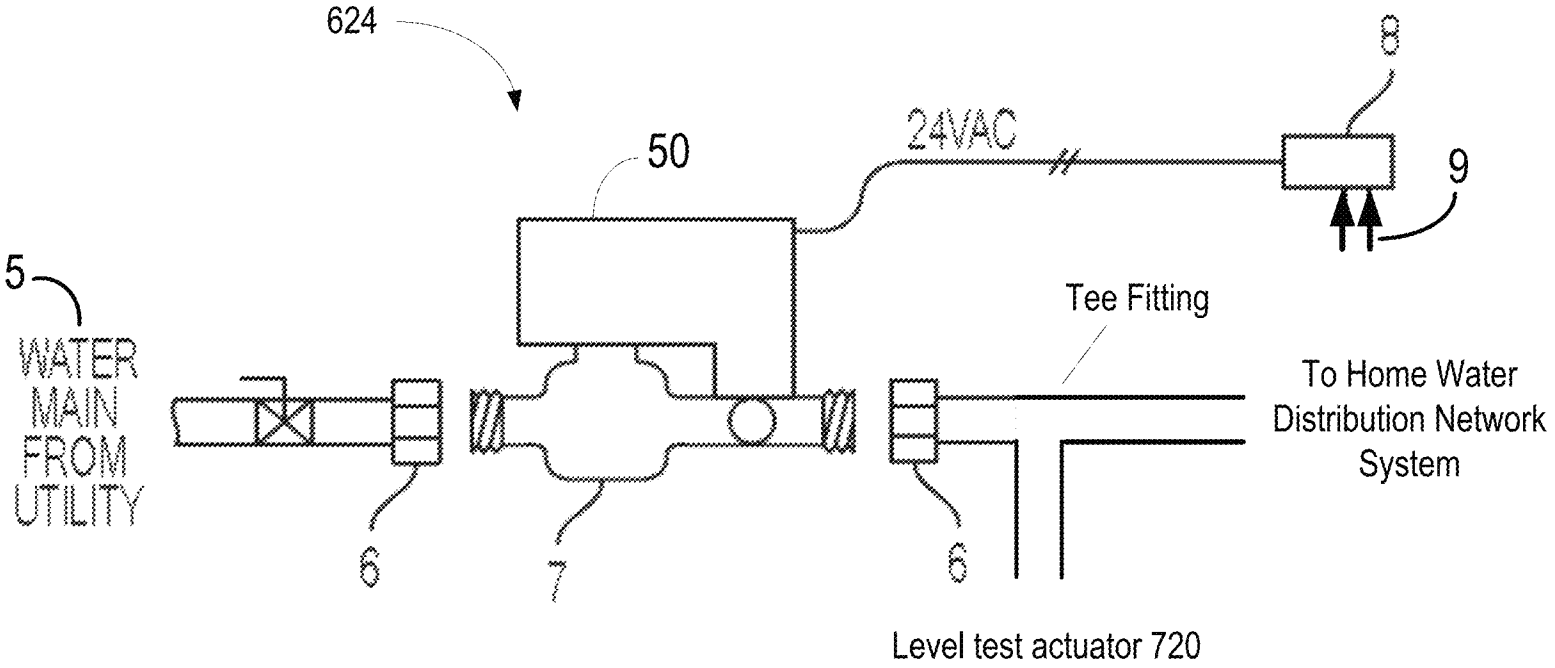
FIG. 12 is a block diagram of another example of a smart water meter/shutoff valve, which may be included in the whole home water appliance.

FIG. 12 is another example of the smart water meter/shutoff valve 624. The smart water meter/shutoff valve 624 of this example may include mating union connections (6) for coupling with the water main from the utility and also coupling with a tee fitting included in the housing that supplies the level test actuator 720 included in the housing and the home water distribution network system via, for example, the quick disconnect station. Thus, the smart water meter/shutoff valve 624 of this example may be factory installed in the housing of the whole home water appliance or the quick disconnect station, or may be added later as an optional feature since the smart water meter/shutoff valve 624 may be coupled into place (7) using the mating union connections (6). In other examples, other types of coupling mechanisms may be used to install the system in the housing of the whole home water appliance system, or in the quick disconnect station so as to control the flow of water into a building structure.

A power adapter (8), such as low voltage AC power adapter, may be plugged into the quick disconnect station via a quick disconnect. Alternatively, the power adapter (8) may be plugged into a wall receptacle located within a predetermined distance, such as up to 250 feet, from the smart water meter/shutoff valve 624. In another example, the power adapter may be omitted since the smart water meter/shutoff valve 624 may operate at 120 VAC. The power adapter (8) can be coupled with power wires (9) to power the smart water meter/shutoff valve 624. In an example, the power wires (9) may be present in a 120 VAC outlet in the quick disconnect station, and the power adaptor (8) may have a 120 VAC plug configuration, and a transformer to convert and/or step the voltage down to a predetermined level, such as 24 VAC. In other examples, other voltages and types of connectors may be used.

Referring to FIGS. 11-15, the communication circuitry (3) may provide communication with any of a number of different mobile devices (17), such as cellular phones, smart phones, tablets, or any other device with wireless communication functionality. The communication circuitry (3) may communicate over one or more wireless networks, such as a CDMA or 4G network, the internet, a Wi-Fi network, short range networks, such as Blue Tooth™ and/or any other wireless communication network with the mobile devices (17). In an example embodiment, the communication circuitry (3) communicates with the mobile devices (17) over only a cellular network to ensure reliability and robustness of the communication path. The communication circuitry (3) may also be part of a system for remote monitoring and control of remotely located equipment that minimizes wireless airtime, such as the system described in U.S. Pat. Nos. 7,228,129 and 7,778,633, which are both herein incorporated by reference in their entirety. In this example configuration, the communication circuitry (3) can be a bi-directional wireless interface that communicates using a first protocol based on a user configurable data string, and a second protocol based on a user configurable data file. In an example system for remote monitoring, the communication circuitry (3) can selectively communicate with a central server computer (not shown) or the mobile devices (17) using the first and second protocols. The central server may provide a user interface to the system; event logging; configuration; data capture and storage; system and device configuration, manipulation, operational control, security and any other system related functions.

In an example, the water control actuator (2) can be a valve that operates at a predetermined voltage, such as 12 VDC motorized ball valve (11) in lieu of a lower cost solenoid valve. A motorized ball valve may be used to eliminate water hammer noise that can otherwise occur when a solenoid valve is slammed shut under full pressure. The additional reason is that an energized solenoid valve can create pipe vibration noise which can be heard throughout the building structure water lines, such as home water lines. A solenoid valve can be either of the normally open or normally closed design. For example, a normally open solenoid valve must have voltage applied to its' coil to close it, and when power is removed, it will open. The proposed system uses a geared, motorized ball valve because it drives open/closed in approximately five seconds, eliminating water hammer. Additionally the motorized valve does not require power to maintain its position, such as an open or closed position. Once driven to its position, power can be removed, and it will stay put. This can be preferential during a power loss condition because the valve will stay closed, or open, as needed. Additionally, the 12 VDC motorized ball valve can be driven to its open or closed state during power loss events using a battery, such as an external battery, a battery included in the structural frame of the whole home water appliance, an onboard backup battery (10) included with the water control actuator (2), or from the micro-hydroelectric power generator which generates suitable power to operate the valve from the domestic water line.

During AC power loss, the water meter (1) can continue to monitor water flow using a backup battery 12 (FIG. 11) included in the whole home water appliance, and if water flow is detected, the onboard backup battery (10) can be used by the controller circuitry to power the water control actuator, such as an electrically operated shutoff valve, to the closed position. The water control actuator, such as a valve, can be driven closed, and then power can be removed from the water control actuator, so that power from the on board battery backup (10) is available, and thus is reserved for the communication circuitry (3) and other electrical devices in the system, thus reserving battery power of the battery (12). If AC power is lost for an extended period of time, the system logic may open the level test actuator 720 to fill the sump pit. The micro-hydrogenerator is operated from this water flow, and harnesses this energy to recharge the depleted backup battery. This cycle can repeat indefinitely, as long as domestic water pressure and flow are available, providing an unlimited venturi pump runtime, and valve control, during long duration AC power loss events, using the water powered venturi pump to keep the sump pit at normal levels, and keep all electronic circuitry functioning The water meter (1) can detect even the smallest leaks in the whole home water appliance or in the home in which the appliance is installed. Thus, leaking toilets, leaking faucets, appliance leaks, ice maker leaks, or any other type of undesired water escape may be detected with the smart water meter/shutoff valve. These small leaks can equate to a large water bill over time, and although do not typically cause building damage; they can cost the user lots of money. The proposed system detects these water "vampires" so that the home owner can take action. Frozen pipes are also another major source of water damage. Many times a frozen pipe will start as a "pin hole" leak (13) in some remote pipe somewhere in a building structure, such as in a wall, and then progress to an increasingly larger hole. Even the smallest pinhole leak anywhere in the building enclosure piping system can be detected. Leaking water heaters, and any other appliance can also be detected if having even the smallest leak.

Figure 13:
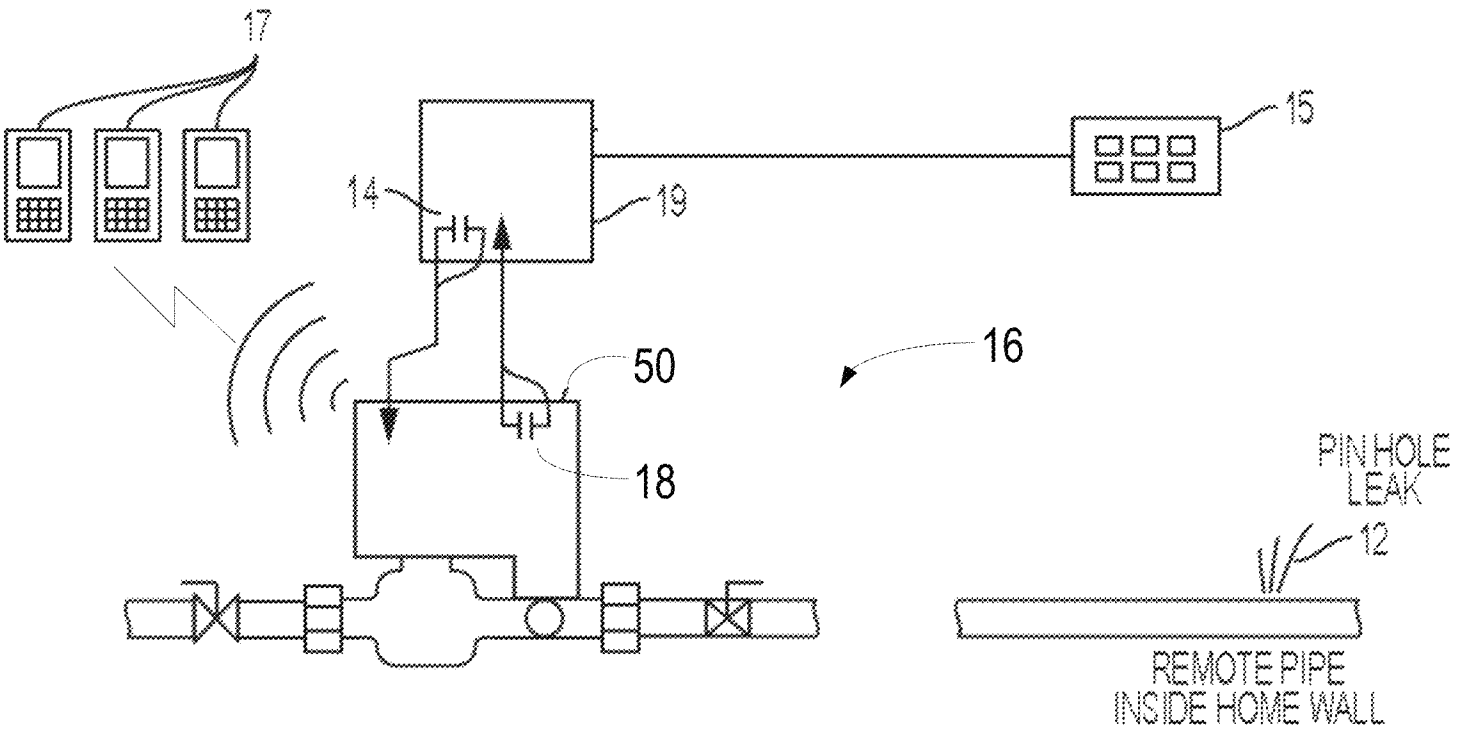
FIG. 13 is a block diagram of another example of a smart water meter/shutoff valve, which may be included in the whole home water appliance, and which includes a user interface and also depicts mobile devices.
Figure 14:
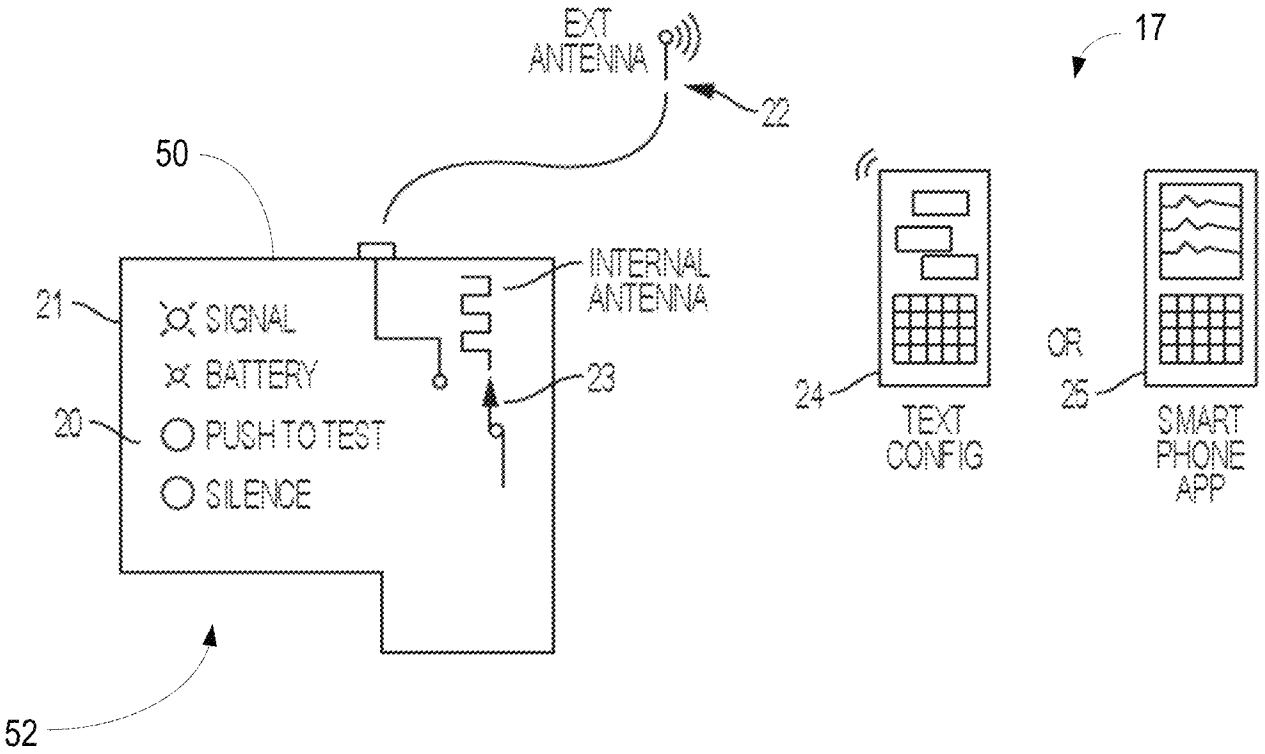
FIG. 14 is a block diagram of a part of an example of a portion of a whole home water protection appliance illustrating an example of a portion of a user interface, which also depicts mobile devices.
Figure 15:
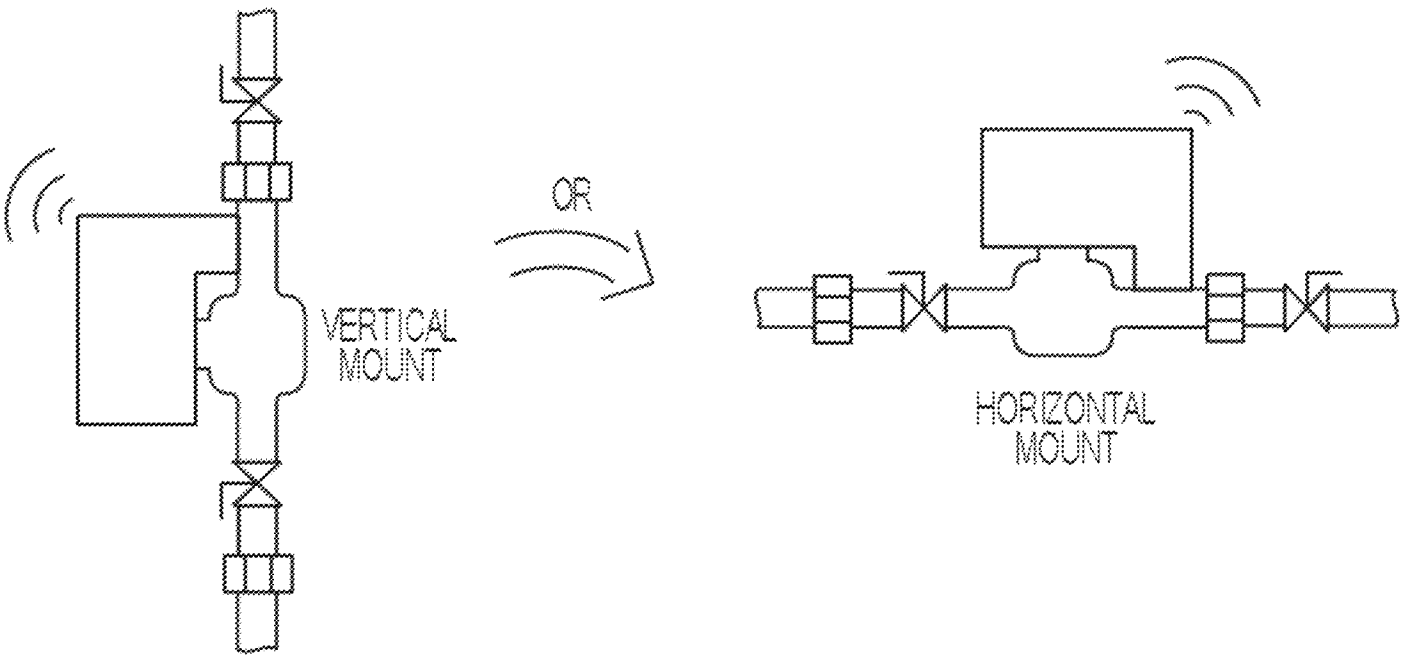
FIG. 15 is an example of orientation of an example of a smart water meter/shutoff valve, which may be included in the whole home water protection appliance.

In an example configuration with reference to FIGS. 13-15, the system can accept one or more different input signals (14) such as relay contact closures from any $3^{rd}$ party system (19), such as an alarm system provided from an alarm system supplier. In an example implementation, at least one of the input signals (14) can correspond with when the user, such as a homeowner, arms/disarms a premises alarm system. For example, a home owner can be leaving for work in the morning, and control or "arm" his home alarm system from a user interface (15), such as a keypad at his front door. The alarm system main panel can provide an output signal, such as by closing a relay contact output (14), which "arms" the whole home water appliance (16). The whole home water appliance in this mode will monitor for the smallest water leaks while the homeowner is away, while ignoring one or more previously defined water use profiles such as a profile of an ice maker making new cubes, washing machine finishing a load of laundry, a water softener's scheduled regeneration, etc. If an unexpected/unrecognized water flow in the form of a water leak event is detected, the wireless transmitter (3) can send a text message to a predetermined quantity of different mobile devices (17), such as by sending sms text messages, or data to a users smartphone app, to up to three or more different, phone numbers of mobile devices (17) so the home owner or plumber can take action. In addition, the system can also trigger an on-board output signal, such as a relay output (18), to trigger an indication to the home alarm system 19 of the same event. Therefore, the proposed system can work side-by-side with any $3^{rd}$ party system (19) by including the ability to send an output signal, such as by closing an onboard relay, which will indicate an alarm event to any 3rd party system, such as an alarm system being 24/7 monitored by an alarm system supplier.

The on board battery backup (10) and/or the battery back system (12) included in the housing can be a rechargeable battery, and the system can include a low battery alarm as an integral feature of the whole home water appliance. The battery backup system (12) can, eliminate the need for the owner to come up with his own battery backup protection scheme. The system can continuously keep the backup battery (12) charged, via onboard AC charger or via onboard micro-hydro-power-generator, and if for any reason the battery becomes unplugged, uncharged, or unable to charge, the system can alert the homeowner to replace the battery(s) or perform other maintenance/troubleshooting/repair.

Referring now to FIG. 14, an example of a user interface for the whole home water appliance is illustrated along with a text device and a smart phone device. The example system may employ a push-to-test push button (20) in a user interface 52. The user interface 52, may, for example, be positioned on a face plate of the system in communication with the controller circuitry 50 such that when the button (20) is actuated, the water valve is closed, and a text message alert is sent to the homeowner's preprogrammed phone numbers, with a time/date stamped event date. This feature may also be used to periodically test the operation of the primary and backup sump pumps in the system.

On board, indicator(s), such as bi-color LED indicators can be used to show if suitable wireless signal strength (21) is available. For example, a green color can indicate a suitable signal, and a red color can indicate the signal should be improved. The system allows for connection of a remote high gain antenna (22) which can be placed in a higher elevation in the home to correct a weak signal condition. The wireless transmitter can include an on-board analog switch (23) which can automatically detect an external antenna is plugged in, and then automatically switch the antenna to the strongest signal source.

The whole home water appliance can be programmable via at least three different modes, 1) text message commands from any device which can send a text message (24), or 2) from a smart phone app (25), or 3) from the appliance front panel HMI display. In an example configuration, the whole home water appliance can provide the capability to program and configure operation of the system, using a free form text based approach. For example, programming and configuration of the system can be performed using text messages either locally via the user interface, or remotely via the mobile devices 17 communicating via text message or standard data exchange methods. The free form text based approach eliminates the need for structured syntax programming methods since no predetermined format or syntax is needed for either the command portion of a command message, or the data portion of a command message. Instead, the system includes a command interpreter module capable of processing messages in an unstructured format by parsing the text message to identify a command and data that is present therein. An example of such functionality is described in U.S. Patent Publication No. 2014/0120901 published May 1, 2014, which is herein incorporated by reference in its entirety.

As illustrated in FIG. 15, an example of the smart water meter/shutoff valve in the form of a unitary structure can be mounted in any orientation in the structural frame of the whole home water appliance, in the quick disconnect station, or elsewhere in the home. For example, the smart water meter/shutoff valve mounted within, or external to the whole home water appliance can be mounted in either a vertical or horizontal orientation giving the installer the option for the most convenient mounting method. Some water meters and valves can only be mounted in the vertical orientation, but this is not a limitation with the whole home water appliance's smart water meter/valve.

Significant water damage can happen not only from frozen or leaky water lines, but also from the failure of other water related systems, such as a sump pump. The pressure sensing tube and corresponding pressure sensor, and/or the dual float switches can be included within the whole home water appliance and alert a user to a high water condition in the sump basin, so that the user can take immediate action to mitigate additional water damage. Additionally, or alternatively, a tether float can be attached to a secondary input of the whole home water appliance to monitor a water system, such as a grinder pump system. In this example, the grinder pump system can be present on building structures, such as homes with basements where a restroom or kitchen is located in the basement. The grinder station can collect waste water from the basement sink or restroom, and pump such water to the city sewer or local septic system. This grinder pump system can be separate from the home sump pump which can be established to collect only certain types of water events, such as black water from the building's toilets and sinks. A failure of the grinder pump can, for example, potentially cause backup of wastewater into the building enclosure. The whole home water appliance can also supply early warning of system failures, such as a grinder pump system failure.

In the event of any alarm condition, the system can provide a local audible siren in addition to the data or wireless text notification so if the user is nearby when the event occurs, he gets immediate notification even if he is not carrying his portable mobile device.

The water control actuator (2) can also include a position indicator to visibly indicate if the valve is in an opened or closed position. Since water lines are not transparent, the position indicator is valuable, especially when using the manual override lever to determine the full open or closed position of the valve. If the valve would fail to close/open for any reason under automatic control, or the user, such as a home owner, wants to manually open/close the valve for any reason, without initiating the automatic features, the user can manually open/close the water valve by actuating an override lever to an enabled position, such as by manually pulling out the override lever from a recessed position in the whole home water appliance. The system can monitor the override lever and automatically pass between manual and automatic control. Once actuated, the override lever may be manually turned until the valve position indicator shows the valve is in the desired position. Once manual testing is complete, the override lever can be returned to a disabled position, such as by pushing the override lever in to return the valve to automatic control.

The whole home water appliance can be used as a total home water protection system by using a water meter for functionality that is applicable to more than just emergency shutoff situations. In some examples, the system can continually track water usage and the associated reports can be compared to utility meter readings to catch leaking toilets, faucets and more . . . including inaccurate utility meters. The system can include a smart learn mode for use in monitoring and tracking water usage. For example, a user can input water consumers present in the water distribution system, such as devices which use water like ice makers, etc.) to ignore. In home application examples, the system can work in harmony with the modern home owner, alerting him to critical conditions, but not shutting down the water supply when common water using appliances are merely trying to function. For example, the system can "learn" the characteristics of the refrigerator, and when the refrigerator uses water for a short duration, such as to make ice cubes, this event can be ignored and treated as a non-critical event. This learned profile allows the user to input water consumers within the water distribution system to prevent false alarms.

Such identified water user can include, for example, if a user simply leaves a faucet dripping to prevent a frozen pipe during extremely frigid winter months.

Operation of the whole home water appliance can include a number of significant benefits, including: Prevent/mitigate large insurance claims, and cooperatively operate with whole home automation—wifi, zigbee, Nest™ network, etc.

In a home application, significant damage from water can result from leaking clothes washer/dishwashers and other appliances, mechanical failures of toilets and other water dispensing devices, leaking ice makers, or any other appliance or device connected with the water distribution system in a home building structure.

In example applications in commercial building structures other than a home, such as a doctor's and dentist's offices, the whole home water appliance can protect valuable equipment and other assets, such as when the office is closed. For example, in dentist offices and medical offices, expensive electronic equipment can be damaged even by the smallest water leaks. Using the whole home water appliance, water leaks can be automatically detected and damage can be minimized to the business similar to a home.

The typical home or business can suffer quick, immediate, and extensive damage from fire, theft/vandalism, natural disaster, and water damage. Other forms of home damage can occur over a longer period of time, or are simply not as significant as damage from these primary sources. Fire and burglar alarms are prevalent in society, but to date the concept of a water detection and shut down system is unavailable. It is a major area of significant home damage, and is simply unmonitored without the whole home water appliance.

Example Operating Modes

The whole home water appliance can operate in any one of a number of different operating modes in addition to the boost mode. Within the operating modes, the system can operate based on expected water usage. Expected water usage can be monitored based on water flow rates. For example, one or more water flow rate profiles may be used. The water flow rate profiles may be generated by the system, input by a user, and/or be predetermined. In addition, different flow rate profiles may be generated/applied based on different external parameters received as inputs to the system, such as whether an external system is operating (e.g. alarm system armed/disarmed, water softener regenerating), a time of day, a day of the week/month, or any other parameter that can be provided to the system as an indication of expected water usage. In one example, there can be three modes: 1) an Away Mode; 2) a Home Mode; and 3) a Disabled mode.

Figure 16:
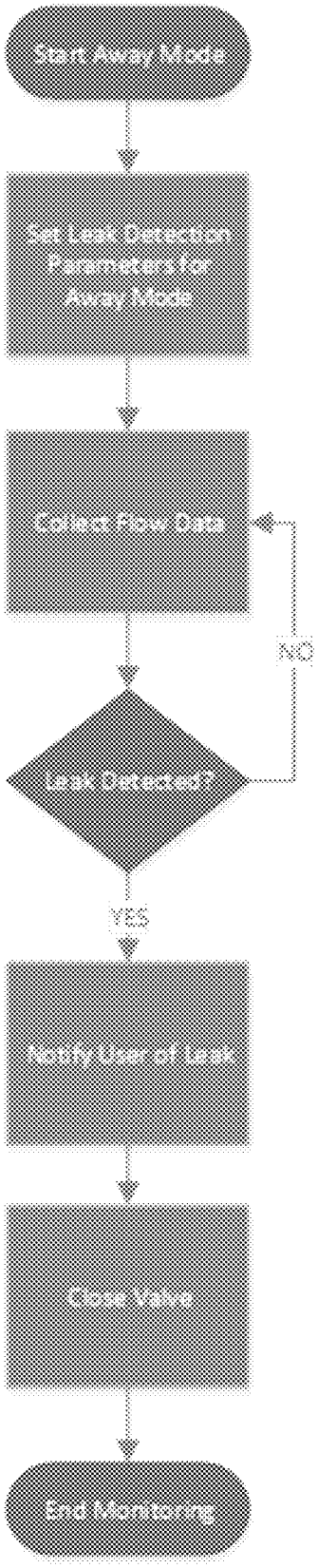
FIG. 16 is a flow diagram illustrating an example of operation of a whole home water protection appliance in an Away Mode.

In the Away Mode, as further illustrated and operationally described in FIG. 16, the system is expecting very little water flow since operation of the water distribution system by a user is unlikely while the user(s) is away from the building structure. Thus, in the Away Mode, the leak detection sensitivity of the whole home water appliance is increased in order to more quickly detect a potential leak condition. In an example, the system may include one or more predetermined water flow profiles representative of the building enclosure not being inhabited. Detected water flow conditions outside the predetermined water flow profile(s) can be characterized by the system as a leak condition.

This mode allows the system to collect flow data, and analyze the collected flow data for conditions indicating a water leak under circumstances of little or no water flow in the water distribution system, except from predetermined automated water use sources, such as ice makers, humidifiers, water softeners and other automated equipment. Thus, the system can respond quickly to any unexpected water flow as a detected leak, while also reducing the chances of false alarms. Also, the system can automatically actuate a water control device to stop water flow, such as by automatically closing a water valve, if a leak is detected without regard to other operational conditions in the water distribution system being monitored. In an example configuration, once a water control device is actuated, such as by closing a water valve, the user can manually intervene to re-open the valve. In some example configurations of the Away Mode, upon detection of a leak, the system can enter a lock mode where the system will not automatically actuate the water control device to resume a water flow condition, such as actuating a valve back to an open position, under any circumstances until removed from the lock mode by a user.

Figure 17:
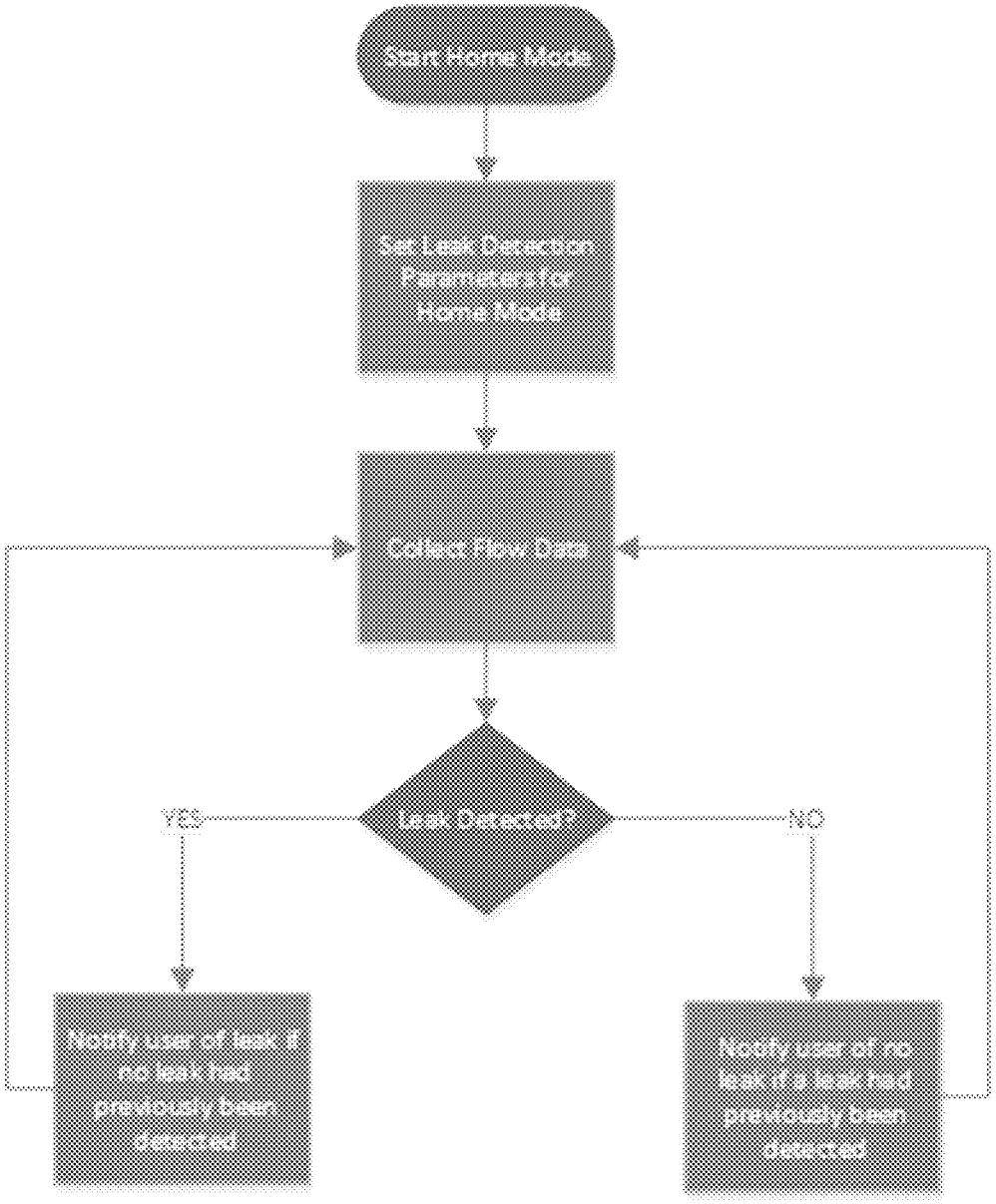
FIG. 17 is a flow diagram illustrating an example of operation of a whole home water protection appliance in a Home Mode.

In the Home Mode, as further illustrated and operationally described in FIG. 17, leak detection parameters may be set for conditions where the system is expecting variability of water flow due to the building enclosure being occupied by people or appliances using water. The leak detection sensitivity of the whole home water appliance can be lower relative to the Away Mode in order to prevent false alarms. For example, predetermined water flow profiles can be customized by the user in accordance with expected water usage to provide wider acceptable variability due to predetermined expected operational conditions. In at least some embodiments, the system may allow a user to identify the type and quantity of water usage devices/systems in the building structure so that the system can generate one or more expected water flow profiles. For example, a user can indicate that a building structure includes three showers, four toilets, three bathroom sinks, one kitchen sink, one dishwasher, one clothes washer, and three outdoor sillcocks.

Using this information, the system can construct one or more water flow profiles that are customized to the building structure. In another example, the system can be placed in a monitor mode in which one or more water flow profiles are generated by the system based on actual daily usage. In this example, once one or more initial water flow profiles are generated, the system can dynamically and automatically, and/or with user input, adjust the water flow profiles based on operational conditions. In at least some example configurations of the Home Mode, the system does not automatically actuate the water control device, such as opening or closing a water control valve, and instead, the user can manually intervene to control the water control device, such as the valve.

In the Disabled Mode, the system does not monitor water flow, and the system does not automatically actuate a water control device, such as by opening or closing a water valve. Instead, in the Disabled Mode the user must manually intervene to control the water control device.

Example User Interface and Configuration

Physical User Interface

The whole home water appliance can provide a user interface that facilitates changing the operating mode of the system, turning on and off the primary and secondary pumps, opening and closing one or more water control devices, such as a water control valve, and various other miscellaneous functions. The user interface can also provide visual indication of the operating mode, water control device status, battery status, and other miscellaneous information such as error conditions.

Example SMS Interface

The whole home water appliance can be configured to send and receive standard text messages, such as SMS messages, sent to and received from an external device, such as a user's cellular phone. Such text messages received by the system can contain pre-defined commands. The table below describes examples of some commands to interface with the whole home water appliance's flow monitoring features. Upon receipt of any command, the system can dynamically and automatically respond back to the user with a text message such as a command acknowledging the command.

TABLE 1

| Command | Description |
|---|---|
| Home | Changes operating mode to "home" mode |
| Away | Changes operating mode to "away" mode |
| Disable | Changes operating mode to "disabled" mode |
| Open | Opens the water valve |
| Close | Closes the water valve |

System Operational Leak Detection Examples

An example of two different leak detection methods for the whole home water appliance are illustrated in FIGS. 12 and 13. The two leak detection methods may be described as: max flow time and usage learning. In other examples, other leak detection methods can be used with the whole home water appliance.

Max Flow

Figure 18:
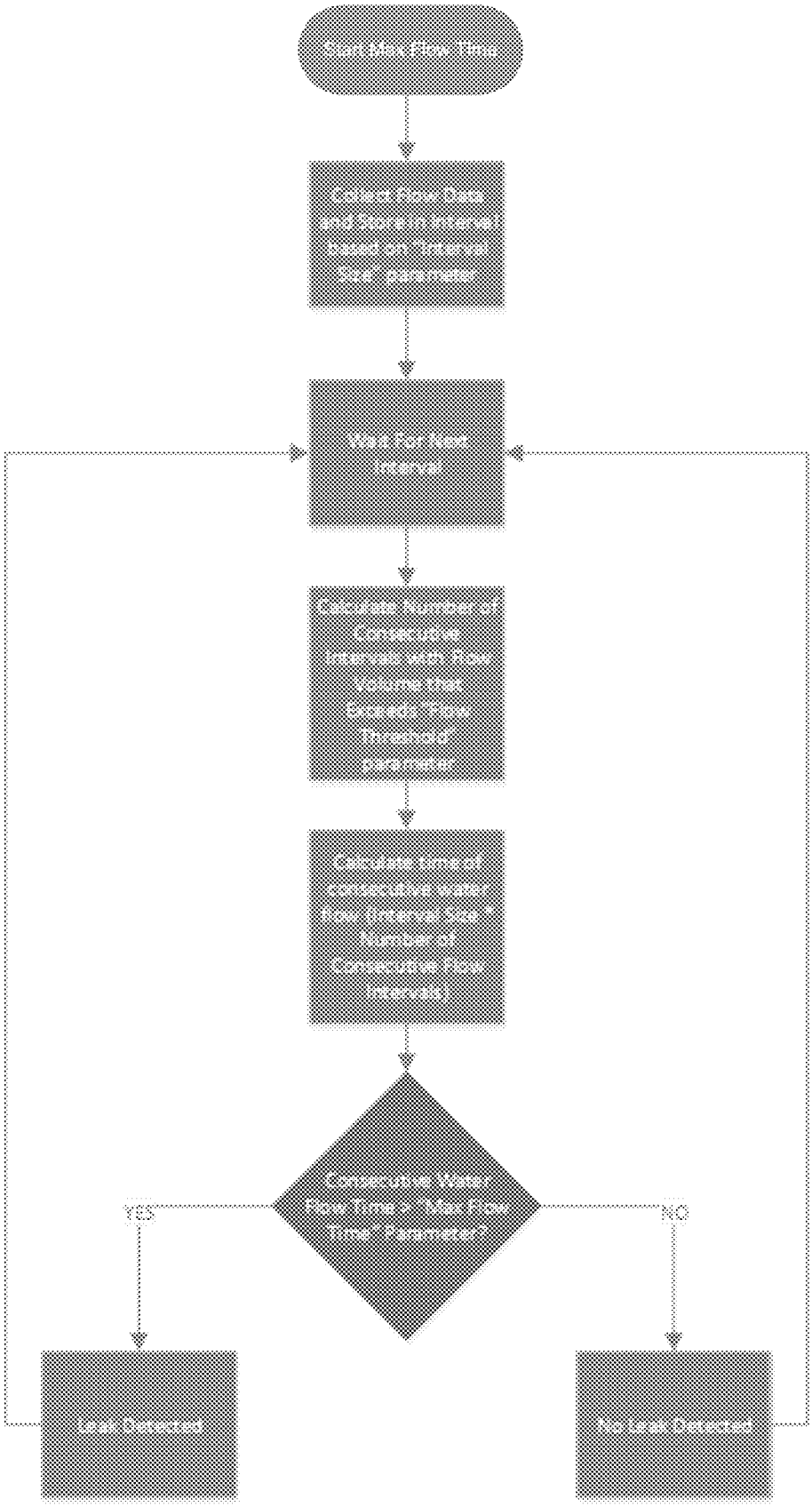
FIG. 18 is a flow diagram illustrating an example of operation of a whole home water protection appliance performing Max Flow leak detection.

As further described and illustrated in the example of FIG. 18, a Max Flow leak detection method can be used in monitoring the water flow and if the flow time exceeds a configured predetermined threshold, the system can indicate a potential leak has been detected.

Usage Learning

Figure 19:
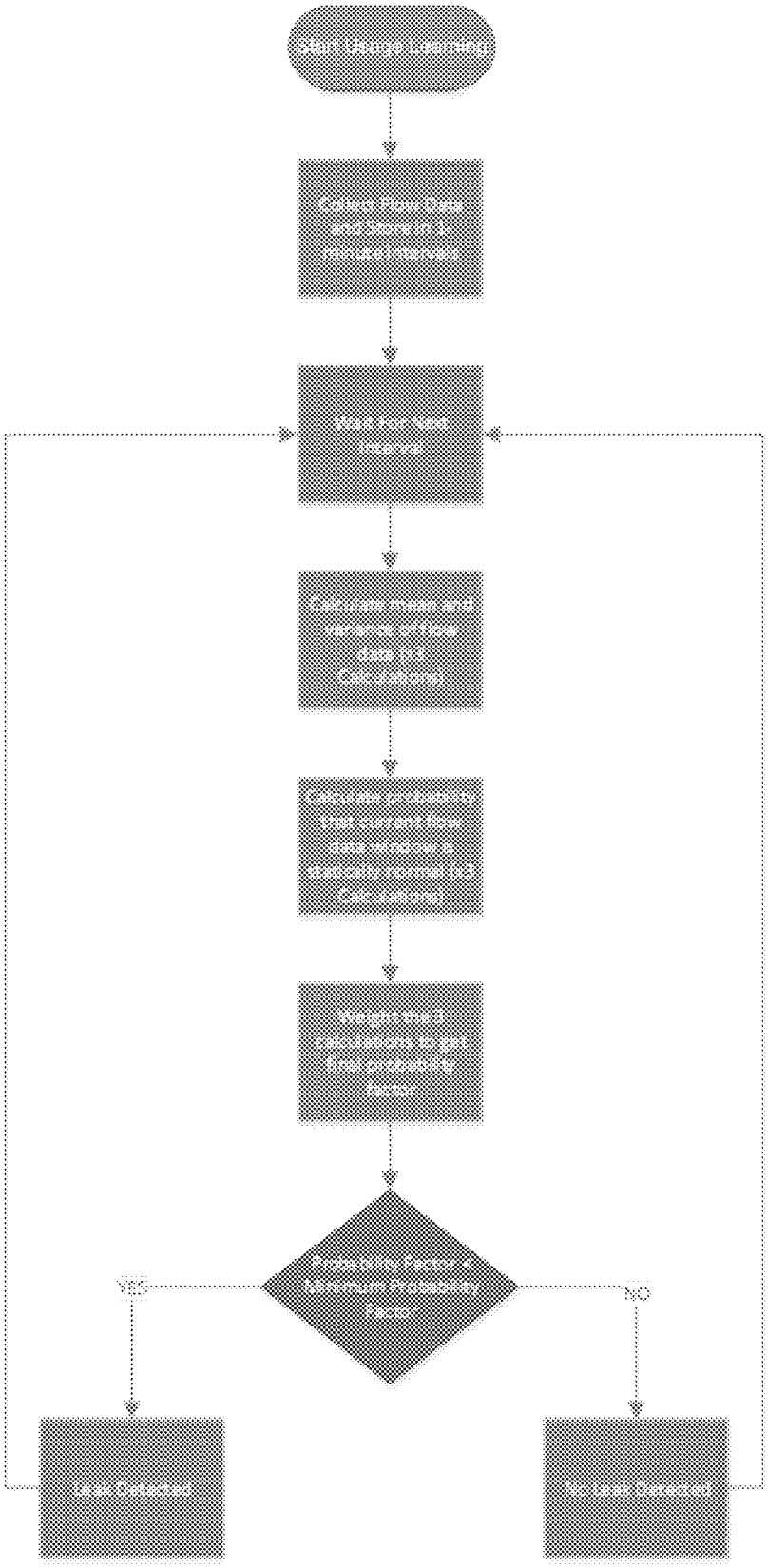
FIG. 19 is a flow diagram illustrating an example of operation of a whole home water protection appliance performing Usage Learning leak detection.

As further described and illustrated in the example of FIG. 19, a usage learning leak detection method can include collection and storage of flow data usage by the whole home water appliance in configurable duration time intervals. The configurable duration of the time intervals can be set by the user as a parameter in the whole home water appliance and/or dynamically determined by the system based on water flow patterns. In the example of FIG. 19, the time interval is indicated as one minute, however, in other examples, any other time interval may be used. Also, in other examples, intervals of varying and different time duration may be dynamically determined, and/or set by the user and used by the system. The system can store a large number, such as several hundred, intervals, which provide a history of water flow. The intervals, or profiles, can be later analyzed to detect leaks. The total flow, as measured from the flow meter, can be integrated over the interval time duration and stored in the interval time slot in chronological order by the whole home water appliance.

Once flow data has been collected, it can be analyzed by the whole home water appliance to detect a potential leak. A predetermined number of parameters can be used in the analysis of any interval. In an example, three parameters can feed into the data analysis: 1) Interval Size; 2) Flow Threshold; 3) Max Flow Time. In other examples, any other number of parameters may be included in the analysis by the system.

Interval Size: This parameter can be used by the whole home water appliance to set the duration, such as in minutes, of flow data collection intervals used by the whole home water appliance. In an example embodiment, a short value will make the system less sensitive to slow leaks, but respond faster to fast leaks, whereas a long value will make the system more sensitive to slow leaks, but respond slower to fast leaks. In this example, the time intervals can be configurable in whole minute increments. In other examples, different values may be used for the Interval Size.

Flow Threshold: This parameter can be used to set a flow volume threshold which indicates that an interval can be considered to have water flowing. Setting this flow threshold parameter to a low value causes the system to be very sensitive to slow leaks. Setting this flow threshold parameter to a high value causes the system to be "forgiving" to slow leaks.

Max Flow Time: This parameter can be used to set a maximum time of continuous water flow. If the number of intervals with consecutive flow multiplied by the interval size in minutes is greater than this max flow time, then the system indicates a potential leak.

An Example Configuration

A typical user, such as a home owner, will not understand or be able to quantify a volume of water flow over a given interval or a potential sump pump failure. This fact can make configuring and tuning the system difficult for a user. To simplify configuration and tuning, in an example, the parameters that feed into flow data analysis can be abstracted to simpler concepts.

The interval size can be user configurable, but can also be considered an advanced setting and can be hidden from the user. In an example embodiment, the system can include a default interval size, such as, for example, 5 minutes. A user may not need to reconfigure this parameter for some applications, such as a typical residential use application. Alternatively or in addition, the system can dynamically learn or determine the interval size during operation.

The flow threshold value can be abstracted from a volume of flow measurement to a "high", "medium", or "low" sensitivity value. The "high" value sets a low flow threshold value. The "low" value sets a high threshold value. These pre-determined threshold values can be preconfigured, but can also be configurable by a user through advanced settings. Alternatively or in addition, the system can dynamically learn or determine the flow threshold values during operation.

The max flow time is measured as a time period, such as minutes, of continuous water flow. The user can set this value directly based on a maximum anticipated continuous water usage time. Alternatively or in addition, the system can dynamically learn or determine the max flow time during operation.

Example Usage Learning

The whole home water appliance can learn water usage patterns to detect abnormal usage which may indicate a leak. By learning the times of day when water is typically being used in a particular application, the system can quickly respond to leaks while reducing the possibility of false alarms. For example, if the system has detected that little to no water has been used from 2:30 am to 2:40 am in the past, but has currently detected water flow, the system can indicate a potential leak to the user. On the other hand, if a building structure such as home experiences several people showering each weekday morning, the water usage will be high but the system will have learned this and will not indicate a leak.

Example Flow Data Collection

The whole home water appliance can store flow volume data in predetermined intervals, such as fixed 1-minute intervals, that are stored in "time slots" based on, for example, day of the week and minute of the day. In this example, each day can be divided into a predetermined number of interval time slots, such as 1440 interval time slots. In addition, each week can be divided into predetermined number of interval time slots, such as 7 days. The system can store a predetermined period of data, such as several weeks of data. In other examples, other types and durations of interval time slots may be used.

Example Flow Data Analysis

The whole home water appliance can employ anomaly detection, which can be based on dynamic machine learning. The historical flow data stored in determined intervals, such as 1-minute intervals, can be used as inputs to anomaly detection to determine the probability that a current flow window's volume is statistically normal. The flow window is the number of intervals being used in the analysis. If the whole home water appliance determines that the flow volume is not statistically normal, the system can indicate a potential leak. In addition, the system can calculate mean and variance of the flow data in various ways. For example: Across a window of the same intervals over any number of previous days; Across a window of the same intervals over the same day in any number of previous weeks; and/or Across any number of previous intervals.

The flow data can be characterized by the whole home water appliance as a normal distribution. The system can perform dynamic probability analysis using mean, variance, and/or current data to determine the probability of normalcy of the current flow data. In an example, the probability analysis by the whole home water appliance can be used to dynamically produce a probability for one or more of mean, variance, and/or current data. These probabilities can be weighted by the system to produce a final probability factor that is compared against a configured minimum probability. The configured minimum probability may be user entered or dynamically learned by the system during operation. If the calculated probability is lower than the configured probability, then a potential leak has been detected.

Example Configuration

One primary configuration parameter for the whole home water appliance is the minimum probability factor. However, some users, such as home owners, may not have a good concept of what this value means. So, the minimum probability factor can be abstracted to a "high", "medium", and "low" sensitivity value. A "high" sensitivity will have a higher minimum probability factor. A "low" sensitivity will have a lower minimum probability factor.

Further advanced configuration includes the window size of the number of intervals to be used in the mean and variance determinations by the whole home water appliance. Also, the number of days, weeks, and previous intervals to be included in the mean and variance calculations can be configurable through advanced settings.

Example Usage Signature Detection

Figure 20:
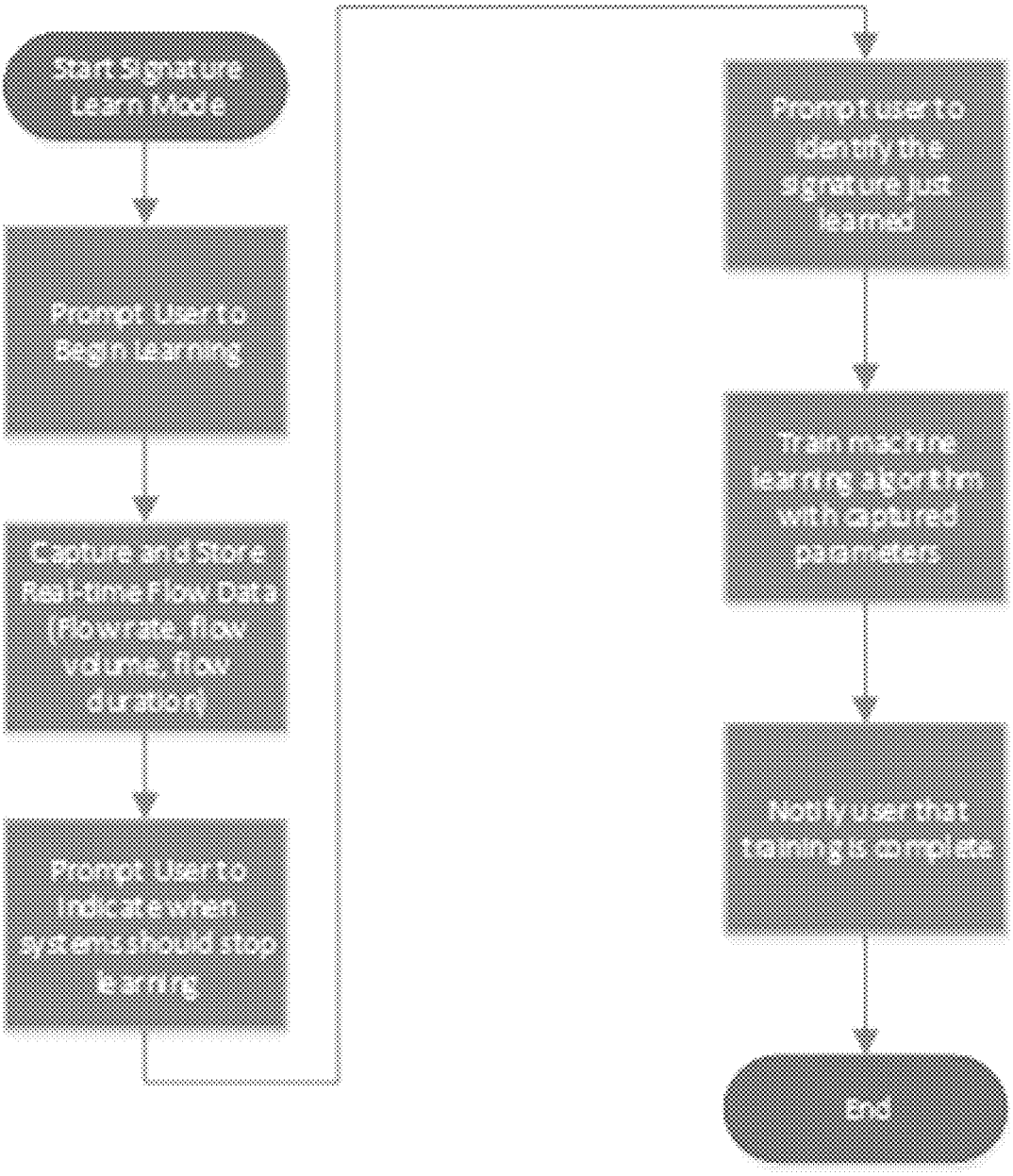
FIG. 20 is a flow diagram illustrating an example of operation of a whole home water protection appliance performing usage signature detection.

As further described and illustrated in the example of FIG. 20, the whole home water appliance can include usage signature detection. The system can use supervised machine learning to dynamically learn the usage signatures of different water consumers in a building structure. In general, different devices or system using water will have a unique signature that can be dynamically learned by the whole home water appliance and used to determine when the device or system is operating to use water. Each water user, such as an appliance, can have different flow rates, flow volume, and flow duration. These parameters can be used by the whole home water appliance to dynamically learn the usage signature of each system or device. Further parameters can be derived by the whole home water appliance from these core parameters, such as flow rate of change.

The system can dynamically learn/be taught what signature belong to what system or device in a particular water distribution system. This can be accomplished by placing the system in signature detection mode and then running each system or device to be learned. While in learn mode, the system can capturing real-time flow data and store it. This information can be used by the whole home water appliance to generate parameters that are used to train the whole home water appliance using supervised machine learning about the signature. In the application of a neural network within the whole home water appliance, for example, these parameters can be used in a backpropagation method of training. Once the whole home water appliance has been trained with a set of devices/systems, the system can continuously monitor current flow data, which can be dynamically analyzed by the whole home water appliance to determine if the data matches any learned signature.

The system keeps track of statistics of each device/system that it has been trained on. Thus, the system can keep track of the number of times a device or system has operated, the total and average volume of water consumed by the device/system, and/or the total and average duration of usage. This information can be stored and requested by the user at any time.

As more signatures are learned by the system, accuracy of dynamic detection of a water leak can increase. The device signature statistics can be used by the whole home water appliance as an additional input to the Usage Learning described above to flag usage as a leak or not.

Automatic Antenna Selection

Figure 21:
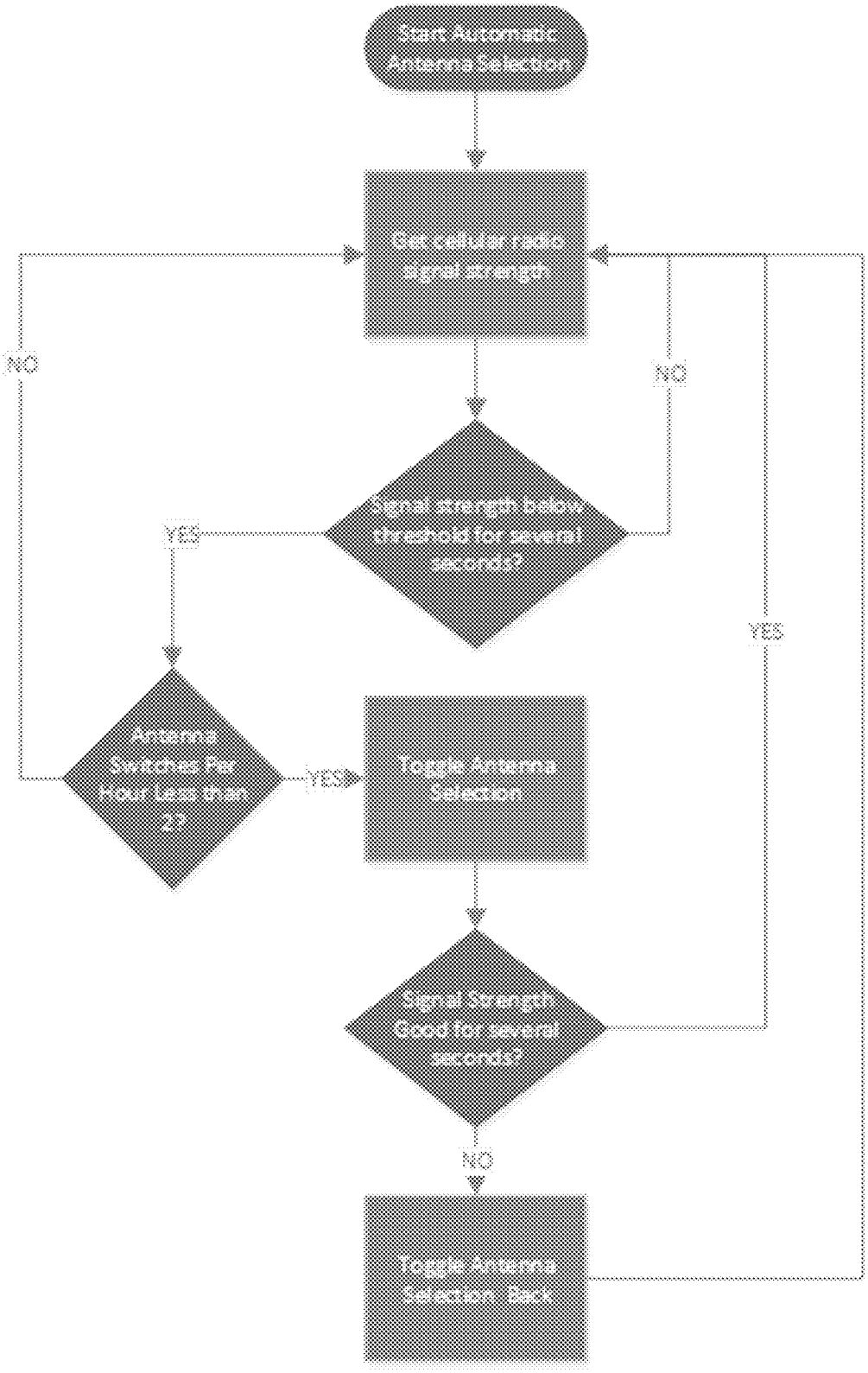
FIG. 21 is a flow diagram illustrating an example of operation of a whole home water appliance performing antenna selection.

FIG. 21 is an example of an operational flow diagram for selecting a system antenna. The system can include the ability to switch between an internal on-board antenna and an external antenna. The whole home water appliance can dynamically and automatically switch to the antenna with the best and most reliable signal. During operation, the system can continuously monitor the signal strength of the cellular radio. If the signal strength falls below a certain minimum value, the system can dynamically switch to the other antenna. For example, if the system is currently on the internal on board antenna and the signal strength is poor, it can dynamically switch to the external antenna. The signal strength can then be monitored by the whole home water appliance for several seconds to compare the current and previous signal strength, signal-to-noise ratio or other parameter indicative of quality of the signal. If the signal strength is worse after the switch, the system can dynamically switch back to the previous antenna. To prevent a continuous switching back and forth in the case of continuously poor signal strength, the system can limit the number of antenna switches to a predetermined number in a predetermined duration, such as 2 switches per hour.

Figure 22:
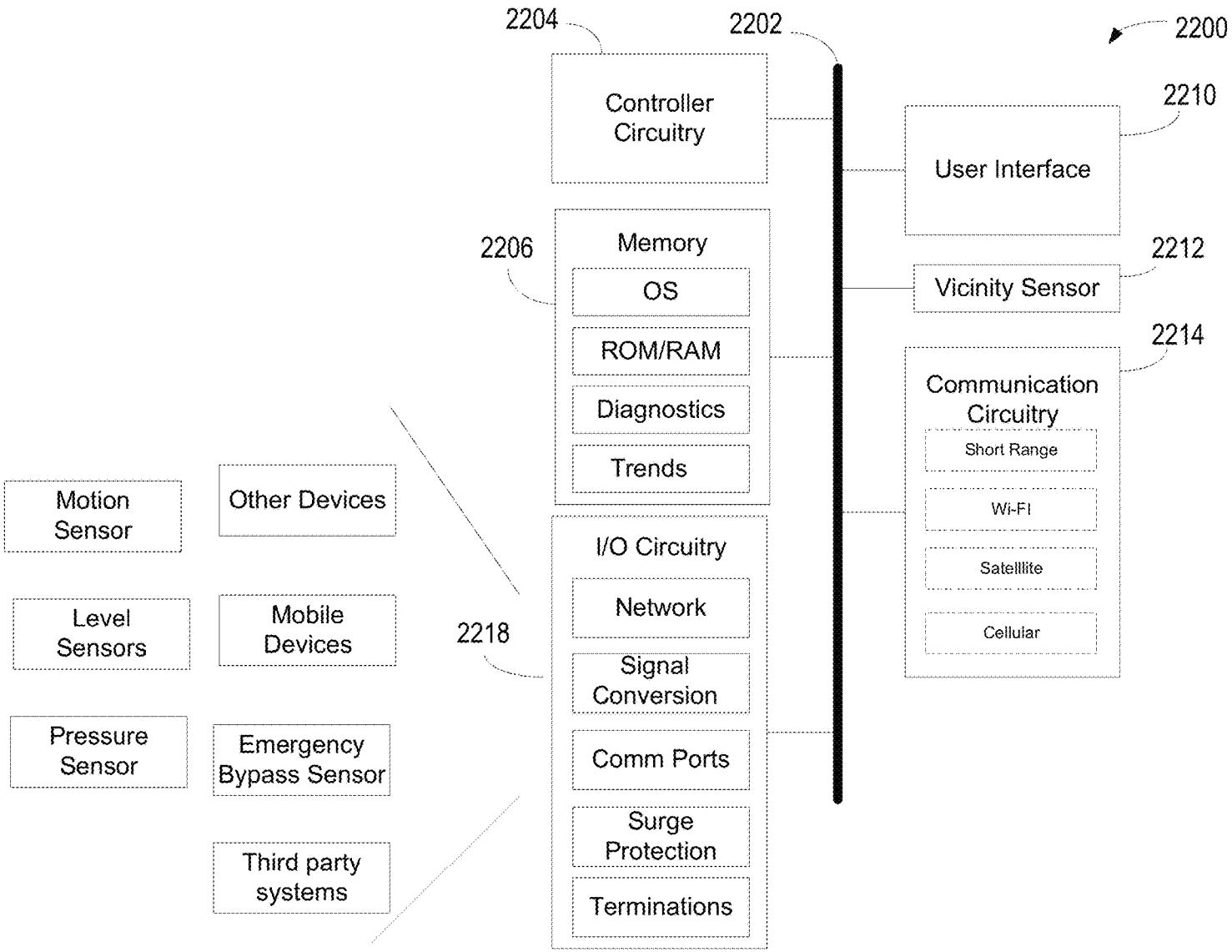
FIG. 22 is a block diagram illustrating an example of an electronics system 2200 included in the whole home water appliance system.

FIG. 22 is a block diagram illustrating an example of an electronics system 2200 included in the whole home water appliance system 400. Electronics system 2200 includes a communication mechanism such as one or more busses, cables, circuits or components for passing information between other internal and external components of the electronics system 2200. Information is represented as physical signals of a measurable phenomenon, typically electric voltages, but including, in other embodiments, such phenomena as magnetic, electromagnetic, pressure, chemical, molecular atomic and quantum interactions. For example, north and south magnetic fields, variable analog voltage or current or a zero and non-zero electric voltage representing two states (0, 1) of a binary digit (bit). A sequence of binary digits constitutes digital data that is used to represent a number or code for a character. A bus 2202 includes many parallel conductors of information so that information is transferred quickly among devices coupled to or in wireless communication with the bus 2202. Controller circuitry 2204 for processing information are coupled with the bus 2202. The controller circuitry 2204 may include processor(s) and/or other logic circuitry to receive and transmit information, execute logic, and perform a set of operations on information. The set of operations may include receiving information from the bus 2204 and placing information on the bus 2204. The set of operations may also include comparing two or more units of information, shifting positions of units of information, and combining two or more units of information, such as by addition or multiplication or other mathematical operation. A sequence of operations to be executed by the controller circuitry 2204 constitute computer instructions.

Electronic system 2200 may also include a memory 2206 coupled to bus 2202. The memory 2206, such as a random access memory (RAM) or other dynamic storage device, stores information including computer instructions. Dynamic memory allows information stored therein to be changed by the controller circuitry 2202. RAM allows a unit of information stored at a location called a memory address to be stored and retrieved independently of information at neighboring addresses. The memory 2206 is also used by the controller circuitry 2204 to store temporary values during execution of computer instructions. The memory 2206 may also include a read only memory (ROM) or other static storage device for storing static information, including instructions, that is not changed by the controller circuitry 2204. The RAM or the ROM may also include instructions, that persists even when the electronics system 2200 is turned off or otherwise loses power.

Stored within the memory 2206 may be data and instructions. Data may include operational data, predetermined variables, system parameters and the like. Instructions may be executable by the controller circuitry. The memory 2206 may store a whole home water appliance operating system (OS) that is executable to support the functionality described herein. In addition, trending may be executable to provide trend pages and generate operational information for trending and display. Also, diagnostics instructions may be stored that are executable by the controller circuitry to performing testing and ascertain the operational status of the whole home water protection system.

A user interface 2210 is also coupled with the bus 2202. The user interface 2210 may include one or more external input devices, such as a touch screen display, buttons, a keyboard, or a sensor, such as a fingerprint or facial recognition sensor or other external devices used for interacting with humans. The touch screen display may present images and allow user interaction via the screen or via a pointing device, such as a mouse or stylus included in the user interface 2210, for controlling a position of a cursor image presented on the display to issue commands associated with graphical elements presented on the display.

Although not illustrated, special purpose hardware, such as an application specific integrated circuit (IC) or an field programmable gate array (FPGA) may also be coupled to bus 2202. The special purpose hardware may perform operations not performed by the controller circuitry 2204, or may be included as part of the functionality performed by the controller circuitry 2204. Examples of application specific ICs include graphics accelerator cards for generating images for display, cryptographic boards for encrypting and decrypting messages sent over a network, speech recognition, and interfaces to external devices.

The electronics system 2200 may also include a vicinity sensor 2212, such as a camera or a motion detection sensor. The vicinity sensor 2212 may detect conditions in its vicinity and transform those detections into signals compatible with the controller circuitry 2204, or other parts of the electronics system 2200.

The electronics system 220 may also include communication circuitry 2214. Communication circuitry 2214 may include one or more instances of different communications interfaces. Communication interfaces may provide two-way communication with a variety of external devices that operate with their own processors, such as servers, mobile devices, and the like. Wireless links may also be implemented. For wireless links, the communications circuitry 2214 may send and receive electrical, acoustic or electromagnetic signals, including infrared and optical signals, that carry information streams, such as digital data. Such signals are examples of carrier waves.

In an example, the communication circuitry 2214 includes one or more wireless communication transceivers such as a short range transceiver, a Wi-Fi transceiver, a satellite transceiver and a cellular transceiver.

The short range transceiver may provide wireless communication within a predetermined physical distance of the whole home water appliance using a personal area network (PAN) or piconet that may include one or more devices. The predetermined physical distance may be, for example, within 100-500 feet, and the short range transceiver may use a predetermined short range wireless communication protocol. Example short term communication protocols include Bluetooth™, Infrared, near field communication, ultraband and Zigbee™. Using the short range communication protocol, the whole home water appliance system may wireless messages to devices that come within the PAN. Such wireless messages may include status messages, alarms and messages related to the device being with a short distance of the device. In addition, upload and download of data may occur over the PAN. For example, a user may download a program update to their mobile device and then come within the PAN to download the program update to the whole home water appliance system without incurring wireless data charges. The importance of the PAN becomes obvious when the reader considers the nature of cellular and satellite networks, in which the end user typically pays for data based on the amount of data used. A large update file for the operating system could be in the hundreds of megabytes, and accordingly create a large over-the-air update fee. The PAN receives this file from the users smartphone or other mobile device, which typically receives the update file from a central update server via Wi-Fi or other "free" network connection. This eliminates receiving the large update file via a paid cellular or satellite connection where the user is charged for megabytes uploaded/downloaded.

The Wi-Fi transceiver may provide a communication protocol and handshaking for short range communication with a wireless router providing internet access. The Wi-Fi transceiver may support a peer-to-peer link between the whole home water appliance system and a wireless router with MAC address based communication protocol such as 802.11 operable at 2.4 GHz or 5 GHz.

The satellite transceiver may provide communication protocols for long range communication via a gateway to relay data bi-directionally via satellite. The whole home water appliance system may communicate in a predetermined communication protocol with the gateway.

The cellular transceiver may provide long range communication between the cellular transceiver included in the whole home water appliance system and a cell tower in the vicinity of the structure in which the whole home water appliance system is installed. The communication protocol may include text message communication protocols, such as SMS. The cellular transceiver is constructed in the form of a "socket modem". In this configuration, the socket modem is a plug-and-play device which can be easily replaced by an end user without specialized knowledge of cellular networks. Cellular networks have "sunsets" where a communications generation, such as 3G for example, will be shutdown by the underlying carrier to free up bandwidth and electromagnetic spectrum for 4G service, for example. When this happens, the end device must receive a new radio technology, and the older 3G radio is no longer supported by the carrier. The socket modem allows quick radio replacement, and when the new socket modem is plugged into the WHWA, it detects the Operating system (OS) version of the WHWA, and reprograms it with the latest, needed version of OS. In addition, the socket modem can come in not only cellular formats, but also wifi and satellite, and in these modes is also a plug-and-play implementation, eliminating the need for the user to be expert of the underlying technology. The user merely plugs in the socket modem, and the socket modem itself updates the overall system OS with the correct program to operate the respective radio technology. In all cases, when the socket modem completes the OS updates, the WHWA updates its OS version, and radio identification information automatically with a central cloud server database, so that the manufacturing and build information is completely up to date. This automated process eliminates the need for manual operator intervention to keep manufacturing files up to date The electronics system 2200 may also include an input/output (I/O) circuitry 2218. The I/O circuitry 2218 may include a network interface. In general the network interface may enable connecting with a local network to which a variety of external devices with their own processors are connected. For example, the network interface may be network interface card (NIC) having an RJ45 connection for network communication via communication protocol such as TC/PIP. In some examples the network communication interface may be an integrated services digital network (ISDN) card or a digital subscriber line (DSL) card or a telephone modem that provides an information communication connection to a corresponding type of telephone line. In some examples, the network interface may be a modem that converts signals on bus 2202 into signals for a communication connection over a coaxial cable or into optical signals for a communication connection over a fiber optic cable. As another example, network interface may be a local area network (LAN) card to provide a data communication connection to a compatible LAN, such as Ethernet.

The network interface typically provides information communication through one or more networks to other devices that use or process the information. For example, the network interface may provide a connection through a local network to a host computer or to equipment operated by an Internet Service Provider (ISP). ISP equipment in turn provides data communication services through the public, world-wide packet-switching communication network of networks referred to as the Internet. Servers connected to the Internet provides a service in response to information received over the Internet. For example, servers may provide information for display or may store information received from the whole home water appliance system.

The I/O circuitry 2218 may also include signal conversion circuitry, surge protection circuitry and communication ports. Signal conversion circuitry may include analog-to-digital and digital-to-analog converters, contact closure conversion, frequency converters, and any other form of circuitry for changing from one signal type or range to another. The surge protection circuitry may include optical isolators, capacitors, current and/or voltage arrestors, isolated grounds, floating grounds and any other circuitry to address undesirable changes in voltage and/or current. The communication ports may provide a communication interface in the form of wired parallel ports or a serial ports or universal serial bus (USB) port or other form of port communication.

The I/O circuitry 2218 may also include terminations. Terminations may include incoming and outgoing contact closures, 4-20 ma signals, 2 wire, 4 wire, and other forms of wired signals and communications for the whole home water appliance system. The I/O circuitry 2218 may also cooperative operate with the communication circuitry 2214 to provide an interface for communication external to the whole home water appliance system and/or internal to the whole home water appliance system.

Devices within the whole home water appliance system may include the emergency bypass sensor, the level sensors, the pressure sensor, humidity sensors, motion detectors, power quality sensors, natural gas sensors, CO2 sensors, temperature sensors, audio sensors, motor ampere sensors and the various other sensors and indications described herein. The WHWA may act as the monitoring hub for the entire home mechanical room by providing external I/O accessible from, for example, the rear of the appliance shroud of the WHWA or the quick disconnect stations, via external terminal blocks, connectors or other signal connection means. For example, it would be common that the home furnace, hot water heater, radon fan, sewage ejector pump, humidifier, dehumidifier, water softener, water filter, and other central home equipment is located in the mechanical room. The WHWA external I/O can receive signals (analog, digital, or via a communication protocol such as RS232, Bluetooth™, proprietary communication protocols, and the like) and monitor critical or routine reminder alarms from all these devices. By consolidating all signals/readings/indications into a single appliance, the need for multiple different alarm monitoring systems can be eliminated or minimized. In addition, remote automated notification of the homeowner via smartphone of important failures, alarms, operational conditions or needed routine maintenance to any mechanical room equipment may be enabled and communicated via the WHWA The I/O circuitry 2218 may also be used to interface other third party systems such as an HVAC system, premise alarm systems and the like to the WHWA where such indications are used to optimize or otherwise effect operational behavior of the WHWA. Also, the I/O circuitry 2218 may also be used to communicate with other devices, such as devices located proximate the whole home water appliance system, for which the whole home water appliance system may be used to communicate. The I/O circuitry 2218 may also be used to communicate locally with devices such as laptops, smart phones, tablets and the like.

The methods, devices, processing, circuitry, and logic described above for the whole home water appliance system may be implemented in many different ways and in many different combinations of hardware and software. For example, all or parts of the implementations may be circuitry, such as the controller circuitry, that includes an instruction processor, such as a Central Processing Unit (CPU), microcontroller, or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Accordingly, the circuitry may store or access instructions for execution, or may implement its functionality in hardware alone. The instructions may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed. For instance, the circuitry may include multiple distinct system components, such as multiple processors and memories, and may span multiple distributed processing systems. Parameters, databases, and other data structures may be separately stored and managed, may be incorporated into a single memory or database, may be logically and physically organized in many different ways, and may be implemented in many different ways. Example implementations include linked lists, program variables, hash tables, arrays, records (e.g., database records), objects, and implicit storage mechanisms. Instructions may form parts (e.g., subroutines or other code sections) of a single program, may form multiple separate programs, may be distributed across multiple memories and processors, and may be implemented in many different ways. Example implementations include stand-alone programs, and as part of a library, such as a shared library like a Dynamic Link Library (DLL). The library, for example, may contain shared data and one or more shared programs that include instructions that perform any of the processing described above or illustrated in the drawings, when executed by the circuitry.

Software Based Artificial Intelligence & Virtual Home Manager

The whole home water appliance system, described herein, contains sophisticated electronic sensors and controller circuitry. In an example implementation, sensor data combined with historical usage records can be used by the controller circuitry to provide artificial intelligence (AI) type of analysis for a user, such as a homeowner or customer. This controller circuitry may include models, databases and executable instructions to perform AI by prediction based on historical data, extrapolation and/or predetermined operational characteristics or patterns. The AI performed by the microprocessor may be self-learning such that the controller circuitry is capable of dynamically adjusting the models, patterns, operational characteristics and data to maintain or improve accuracy of the AI as operational parameters of the system fluctuate.

The AI may be executed by the controller circuitry such that the system operates as a Virtual Home Manager, to analyze the collected data to make notifications, analysis, and reports to the customer on important events and trends which may be overlooked by the untrained eye, attempting to analyze scores of data, presented over long periods of time. For example, the following uses may be optional AI features which may be contained in the appliance, and made available to the homeowner or customer. 1) POWER QUALITY METERING circuitry; 2) HUMIDITY circuitry; 3) NATURAL GAS DETECTOR circuitry; 4) CO2 DETECTOR circuitry; 5) TEMPERATURE DETECTION circuitry; 6) LISTEN-IN MODE circuitry; 7) TIMED ALERTS circuitry; 8) OCCUPANCY DETECTION circuitry; and 9) Nest™ Network COMPATIBILITY circuitry.

1) POWER QUALITY METERING circuitry—the whole home appliance monitors for AC power loss in a home, as previously discussed. The power quality metering circuitry may be hardware or a combination of hardware and software which provides enhanced features in the form of data capture, processing and analysis functionality in order to provide additional information to the user or customer, such as detailed graphs of power sags, dips, spikes, brown-outs, and other common power problems. In addition, the functionality of the power quality metering circuitry may provide the homeowner with UPS quality power quality indicators, and analysis to make suggestions to correct poor or undesirable power situations.

2) HUMIDITY circuitry—the whole home appliance may include humidity sensors and corresponding functionality to monitor the humidity level in the mechanical equipment room or other location of whole home appliance. During operation, the humidity circuitry may issue "possible mold alerts" based on high humidity levels for extended periods, and make suggestions on how to solve such issues. These alerts may be in the form of text messages sent to a mobile device, generated reports, indications of the user interface of the whole home appliance, or any other form of communication to the user or customer 3) NATURAL GAS DETECTOR Circuitry—the whole home water appliance system may also be equipped with one or more optional natural gas leak detector or sensor. The natural gas leak detector(s) may be included in the structural frame. Using the natural gas leak detector, the gas detector circuitry can detect a natural gas leak and alert the homeowner of the gas leak, such as from a furnace or hot water heater in the vicinity of the whole home water appliance system. The gas detector circuitry may also make suggestions on what this means and provide possible solutions to the user or homeowner via text messages sent to a mobile device, generated reports, indications of the user interface of the whole home appliance, automated phone calls, or any other form of communication to the user or customer.

4) CO2 DETECTOR circuitry—the whole home water appliance may be equipped with one or more optional Co2 detectors, such as CO2 sensors. The CO2 detector(s) may be located in the structural frame. The CO2 detector circuitry may include functionality to alert the user or homeowner to excess CO2, such as from incorrect exhausting of a natural gas furnace or hot water heater, and the like based on readings from the CO2 detector(s). These alerts may be in the form of text messages sent to a mobile device, automated phone calls, generated reports, indications of the user interface of the whole home appliance, or any other form of communication to the user or customer. In addition, the CO2 detector circuitry may include functionality to make suggestions on what the alerts mean, and how to solve.

5) TEMPERATURE DETECTION circuitry—the whole home water appliance may be equipped with one or more optional temperature sensors. The temperature sensors may be located in the structural frame and configured to detect ambient air temperature and/or water temperature. The temperature detector circuitry may include functionality to, for example, alert a homeowner to freezing conditions in the mechanical room or other location where the whole home water protection application resides. These alerts may be in the form of text messages sent to a mobile device, automated phone calls, generated reports, indications of the user interface of the whole home appliance, or any other form of communication to the user or customer In addition, the temperature detection circuitry may include functionality to make suggestions on what the alert means, and how to solve.

6) LISTEN-IN MODE circuitry—the whole home water appliance may be equipped with an optional sensitive microphone, or other form of listening device, which may be located in the structural frame. The listen-in mode circuitry may include functionality to alert the homeowner or customer to the fact that the other equipment in the vicinity of the whole home water appliance is malfunctioning. For example, the listen-in mode circuitry may determine that the furnace, or hot water heater, is not starting/stopping correctly by monitoring or "listening" for the equipment to be operating or running as expected in the mechanical room where the whole home water appliance is located. These alerts may be in the form of text messages sent to a mobile device, automated phone calls, generated reports, indications of the user interface of the whole home appliance, or any other form of communication to the user or customer. In addition, the listen-in mode circuitry may include functionality to make suggestions on what the alerts mean, and how to solve.

7) TIMED ALERTS circuitry—the whole home water appliance may include functionality to provide optional recurring, timed schedules to alert a homeowner or customer when it is time to perform a task, such as a routine maintenance task. Routine maintenance tasks may include replacement of furnace filters, water filters, and/or any other recurring maintenance tasks. These alerts may be in the form of text messages sent to a mobile device, automated phone calls, generated reports, indications of the user interface of the whole home appliance, or any other form of communication to the user or customer. In addition, the time alerts circuitry may include functionality to make suggestions on what the alerts mean, and how to solve. For example, the alerts may include links to online retailers, such as Amazon, for convenient reordering of items associated with the maintenance, such as filters, etc. The links may be embedded in the alert notifications.

8) OCCUPANCY DETECTION circuitry—the whole home water appliance may include functionality that provides optional occupancy notifications to alert homeowner or customer. The alerts may provide, for example, information that someone may be in the home. The functionality of the occupancy detection circuitry may be configured to monitor home water usage, such as flushing toilets or a faucet being opened, and then alerting the homeowner of a possible home breach. In addition, the functionality of the occupancy detection circuitry may make suggestions regarding what the alert means, and how to solve.

9) Nest™ Network COMPATIBILITY circuitry—the whole home water appliance may be equipped with optional Nest Network interface circuitry such that the whole home water appliance can be viewed from the homeowners Nest phone app, and use this single app to monitor his whole home water system, Nest smoke detectors, Nest thermostats, and Nest cameras.

10) EXTRA INPUTS/OUTPUTS circuitry—the whole home water appliance may be equipped with additional inputs/outputs (I/O) to monitor any additional sensors or appliances the homeowner or customer wishes to monitor. In addition, the extra inputs/outputs circuitry may provide functionality to use the whole home water appliance as a single gateway to aggregate this additional collected data for the homeowner or customer. In addition, functionality of the extra inputs/outputs circuitry may make suggestions on what this additional data/alert means, and how to interpret.

Figure 23:
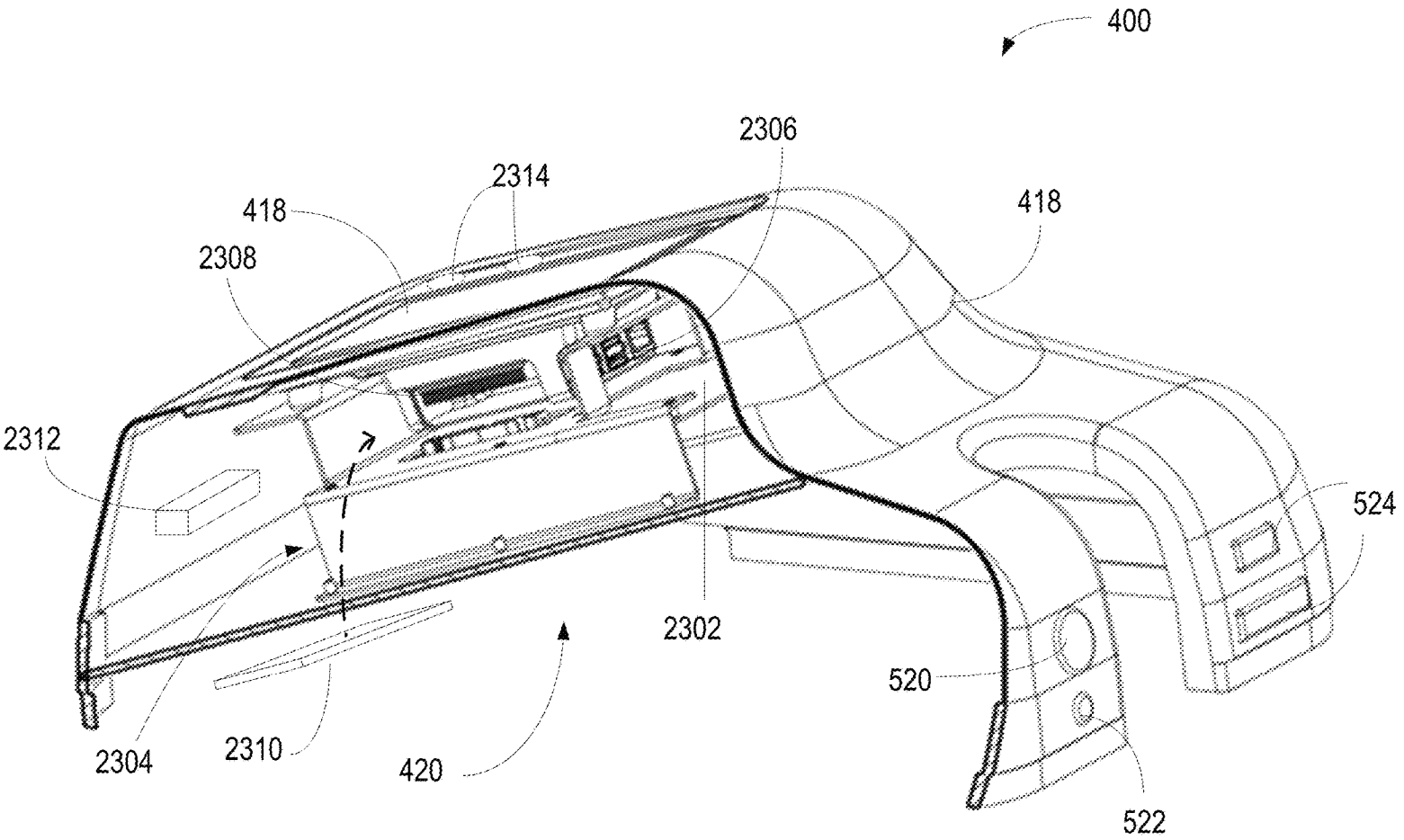
FIG. 23 is a perspective cutaway view of a portion of an example of the whole home water appliance system.

FIG. 23 is a perspective cutaway view of a portion of an example of the whole home water appliance system 400. In FIG. 23, a cutaway view of an example of a shroud 418 is depicted illustrating an example of an electronics enclosure 420, which is included therein. Thus, the electronics and circuitry associated with the whole home water system are modularized in an area that is spaced away from the septic pit and isolated from liquid related components of the whole home water appliance system. In other examples, one or more of the electronic enclosure 420 can be included elsewhere in the structural frame of the whole home water appliance system 400.

The electronics enclosure 420 may include any or all of the electronic related functionality described herein. In addition, any electronic related devices positioned elsewhere in the structural frame may be in electrical communication with electronics, such as the controller circuitry, included in the electronics enclosure 420. The electronic enclosure 420 may be removable from the structural frame as part of the shroud 418. Accordingly, the electronics in the electronic enclosure 420 may be in electrical communication with other components included in the whole home water appliance system via one or more wiring harnesses that include two piece connectors that enable quick disconnect.

The illustrated example includes the display 418 in electrical communication with a printed circuit board (PCB) 2302 included in the electronics enclosure 420. The PCB 2302 may include the controller circuitry, memory, I/O circuitry and the like. In other examples, multiple PCBs, circuitry, or a combination of circuitry and PCB's may be used. Also included in the electronics enclosure 420 is a power supply 2304 for supplying power for the whole home water appliance system 400, and a connector panel 2306. The connector panel 2306 may include the two piece connectors to enable disconnection and removal of the electronic enclosure 420. In addition, connections for the I/O circuitry may be include in the connector panel 2306. Alternatively, or in addition, other connectors may not be landed on the connector panel 2306.

The connector panel 2306 may be included in the electronics enclosure 420 to enable quick disconnect. The connector panel 2306 may also include connectors to electrically connect the display 418, such as ribbon cable connectors, and one or more wiring harnesses or ribbon cable connectors to connect the data communication ports 520, the electric power supply port 522, and one or more external I/O connections 524, such as terminations, to the I/O circuitry.

The electronics enclosure 420 may also include a communications connector 2308. The communications connector 2308 may be, for example, an edge connector in which communications circuitry, such as in the form of a communication circuitry PCB 2310 may be inserted as illustrated by dotted arrow in FIG. 23. In this configuration, different communication circuitry PCBs 2310 may be installed and removed from the system in accordance with the needs of a user. For example, in a system that included only cellular communications capability, a communications circuitry PCB 2310 for cellular service may be removed from the communications connector 2308 and replaced with an upgraded communications circuitry PCB 2310 for both cellular communications capability and WI-FI capability. In another example, a communication circuitry PCB 2310 for cellular communications could be removed from the communications connector 2308 and replaced with a communication circuitry PCB 2310 for satellite communications due to lack of availability of cellular service at the installation site of the whole home water appliance system.

The electronic enclosure may also include a motion detector 2312. The motion detector 2312 may include motion sensor, such as a camera, an optical sensor, a microwave sensor or an acoustic sensor to detect movement in the vicinity of the whole home water appliance system, such as in the room or space where the whole home water appliance system is installed. The motion sensor may penetrate the shroud 418 to enable detection of motion. The motion detector 2312 may output a signal indicative of a detected motion to the controller circuitry. The controller circuitry may, in response to the detection of motion, may, for example, illuminate the display, generate audible alarms, illuminate indicators 2314, such as light emitting diode (LED) indicators and/or perform other visual indications due to a user being present. In an example system, the whole home water appliance system may optionally also include LED lighting within the structural frame which is illuminated upon motion being detected. The LED lighting may provide illumination inside the shroud 418 and the sump pit for inspection and maintenance. Although not illustrated, the electronic enclosure 420 may also include other electronics and equipment, such as the level sensors, the pressure sensor, humidity sensors, motion detectors, power quality sensors, natural gas sensors, CO2 sensors, temperature sensors, audio sensors, motor ampere sensors, radon sensors, and other sensors and indications related to the whole home water appliance system. The WHWA may be configured as an internet connected device via the communication circuitry and/or the I/O circuitry, and as such can operate in a variety of mash-ups with $3^{rd}$ party cloud based application programming interfaces (APIs). For example, monitoring the local weather, and then automatically testing all systems before weather strikes. In another example, the homeowner, via the local graphic display or phone app, can order an online water quality test where the WHWA will accept credit card payment, and then the homeowner is shipped a water test kit to test for lead and other water contaminants in their drinking water.

Figure 24:
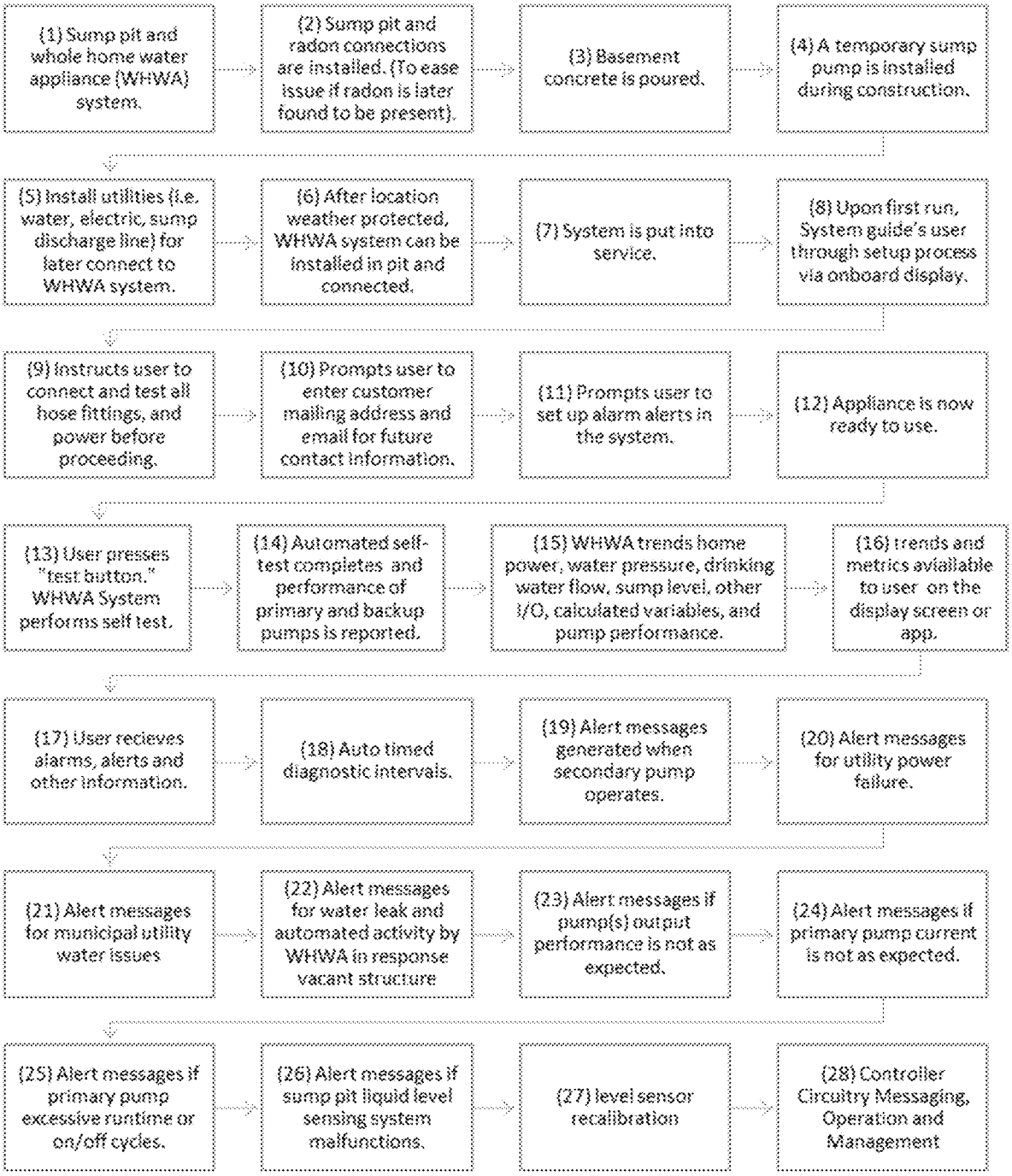
FIG. 24 is a block diagram illustrating an example of installation and operation of the whole home water appliance.

FIG. 24 is a block diagram illustrating an example of installation and operation of the whole home water appliance.

Sequence of Operation

Referring to FIG. 24, in an example sequence of steps to install and operate an example whole home water appliance system for a residential home installation:

1. Sump pit and whole home water appliance (WHWA) system provided to builder erecting a new structure such as a home that includes a basement.
2. New home builder installs empty sump pit in desired location. Radon connections are also installed in proper location since this piping is typically installed in the concrete. WHWA may include connection in the system for radon pipe/fan (if radon equipment supplied), to ease issue of addressing radon if found to be present.
3. Basement concrete is poured.
4. During basement concrete pouring, and early construction, it is common that a builder will install a temporary "used" sump pump (during early construction) as the sump pit can collect debris and damage a new pump. This process will not change with the whole home water appliance system, and the WHWA is installed after rough construction is complete, and is typically installed when other home appliances are installed.
5. New home builder may install utilities (municipal water supply and electricity) and run sump discharge common outlet line to sump pit location where whole home water appliance will be positioned. Where the connection quick disconnect station is included, utilities and common outlet can be connected thereto.
6. When roof is on the home, or the location of the WHWA is otherwise weather protected, the whole home protection appliance system can be inserted into the sump pit, and the utility and common outlet connections completed.
7. Put system into service by powering up and turning on municipal water supply.
8. Once the system is powered up, instructions on face of appliance local color graphic display prompt installer to start up appliance and guide the installer through the setup process.
9. Local color display instructs installer to connect and test all hose fittings, and power before proceeding.
10. Next, the system prompts for entry of contact information on the display. The local display may instruct to download one or more applications, such as a sump control phone application and accompanying API. Alternatively, or in addition, the user may enter a customer mailing address and email address into the local display for future contact information. In an example, The WHWA may be, for example, sold with 2 years of prepaid cellular service, and after 2 years the homeowner is automatically notified regarding how to pay for and extend service. In this example, the user will merely enter his address, contact, and credit card information on the face of the appliance, and it is digitally sent to a registrar (i.e. a back-end billing and product management platform), via an API, to auto activate/extend cellular service. In an alternative example, a user may launch a phone app on the user's mobile device. The phone app may open to "first time setup screen" where credit card info is entered into app to enable device. Data is connected to Registrar API and card processed and account established in Registrar. Cellular service may now be ready to use
11. The local display or the App may prompt user how to set up alarm alerts within appliance system.
12. Appliance is now ready to use.
13. User presses test button on app or the appliance. WHWA performs automated diagnostic self-test. Diagnostic test includes the controller circuitry energizing the level test actuator to fill the sump with water from the municipal water supply. In an example test, the controller circuit times the drawdown and amps on the primary pump running alone. Pit is auto refilled, and system now times drawdown time on secondary, or backup water pump. Gallon per minute (GPMs) may be calculated for both pumps and compared to predetermined information, such as original equipment manufacture (OEM) pump curve, along with amp data.
14. WHWA reports status and results of diagnostic tests. Text message(s) may be issued stating pumps either passed/failed pump volumetric tests. The text messages may also include statistics, and state what is next. Data may be dynamically stored for trending.

15. WHWA generates trends. Some example trends, reports and information generated may include appliance auto trend logs home power, water pressure, drinking water flow, sump level, and/or any other salient I/O and calculated variables on an I/O list stored in the system and accessible by a user.
16. User can look at app or display at any time to see latest operation of entire system including domestic water usage and pressure, and any other operational parameter.
17. User may get alerts, alarms and/or other system related information messages, such as text messages. For example, user may get an alarm if calcium chloride pouches need to be reordered. A link in a text message received by the user may be executed, such as to reorder filters on a retailer website, such as AMAZON™, with one click. Calcium chloride air intake fan may operate continuously, or intermittently on a predefined schedule, and user may have remote ability to turn on-off or modify predefined schedule with mobile device. A dehumidification sensor, such as a Hall effect sensor, pressure sensor, force sensitive resistor, strain gage and/or optical LED sensor pair may monitor the calcium chloride tray, such as by dynamically monitoring, weighing or otherwise tracking an amount remaining of the active calcium chloride so that a user may be alerted when calcium chloride has been depleted and in ready for refill.
18. System may perform auto timed diagnostic intervals, such as once/month or some other set interval or user or system derived interval. Diagnostics may be automatically performed by the controller circuitry at regular intervals, during low-service times (i.e. once/month), system automatically performs self-test and reports.

At the conclusion of the interval, the system may perform maintenance and upkeep activities, such as recalibrate water level measurement sensors, perform pump volumetric water pumping tests, confirm calcium chloride levels are adequate, and the like. In addition, the system may issue one or more user reports, such as during low service times. (i.e. when it is not raining or the system is otherwise experiencing dynamic inflow of water to the sump pit).
19. WHWA may generate a message whenever secondary pump is operated using the municipal water supply. For example, if water powered backup pump cycles for any reason, the user is alerted—except for the auto self-test. For example, if the primary pump fails for any reason, the water level measurement devices in the sump pit liquid level sensing system, such as the hydraulic float switch, may detect the high level and the controller circuitry may auto cycle the secondary water pump to maintain water level. In addition, the user may be alerted via local and text message alerts. For example, in extremely high flow of liquid to the sump pit, both pumps may be started for boost mode operation in order to pump at higher rate than either pump could pump individually
20. If utility AC power supply fails, user may be alerted and water pump may control level using secondary water pump, or any other back up pump not energized by AC power. In another example, upon AC power failure, user is alerted and automatically system controls water level via 100% mechanical water-powered backup system using the secondary pump.
21. WHWA generates alarms if municipal water supply has issues. For example, if pressure drops low, user is alerted and advised what to do.
22. If the system detects a leak the user is alerted. If no customer response, home drinking water is shut off and user alerted.

For example, if the WHWA determines user is not home, such as by an input from a connection to a home security system or motion detector, the flow meter may be enabled to detect leaks, and customer may be alerted. If no customer response, then home drinking water is shut off, and user may be alerted. In alternative examples, the user may indicate they are not home, or the system may detect that no one is home based on water flow parameters or other input parameters from external devices, such as a garage door opener.

In another example, if the system monitors the flow meter and detects a leak, detected by, for example, onboard AI software executed by the controller circuitry, the user may be alerted. If no customer response, then the controller circuitry may shut off the home drinking water, and the user may be alerted.
23. Pump output performance monitored by controller circuitry and performance anomalies generate alarm messages. For example, if pump(s) are determined to not be pumping at predetermined GPM, such as rated GPM, user is alerted and instructed how to proceed. In another example, if the system determines that pump(s) are not pumping at rated GPM (as calculated by timed drawdown tests) then user may be alerted to possible line blockage and given instructions "how to proceed".
24. If system determines that primary pump amps are not normal (as compared to nameplate rating, or historical operation) then user may be alerted to possible line blockage or pump issue, and given instructions "how to proceed".
25. If system determines that primary pump has excessive runtime or on/off cycles, user is alerted, and told how to proceed.
26. If system determines the level measurements, such as the sensor-less pump control or the laser pump control has stopped working or is otherwise not accurate, user is alerted, and backup floats, such as the dual back-up float switches and the hydraulic float switches may be used by the system to control on/off of both primary and secondary pumps. In another example, if analog laser level stops working, user is alerted, and backup floats control on/off of primary pump.
27. The system may operate to "reset" or recalibrate the sump pump level measurements according to operational parameter, such as a run time interval, once every predetermined number of pump cycles, such as 10 cycles, or any other varying parameter. The system may dynamically and automatically "reset" or recalibrate the sump pump level measurements by drawing down the water level in the sump pit. With the sensorless pump control, the liquid level in the sump pit is drawn down below the bottom of the sensing tube, and allow air to be re-trapped at zero level. In the laser pump control, the liquid in the sump pit may be drawn down until the float rests against the stop and the TOF sensor(s) may be recalibrated. User may be alerted to any recalibration issues with alert messages. The system may perform automatic testing of high level float switches during an auto test by filling sump pit to level of floats and confirming that the floats actuated. Auto test may be performed on a predetermined schedule, during times of quiescence, or based on any other trigger. If floats are not actuated, or test otherwise fails, customer may be alerted, and instructed what to do next.

28. The controller circuitry may provide local messages via the display and/or generate messages such as text messages to a user with contact information stored in the WHWA. In addition, the controller circuitry may take corrective actions or preventative actions to avoid issues. Examples of such actions by the controller circuitry include:
    a. The controller circuitry may avoid water hammer by controlling on/off ball valves to open/close slowly (such as for example, travel between open and close in about 2 seconds)
    b. The controller circuitry may generate a message on the display screen and or generate a message providing contact information for service help. Alternatively, or in addition, the controller circuitry may initiate an application, such as a phone app which may include a local screen having contact data for service help.
    c. A local screen on the whole home water appliance and/or the phone app may be synched by the controller circuitry to share system data, trend logs, user configured data, and other useful data. The screen may be designed and constructed such that a novice can navigate the menu without a user's manual.
    d. If any alarm is present in the system, the controller circuitry may initiate a backlight of the LCD color display to illuminate and flash with a predetermined color, such as red, so a user can easily see the alarm backlight in a dark basement. If all systems are normal, and no alarms are present, the LCD display may include an operational backlight, such as a green glow, to indicate no abnormalities have been detected in the system.
    e. In an example, if the customers wireless service expires, or is ready to expire, the user may get a text message initiated by the controller circuitry indicating a subscription lapse, and instruction to re-subscribe from the face of the WHWA LCD screen. The backlight color of the screen may be, for example, a "red" color if wireless service has elapsed. The user may be prompted via the LCD screen to enter credit card information into the appliance system to re-institute the wireless service. The credit card info may be securely transmitted to a registrar via API, and a "success" or "fail" message may be sent to the customer via text message from the WHWA indicating the credit card transaction status. In an example, the system may include a credit card reader embedded in the system such as in a face of the appliance to enable a credit card transaction without user data entry. In another example, the user may initiate a credit card payment, or a bill payment service, such as PAYPAL from an application on the user's wireless device or at a website provided in a text message.
    f. In another example, wireless text notifications may be optional. If users opts to not get remote text notifications, the WHWA may otherwise include all the functionality described herein, and the local LCD display can be used for system information and user interaction with the system. For example, with the wireless text notifications disabled, when an event occurs, such as a lapse wireless service, a local piezo buzzer can sound to indicate a system alarm, and the homeowner may manual disable in the user interface, such as by pressing an LCD screen acknowledge button to silence the alert.
    g. The controller circuitry may determine when wireless service is expiring (first 2 years free), the user is alerted, and instructions are provided to re-subscribe from the face of the system display screen.

Referring again to FIGS. 22 and 23, in an example system, the input/output (I/O) circuitry 2218 may be hardware implemented as an independent device capable of executing logic, such as a programmable logic controller (PLC). The PLC may be positioned in the electronic enclosure 420. Alternatively, or in addition, the I/O circuitry 2218 may be hardware, such as a printed circuit board included in the electronic enclosure 420, that is administered and controlled by the controller circuitry and/or be included in the controller circuitry. The I/O may include analog and digital inputs and outputs. In addition, signal conversion capability, such as analog to digital or digital to analog, buffering, communication protocol conversion, and the like may also be included as part of the functionality of the I/O circuitry 2218. In an example, the I/O circuitry 2218 in the system may include terminations in the form of:

DIGITAL INPUTS (Dry Contact Inputs)
1. Domestic water flow meter, such as a high speed pulse output flow meter
2. High level back-up float #1
3. High level back-up float #2
4. Home security system is armed (connect to home security system if present)
5. Input detecting enclosure door is opened, linked to turn on sump light Digital Outputs
1. output to drive open/close level test actuator for whole home shutoff
2. output to drive open/close water valve for sump water fill
3. Primary pedestal pump on/off
4. Calcium chloride air intake fan on/off
5. Whole home water appliance is in "away" mode (connect to home security system if present)
6. Output to turn on/off LED light to illuminate sump during service/inspection/door open Analog Inputs
1. Pedestal pump amps
2. Tank analog level (laser 1) [I2C bus #1]
3. Tank analog level (laser 2) [I2C bus #2]
4. Strain gage for weight of calcium chloride tray
5. Home water pressure Analog Outputs
1. The WHWA may include an optional expansion card slot where an optional analog output card may be inserted to provide predetermined range(s) of analogy outputs. For example, the analog output card may include an adjustable 0-10 VDC, or 4-20 mA output signal(s) to drive any device operating from an adjustable 0-10 VDC or 4-20 mA signal.

The controller circuitry 2204 may operate, control and monitor the functionality of the whole home water appliance system described herein. The controller circuitry 2204 may be the heart of a "product platform" strategy, on which several variations in functionality of the whole home water appliance system may be based, as described herein. In an example, the controller circuitry may include several inputs and outputs of various types that are used to monitor and control equipment. I/O may, for example, leave I/O circuitry, such as a PCB, through a set of two connectors—a low voltage harness and a high voltage harness. The controller circuitry may include several communication buses, which are exposed outside the system via ports or connectors to allow for connection/communication with third-party devices. The controller circuitry may be powered from a power source such as a DC or an AC power source and may include a battery backup. In an example, the controller circuitry may be powered by DC power provided from a backup battery, such as a Li-Ion backup battery, and charger.

Wireless connectivity may be provided by the communication circuitry 2214 using a modular radio wireless communication interface. The initial connectivity of the modular radio wireless communication interface may be provided by a cellular module. The cellular module may be hosted on a circuit board. The user interface 2210 may include a display, such as a color liquid crystal display (LCD). In an example, the display be about 4" in size, include a touch screen interface, and include an array of LEDs for general purpose use as indicators.

The controller circuitry 2204, may include any hardware device(s) capable of executing logic or software. In an example, the controller circuitry may include a microcontroller from the NXP Kinetis™ family of microcontrollers, such as a K7x™ series microcontroller. The controller circuitry may include memory such as at least 128 KB Ram, 1 MB flash. The system may also include fast external memory for graphics, data, and log storage, of at least 128 MB in size that is external to the controller circuitry but included in the whole home water appliance system. The system may also include a removable memory storage capability, such as a port or other form of connection for receiving an external memory, such as a MicroSD card upon which data and other information may be stored.

In addition, and/or as part of the controller circuitry, included within the operational functionality of the whole home water appliance may be user interface circuitry, power system circuitry and I/O circuitry as previously discussed.

Examples of hardware to perform the operational functionality include:

User Interface Circuitry:
4" color LCD with touchscreen
Touchscreen may be capacitive or resistive
At least 4 red/green LEDs for general purpose status indication
Buttons in a "softkey" configuration around LCD
Power System Circuitry:
12 VDC primary power+/−10%
Li-Ion battery, sized to provide at least 6 hours of runtime
Li-Ion charger with typical safety features
Primary power and battery may be in the same harness, and may be separate from I/O harnesses
Regulator providing power to system may provide 3.8 VDC at 2A, and a fast transient response
I/O Circuitry—Dry Contact Inputs:
Each input to accept a contact closure or open collector output as a signal
At least 3 of the inputs may accept pulses up to 10 KHz
Each input set may consist of the following signals: 12 VDC, Ground, Signal
ESD protection including optical isolation, isolated ground systems, surge suppression devices and the like
Overvoltage protection in the form of diodes and capacitors
May be routed through the low voltage harness
I/O Circuitry—Analog Inputs:
Each input may accept a 4-20 mA signal, or 0-10 vdc, or other variable low voltage signal
At least 12-bit analog-to-digital (ADC) resolution
ESD protection
Reverse and over voltage protection
Each input set may consist of the following signal: 12 VDC, Ground, Signal, Return
May be routed through the low voltage harness
I/O Circuitry—Open Collector Outputs:
Each output to provide at least 2 A of current with a 12 VDC source
Each output may operate in current sink mode or a current source mode.
At least 2 outputs may provide pulse width modulation (PWM) circuitry up to 80 kHz
I/O Circuitry—Relay Outputs:
Each relay may be rated for at least 240 VAC at 20 A, and may be a relay type such as an appliance type relay
Each contact output set may consist of the following signals: C, NO, NC
May be routed through the high voltage harness
relay output circuits may measure the AC current flowing through the respective relay
A current sensor may be used to measure between 0.1 Amps and 12 Amps with at least 12 bit ADC resolution
I/O Circuitry—USB Bus:
Multiple mini USB connectors present
May serve as a device, not host
I/O Circuitry—Ethernet:
May include network communication circuitry in the form of, for example, 100 Mbit Ethernet with standard RJ45 jack
I/O Circuitry—Rs232:
May include a standard RS232 with DB9 port
Does not need flow control lines
I/O Circuitry—CAN Bus:
CAN bus may be routed to external devices through an RJ11 jack
Provide 12 VDC and Ground are provided. In some examples, provided externally via RJ11 jack
ESD protection
I/O Circuitry—External I2C Bus:
May include two independent packet switched communication busses, such as I2C busses
Each bus may be routed to external devices through RJ45 jacks
Each connector providing communication to external devices may include various protocols and/or signals, such as a serial data line (SDA), signal clock lines (SCL), 12 VDC, Ground, and the like
Signals may be communicated via signal bus or via twisted pair.
Communication Circuitry:
Short range radio circuitry
WiFi circuitry
Satellite communication circuitry
Cellular communication circuitry The operational functionality may also include the following features:

Electronics enclosure may be sized at about 8"×8", or as smaller to minimize footprint. In other examples, other sizes are possible.

Surface mounted printed circuit board(s) (PCB) disposed in the electronic functionality enclosure Functionality and components positioned on a front surface of the PCB may include user interface circuitry such as a liquid crystal display (LCD), buttons, and LEDs Functionality and components positioned on a rear surface of the PCB may include bus connectors and card slots, such as an SD card slot. In an example, bus connectors and card slot(s) may be positioned on a rear surface of board along an edge of the PCB in a right angle orientation to a planar surface of the PCB Power and I/O harness connectors may be position on a rear surface of the PCB in a perpendicular orientation to a planar surface of the PCB The circuitry for operational functionality related to the communication circuitry may be near a top edge of the PCB so an antenna may clear the PCB and an external SMA connector is accessible.

Figure 25:
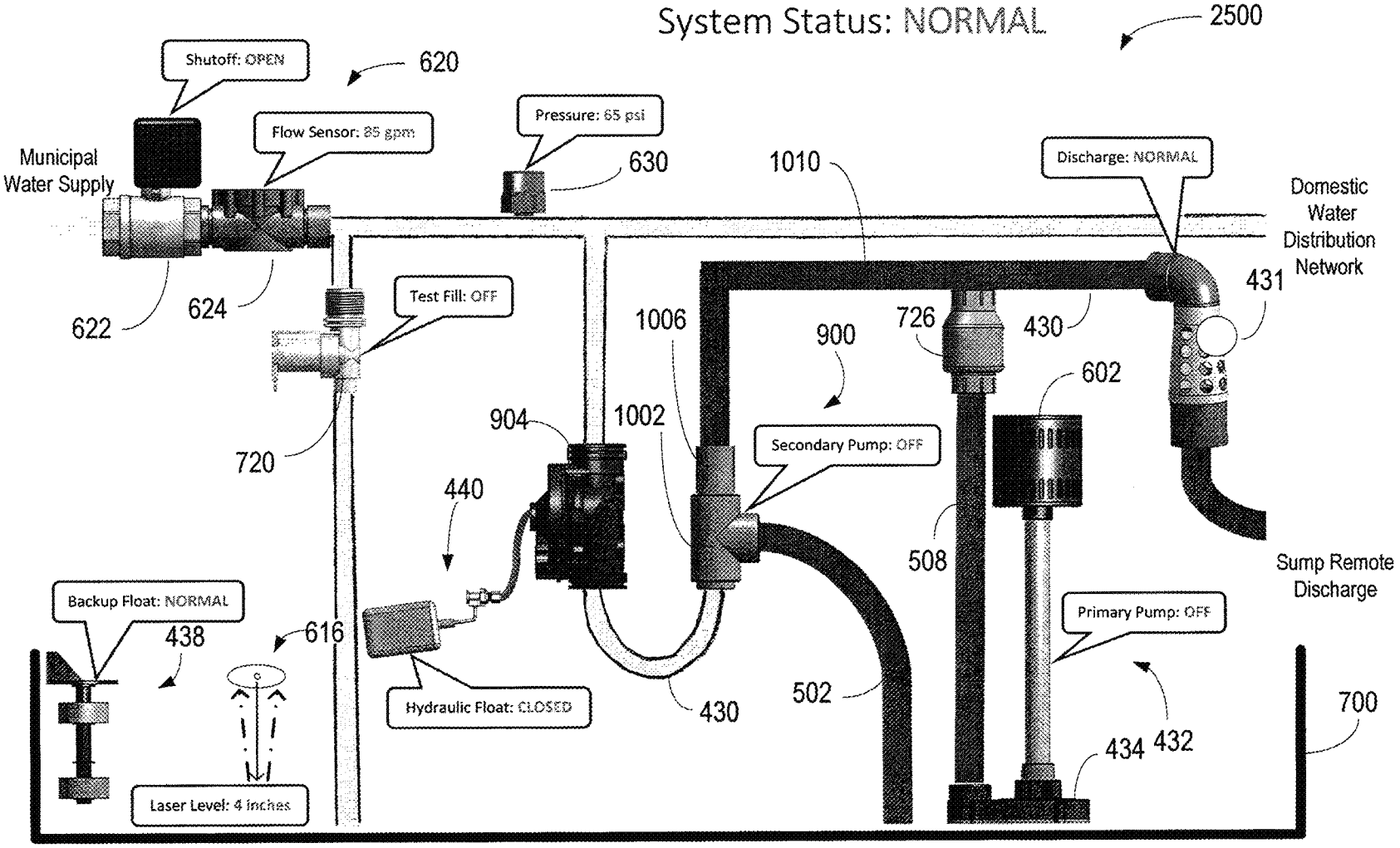
FIG. 25 is an example graphical user interface status screen for the whole home water appliance system.

Access panel or door for easy access to change PCB or other circuitry related to operational functionality in field by customer PCB mounted in enclosure FIG. 25 is an example graphical user interface status screen 2500 for the whole home water appliance system. The illustrated status screen is an example of process flow diagram of the system that dynamically provides operational parameters associated with the various elements of the system. The status screen also illustrates a municipal water supply side of the system (lightly shaded lines in the example of FIG. 25) within which the municipal water supply flows, and a sump pit discharge side of the system (darkly shade lines in the example of FIG. 25) in which liquid extracted from the sump pit 700 flows. The status screen 2500, as well as the rest of the GUI screens described herein may be viewed and manipulated on the display 422 of the system, in an app executing on a mobile phone and communicating with the system for data and information, and/or a personal computer or tablet via a web browser.

Within the municipal water supply side, the municipal water supply is provided to the water control actuator 622 and the flow meter 624 of the smart water meter/shutoff valve 620, and a position of the water control actuator 622 and a flow rate of the municipal water is indicated in the status screen 2500. In addition, a pressure of the municipal water flow provided to the domestic water distribution network, which is sensed with the pressure sensor 630, and the position of the level test actuator 720 are also dynamically indicated in the status screen 2500.

The position of the hydraulic level sensor 440 and the operational status of the secondary pump 900, which includes the hydraulic valve 904 in the municipal water supply side, as well as the check valve 726, and merge pipe fitting 1010 on the sump pit discharge side, are also dynamically provided. In the sump pit discharge side of the system, the status of the primary pump 432, which includes the impeller 434 and the motor 602, and the status of the common outlet discharge as provided by the emergency bypass sensor 431 is also dynamically provided in the status screen 2500. Also, the primary level sensor, which is the laser pump control provided by the TOF sensor 616 and the backup float sensor provided by the dual float sensor 438 from the sump pump discharge side are also dynamically indicated. An overall status of the whole house water appliance system is also provided by a dynamically changing system status indication 2502.

Figure 26:
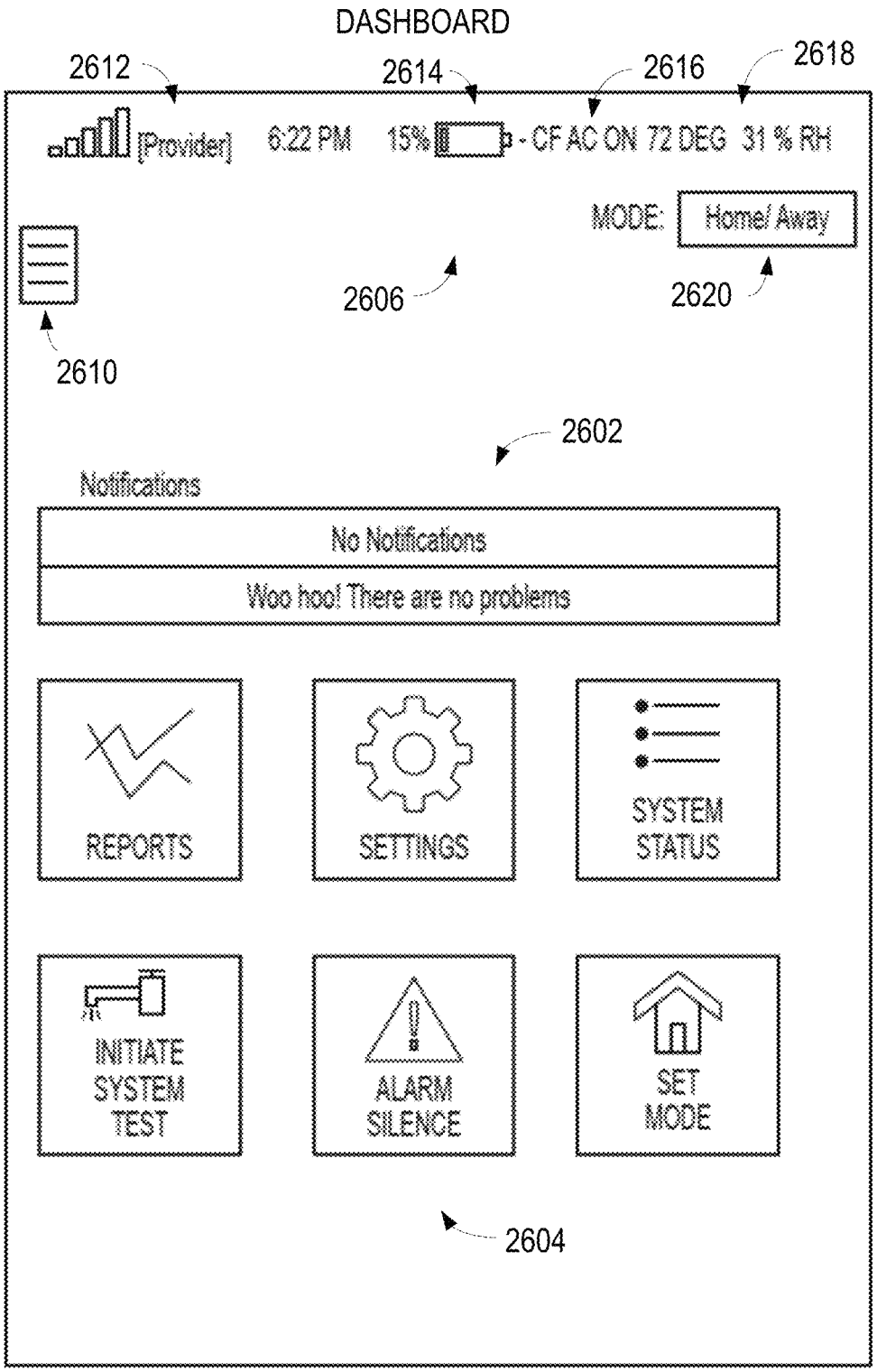
FIG. 26 is a graphical user interface screen of an example dashboard screen for the whole home water appliance system.

FIG. 26 is a graphical user interface screen of an example dashboard screen 2600 for the whole home water appliance system. The illustrated dashboard screen 2600 includes a notification section 2602, a menu section 2604 and a dynamic summary section 2606. The notification section 2602 may provide alarms and status indications, as well as other information. In example configurations, the notifications may also include advertising, upgrades and other information that is targeted at the specific user of the system.

The menu section 2604 may include icons for different subject matter sections or information related to the whole home water appliance system. In the illustrated example, the menu selections include a reports selection, a settings selection, a system status selection, an initiate system test selection, an alarm silence selection and a set mode selection.

The dynamic summary section 2606 provides select current information for the whole home water appliance system, such as alarms, status, reminders, and notices. The dynamic summary section 2606 may be included on all graphic screens in the system by default unless omitted by user selection of omission. Also, the dynamic summary section 2606 may be customized by the user to display selected operational parameters using a pull down list of available operational parameters for display.

In the illustrated example, the dynamic summary section 2606 includes a menu pull down 2610, and a cellular, satellite, or Wi-Fi signal strength indicator and wireless service provider name 2612. In addition, the dynamic summary section 2606 of this example includes a battery life indication 2614 of a backup battery for the system, a utility power indicator 2616 indicating that AC power is being supplied to the system, and environmental conditions 2618 at the location of the whole home water appliance system, such as the temperature and relative humidity in the basement or crawl space where the sump pit is located. Further, the dynamic summary section 2606 of this example includes a mode indication 2620 indicating whether the system is in home mode or away mode based on an input from an external system, a user entered indication, or water flow detected in the domestic water distribution network. In other examples, other operational parameters may be displayed in the dynamic summary section as selected by a user.

Figure 27:
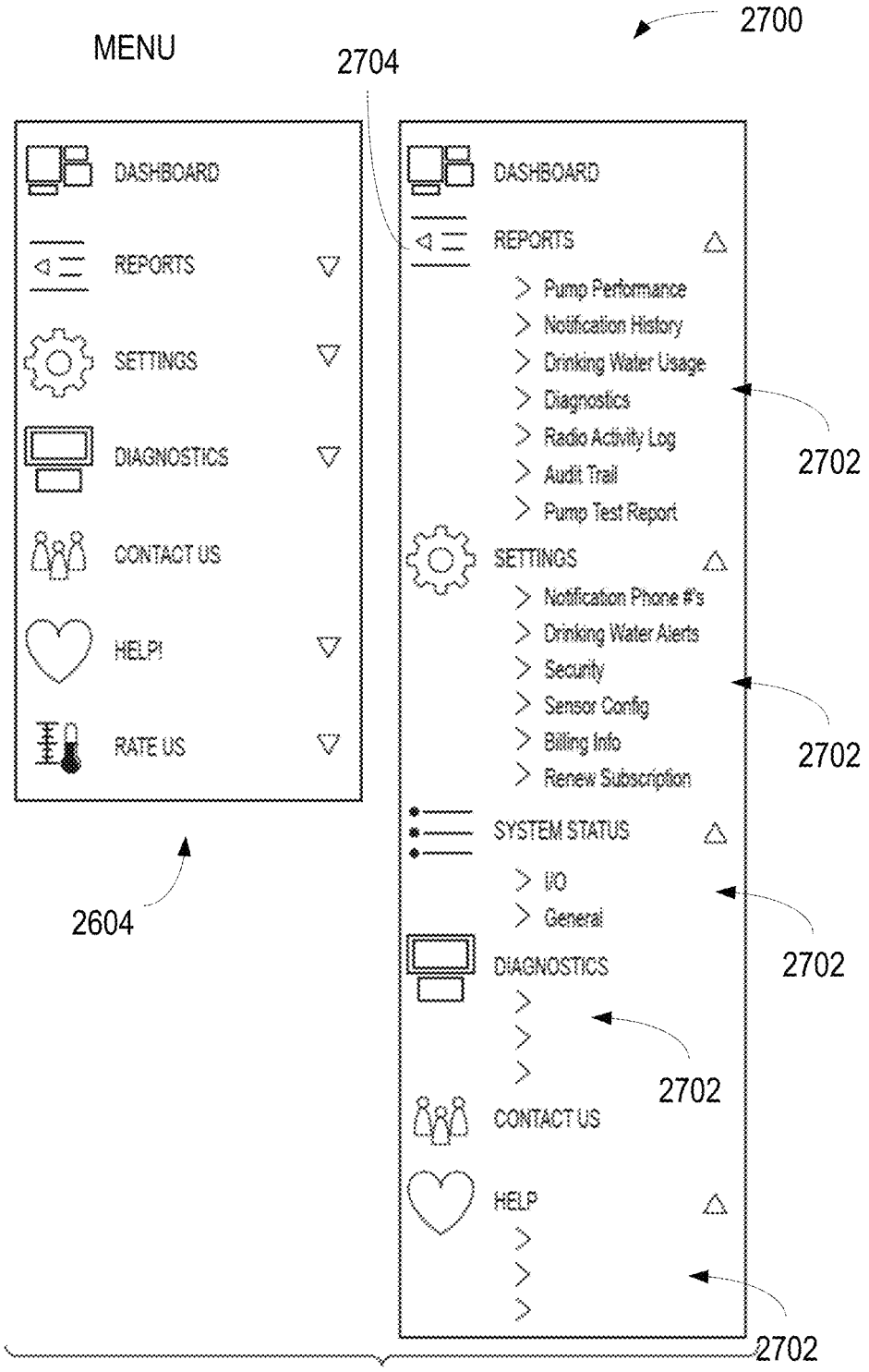
FIG. 27 is an example menu screen illustrating example sub menu items within the menu selections of menu section shown in FIG. 26.

FIG. 27 is an example menu screen 2700 illustrating example sub menu items 2702 within the menu selections of menu section 2604 in FIG. 26. The list of sub menu items 2702 may be pull downs under each menu section 2604. Each sub menu item 2702 may be a link to a graphics screen within the whole home water system.

In addition to preconfigured sub menu items 2702, a user may add additional graphic screens, such as different report screens as new sub menu items 2702 to customize the system. For example, using a new reports menu pull down 2704 and selecting a report type from a predetermined list of types of reports a user may create and save new reports showing parameters of interest. Different report types may have different predetermined information display locations and formats and provide different functionality and user interaction. Types of reports may include, for example, trend reports, status reports, and the like. Upon selection of a report type, the user is prompted to name the new report and select operational parameters for display in a report screen of the selected report type. Operational parameters may include signal values received via the I/O circuitry and calculated values determined by the controller circuitry. The user may also add tabs to a new report by selection of an add tab menu item. Upon adding a new tab, the user is prompted to name the tab and use pull down menus to add operational parameters in the report screen for that tab of the report type.

As illustrated in the sub menu items 2702, any number of different reports may be present in the system. For example, the system may include a pump performance report, a notification history report, a drinking water usage report, a diagnostic report, a communications circuitry (radio) activity log report, an audit trail report and a pump test report. In other examples any other reports may be included since the reports in the system are configurable by a user to display any combination of operational parameters.

Figure 28:
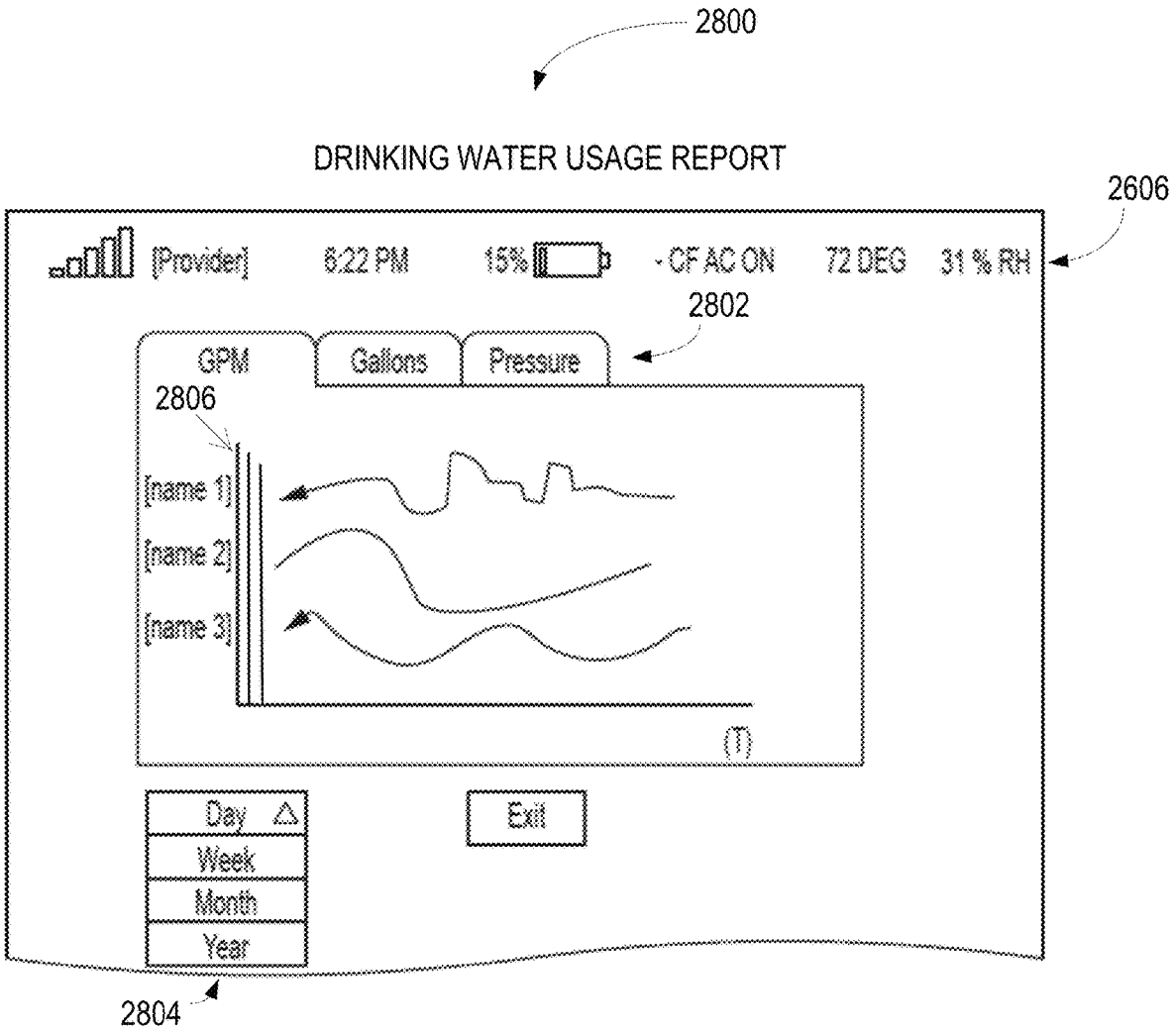
FIG. 28 is an example of a user configurable trend graph report for drinking water usage related operational parameters.

FIG. 28 is an example of a user configurable trend graph report 2800 for drinking water usage related operational parameters. The user configurable trend graph report 2800 is a report type that may be accessed by user selection of a piece of equipment, such as primary pump 432 from the status screen 2500, or from the menu 2700.

Upon selection, a corresponding dynamically trending graphic is displayed as the trend graph report 2800. The report type format of the trend graph report 2800 includes a number of name selections along the Y-axis which are identified as Name 1, Name 2 and Name 3 in the example of FIG. 28. When creating a new trend graph report, or modifying an existing trend graph report, a user may select one of the name selections, which will bring up a pull down list of available measured and calculated process related parameters in the system. The user may select an operational variable, such as a pressure, a temperature or a flow rate from the pull down list. Following selection by the user, the selected operational parameter is visually provided over time (T) of the x-axis on the trending graphic. The user may also select a pen color for each dynamically trending operational parameter selected for display in the trend graph report 2800. There may be a number of trending report tabs 2802 for different types of operational parameters. In the example of FIG. 28, trending report tabs for GPM, total gallons and pressure are provided.

The trend graph report 2800 may also have a user selection capability for dynamically selecting a trend period from a trend period selection 2804, which may be in the form of a drop down menu. The drop down menu may include selectable trend periods, such as a day, a week, a month or a year, as illustrated in FIG. 28.

A user may configure and store any number of user configurable trend graph reports 2800 in the system in association with system parameters and corresponding system equipment/elements. A trending graphic report 2800 may be configured and saved by the user in association with a graphic of a particular piece of equipment/element or elements, such that selection of the graphic of the equipment/element or elements brings up the trending graphic associated therewith. Association may be performed by the user entering an association mode from a report type, selecting an association action, and navigating to the particular graphic in a particular display screen. By the user clicking on the graphic in one or more different particular display screens, the system stores the association such that future clicks on the graphic will change the view to the associate trending graphic report 2800.

As the user creates a new trending graphic report 2800, the user may select additional operational parameters. Following selection, the system may automatically adjust the scaling of the operational parameters to maintain correspondence in the trending graphic report 2800 between different operational parameters being trended in the same graphic trend. For example, a trend graph report for drinking water usage may be configured by user selection of a trending pressure between 0 and 40 psi as Name 1, and a flow between of 0 and 120 GPM may be selected as Name 2, and a trending temperature between −25 and 110 degrees Fahrenheit may be selected as Name 3. Due to automated scaling by the controller circuitry, coherency of the trend graph report may be maintained and parameters with significantly different scaling can be auto correlated and displayed over time (T) in the user selected trend period 2804.

Automated scaling by the controller circuitry may be based on, for example, the level of variability of the operational parameter selected for display within the selected trend period range 2804. Upon selection of a trend period 2804, the controller circuitry may dynamically perform a review of the maximum and minimum operational parameter actual values based on the trend period selected. Based on the actual values in the selected trend period range, scaling of operational parameters may be automatically performed. In addition, the controller circuitry may compare the range of each of the user selected operational parameters and correspondingly scale the displayed operational parameters accordingly so that the trend lines shown are intuitively comparable by the user.

For example, in a trend period selection 2804 of one day, the variability of the operational parameters may be lower resulting in a more granular dynamic scale selection by the controller circuitry for each selected parameter, such as 38 to 42 psi for Name 1, 30 to 50 GPM for Name 2, 60 to 75 degrees F. for Name 3. In another example with a trend period selection 2804 of one year, the variability of the operational parameters may be significantly higher resulting in a more course scale for each selected parameter, such as 0 to 75 psi for Name 1, 0 to 150 GPM for Name 2, and −15 to +115 degrees for Name 3. In either case, the vertical axis of the chart will contain a number of vertical scales 2806, such as three, which correspond to the three different variable ranges. These vertical scales 2806 are represented in three distinct, different colors, that correspond to the colors of the corresponding charted variable colors. Thus allowing a novice to plot three different variables, of different scales, onto a single graph, and see how the variables interact on the same time scale without the need to manually compare separate charts to each other.

Figure 29:
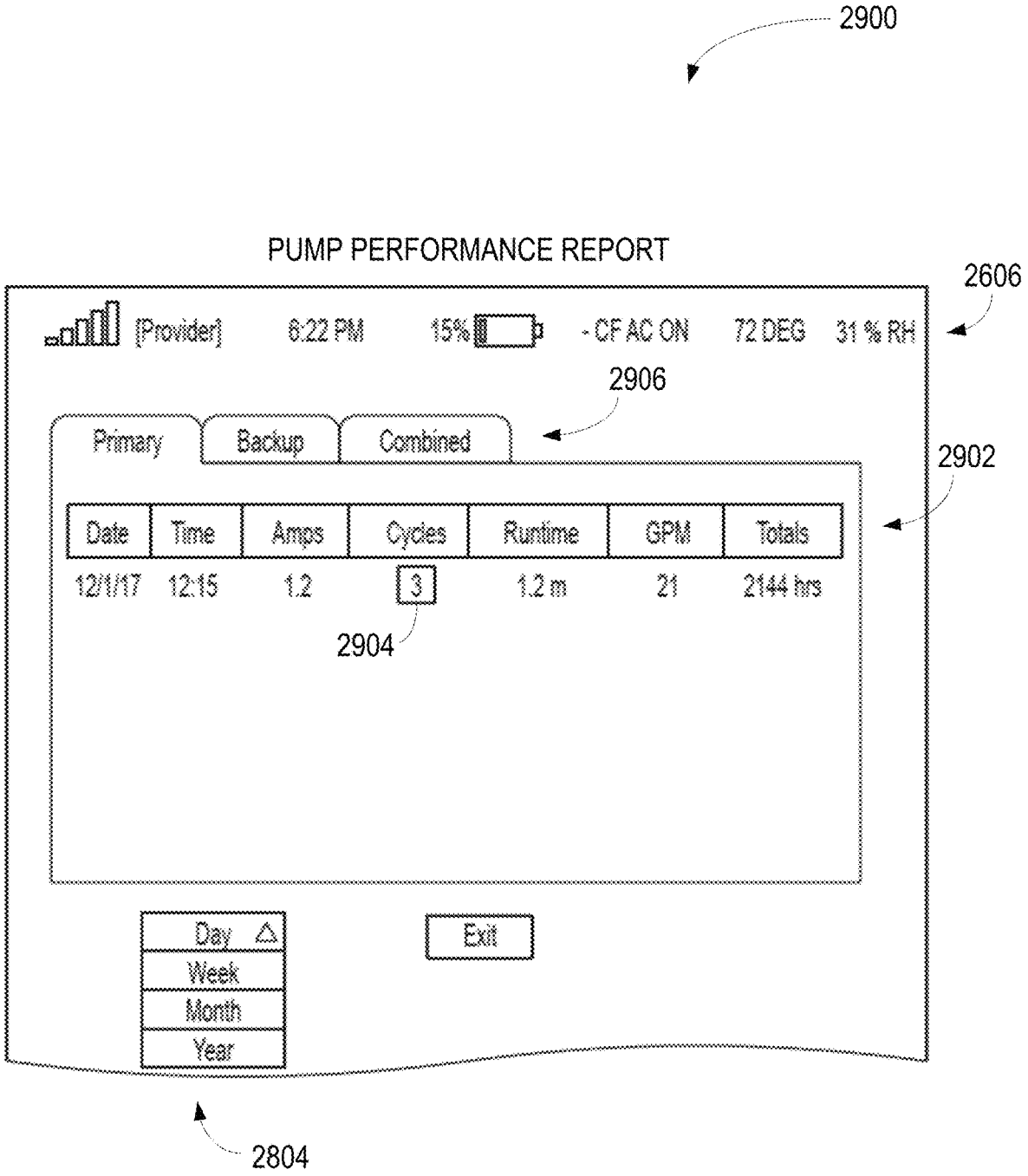
FIG. 29 is an example of a user configurable stats report for pump performance related process parameters.

FIG. 29 is an example of a user configurable stats report 2900 for pump performance related process parameters. The user configurable stats report 2800 may be accessed by user selection of a piece of equipment, such as secondary pump 900 from the status screen 2500, or from the menu 2700.

Upon selection, a corresponding stats report screen graphic is displayed as the stats report 2900 that includes a number of operational parameter columns 2902, which are identified as date, time, amps, cycles, etc. along the top of the screen in the example of FIG. 29. When creating or modifying a stats report 2900, a user may select one of the operational parameter columns 2902, which will provide a pull down list of available measured and calculated process related parameters in the system available for the stats report. The user may select an operational variable, such as runtime, GPM, and the like from the pull down list. Following selection by the user, the selected operational parameter is visually provided in the corresponding operational parameter column 2902. The user may use the default description of the operational parameter in the operational parameter column 2902, or may create a custom description of the selected operational parameter.

Operational parameters displayed in the stats report 2900 may dynamically update during operation of the system. In addition, status and alarming may be dynamically provided by visual changes of the displayed operational parameters. For example, in the example stats screen 2900 of FIG. 29, number of cycles is highlighted in a box 2904 and a color of the text of the operational parameter may be changed from green to red to indicate an alarm condition due to, for example, a number of cycles of the primary pump above a predetermined threshold within a predetermined time period. In another examples, total hours of operation may be similarly highlighted and changed to yellow to indicate maintenance on the primary pump should be completed.

User selectable equipment tabs 2906 may also be included in the stats report 2900 for different pieces of equipment in the whole home water appliance system. In FIG. 29, a tab for the primary pump, a tab for the backup or secondary pump, and a tab for the combination of the primary and the backup pump are indicated. Each tab may include corresponding operational parameter columns 2902 with operational parameters selectable by the user from pull down lists.

Figure 30:
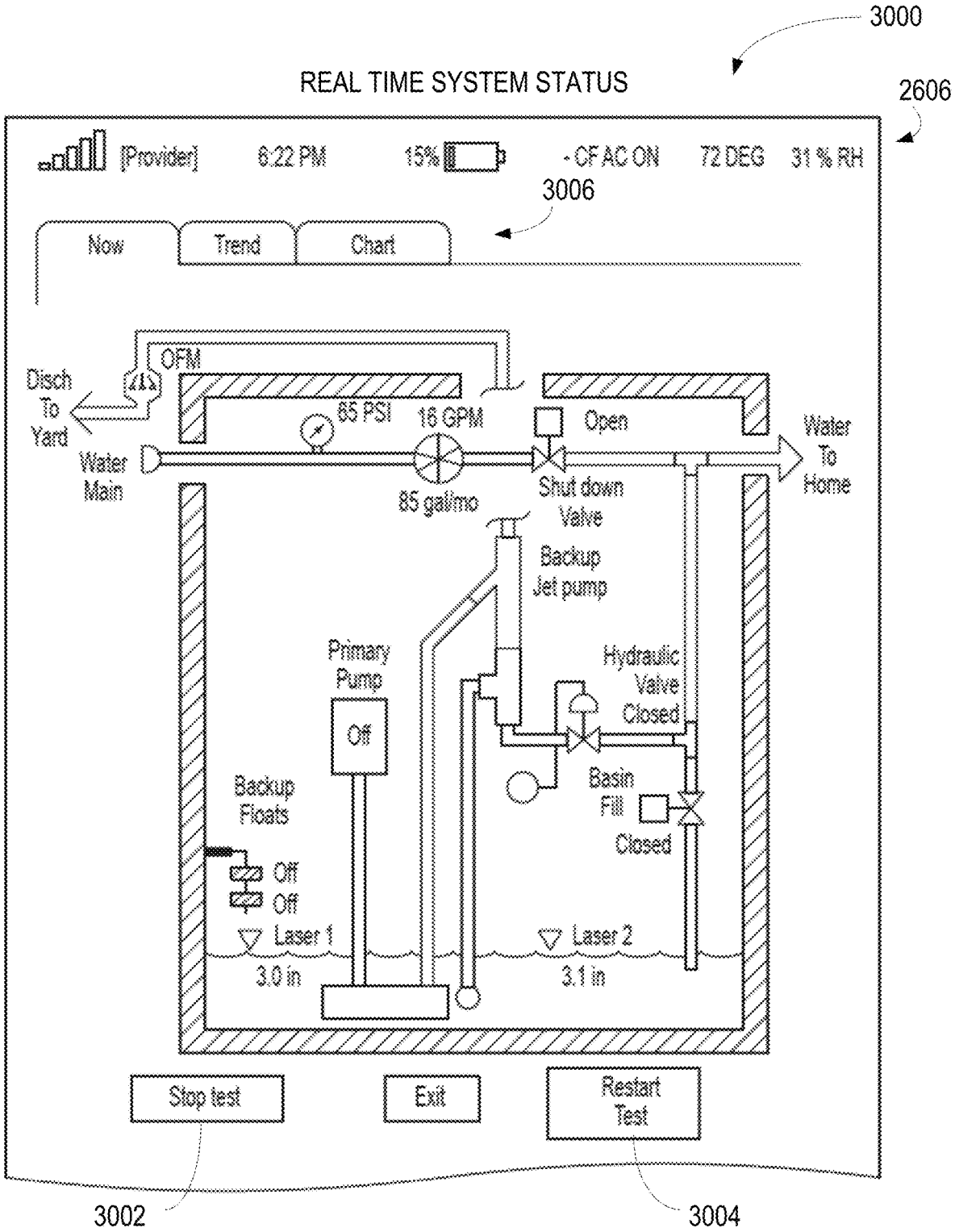
FIG. 30 is an example of a real time system status screen displaying system operational parameters.

FIG. 30 is an example of a real time system status screen 3000 displaying system operational parameters. The real time system status screen 3000 may be a different selection in menu 2700 from the status screen 2500 illustrated in FIG. 25. For example, real time system status screen 3000 may be accessed by selection of the "I/O status" selection in the menu 2700, and the status screen 2500 may be accessed by selection of the "General" selection in the menu 2700.

The real time system status screen 3000 may be launched automatically by the controller circuitry at a time when the system enters a diagnostic test mode. In addition, or alternatively, the real time system status screen 3000 may be accessed by user selection of a piece of equipment, such as primary pump 432 from the status screen 2500, or selecting a status view under the system status selection in the menu 2700, such as "I/O status." In the case where the real time system status screen 3000 is launched automatically upon entry into a diagnostic test mode, a stop test icon selection button 3002 may be available so the user can manually abort the test if desired. Also, a re-start test icon selection button 3004 may be available for a user to manually initiate or re-start a diagnostic test.

The real time system status screen 3000 may show a layout of the system, such as the layout provided in FIG. 30, in which variable numerical value and textual (e.g. on/off; open/close) operational parameters are updated in real time within the screen. In addition, equipment and objects within the real time system status screen 3000 may be dynamically adjusted to reflect corresponding variable operational parameters. For example, the pumps, and piping between equipment may dynamically and automatically change color when a pump starts or a valve opens to indicate flow of liquid in the system. In addition, for example, a water level graphic may be updated to different vertical positions as the sump pit level dynamically varies. Also, user selection of any element depicted or variable parameter displayed, such as from the touch screen of the display, may bring up a corresponding trend graph report 2800 or stats report 2900.

The real time system status screen 3000 may include a number of status tabs 3006, such as the current (now) tab, trend tab (numeric values) and chart tab (lines), which are selectable by a user and may show the same operational parameters if different formats. Additional custom real time system status screens 3000 may be generated by the user with user selected operational parameters. Selection of elements and equipment may be based on selection of available icons from a pull down list. The controller circuitry may automatically and dynamically position and size the selected icon and show corresponding operational parameters depending on the other icons selected for the custom real time system status screen 3000.

In addition, the controller circuitry may automatically and dynamically illustrate relational between selected icons. For example, interconnecting piping between two selected Icons may be automatically and dynamically added to the screen by the controller circuitry at the time the related icons are selected by the user. In another example, additional graphical detail and corresponding dynamically updated variables or graphics may be scaled in accordance with the number and relation of other selected icons. Thus, for example, a custom real time system status screen 3000 created by a user to focus on the smart water meter/shutoff valve 620 may automatically include additional equipment details, I/O values, piping details and multi-color flow rate and pressure ranges, whereas when the smart water meter/shutoff valve 620 is depicted in a custom real time system status screen 3000 also depicting the primary and secondary pumps 432 and 900, the additional details for the smart water meter/shutoff valve 620 may be omitted. Accordingly, not only does the system dynamically arrange and connect the selected icons, but also, dynamically adjusts the complexity in accordance with the number of system elements being depicted.

Figure 31:
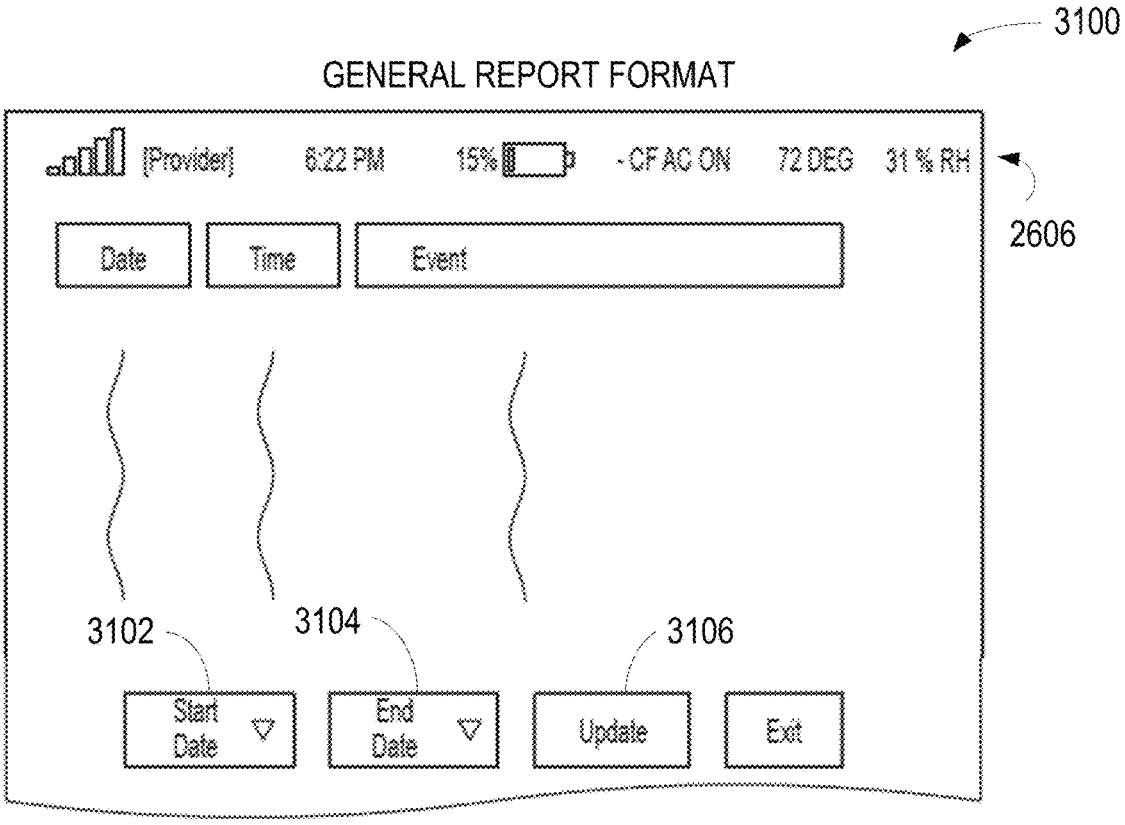
FIG. 31 is an example of a dynamically user configurable general report.

FIG. 31 is an example of a dynamically user configurable general report 3100. Similar to previously discussed reports, the dynamically user configurable general report 3100 may be in a predetermined format that is fully configured with user selected operational parameters selected from pull down menus at the time the report is created. In addition, the dynamically user configurable general report 3100 includes a start date icon selection 3102, an end date icon selection 3104 and an update icon selection 3106 for use by a user after the report is fully configured with operational parameters while data is being dynamically collected/generated and displayed. Accordingly, the user may create and store a dynamically user configurable general report 3100, and then use the stored report for analysis of system operation during particular events or date ranges. For example, if a user got alarm messages regarding excessive cycles of the primary pump during an overnight period, the user could generate a primary pump specific dynamically user configurable general report 3100 the next day and select start and stop dates to analyze the cause(s) of the alarm.

The dynamically user configurable general report 3100 may be used to create any type of reports. Examples of such reports include a notification history report with operational parameters and corresponding alarm messages, a radio activity log with operational parameters related to communication via the communications circuitry and related operational parameters of interest, audit trail reports with operational parameters related to audit results, and pump test reports providing pump related operational parameters. Any dynamically user configurable general reports 3100 may be included in the sub-menu 2702 of the reports selection in the menu 2700.

Figure 32:
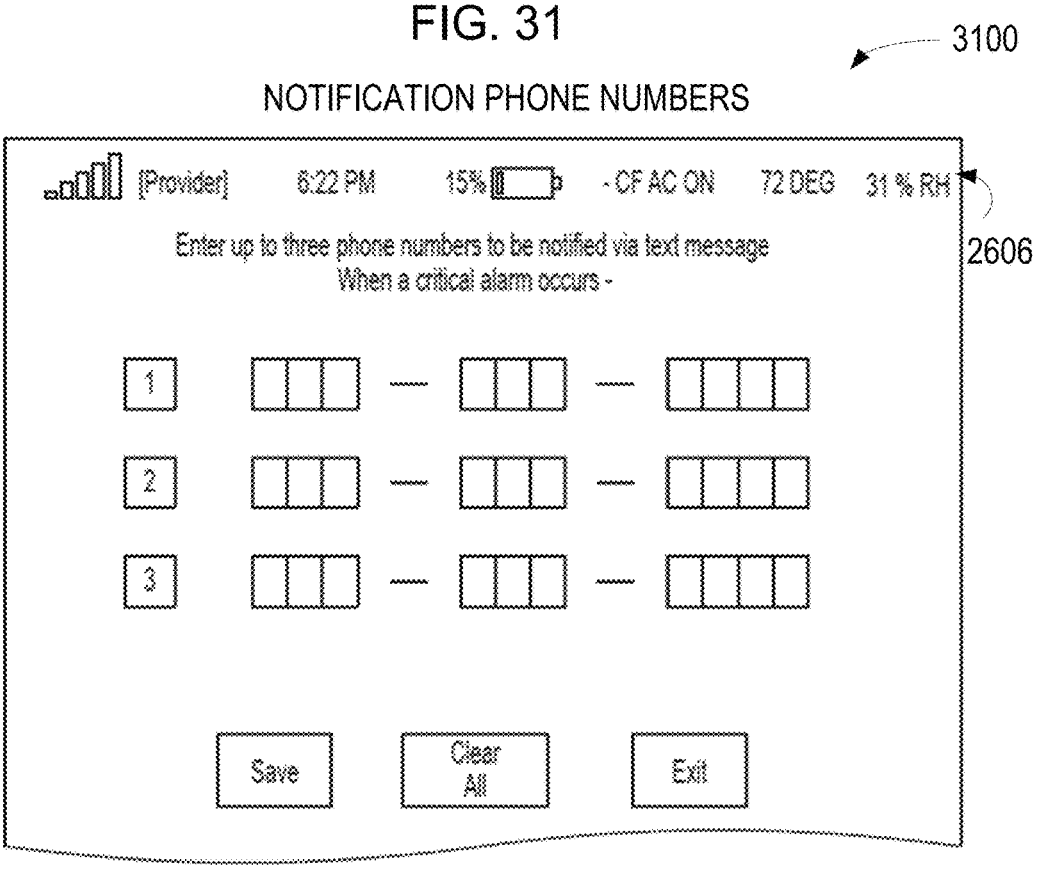
FIG. 32 is an example of a notification phone numbers screen.

FIG. 32 is an example of a notification phone numbers screen 3200. Access to the notification phone numbers screen 3200 may be automatically provided during startup of the whole home water appliance system. In addition, the notification phone numbers screen 3200 is accessible from the menu 2700 as "Notification Phone #'s". Users of the whole home water appliance system may input their phone number to receive messages from the system. In addition, the inputted phone numbers may provide a security function. The controller circuitry may use the inputted phone numbers as security verification before accepting requests and commands in the form of text messages from a user. The controller circuitry may contact a central server, such as a registrar to provide information input into the notification phone numbers screen 3200. Such information may be synched between the whole home water appliance system and the central server.

Figure 33:
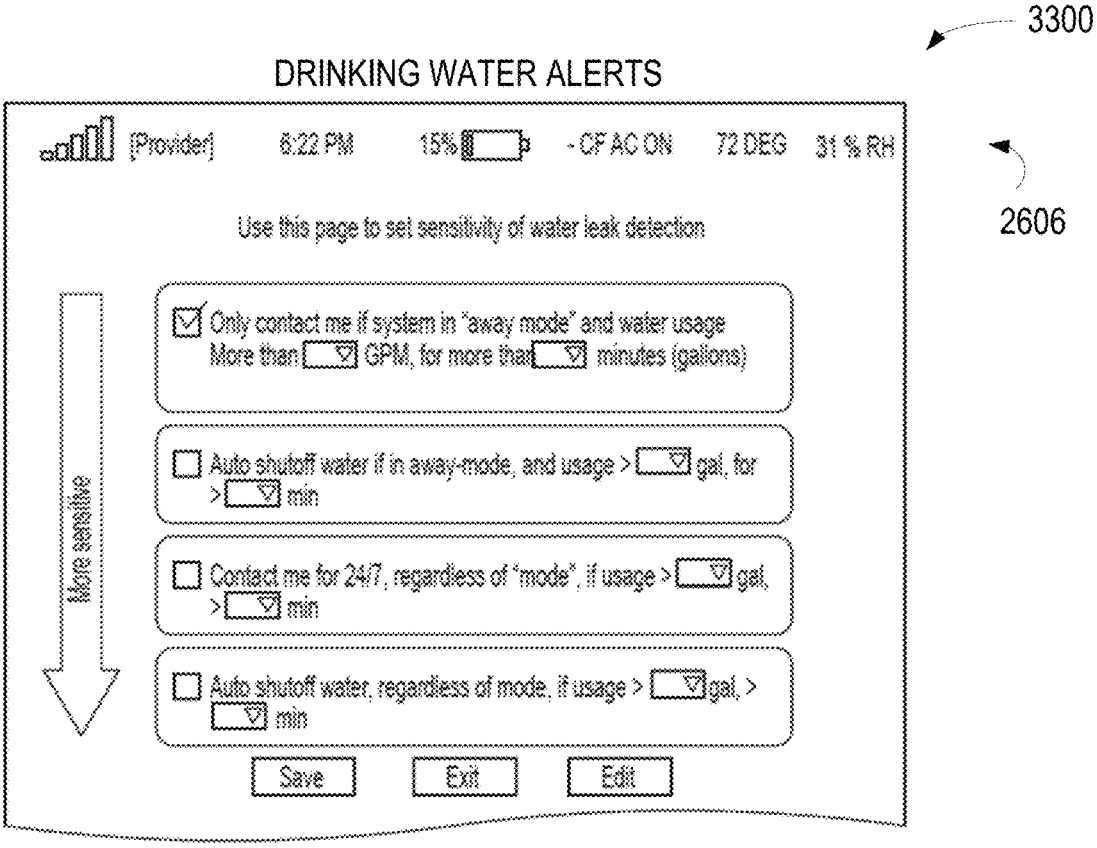
FIG. 33 is an example of drinking water alert level user settings screen.

FIG. 33 is an example of drinking water alert level user settings screen 3300. A user may configured the sensitivity of the system in detecting water leaks in the domestic water distribution network. By checking boxes and selecting thresholds for operational parameters of a detected flow rate and duration, the user may increase or decrease the response level of the smart water meter/shutoff valve 620 to a leak detection event. The detected flow rate may be a flow rate outside of predetermined water use profiles create or modified by the user. Such predetermined water use profiles include a profile of an ice maker making new cubes, washing machine finishing a load of laundry, a water softener's scheduled regeneration, etc. The sensitivity of the system may be set in a least sensitive setting where the user is only notified of a leak detection event when the user is away and the duration and magnitude of usage exceeds a amounts set by the user. In a most sensitive setting, the smart water meter/shutoff valve 620 may shut off domestic water supply to the domestic water distribution network based solely on the magnitude and duration of a flow event.

Figure 34:
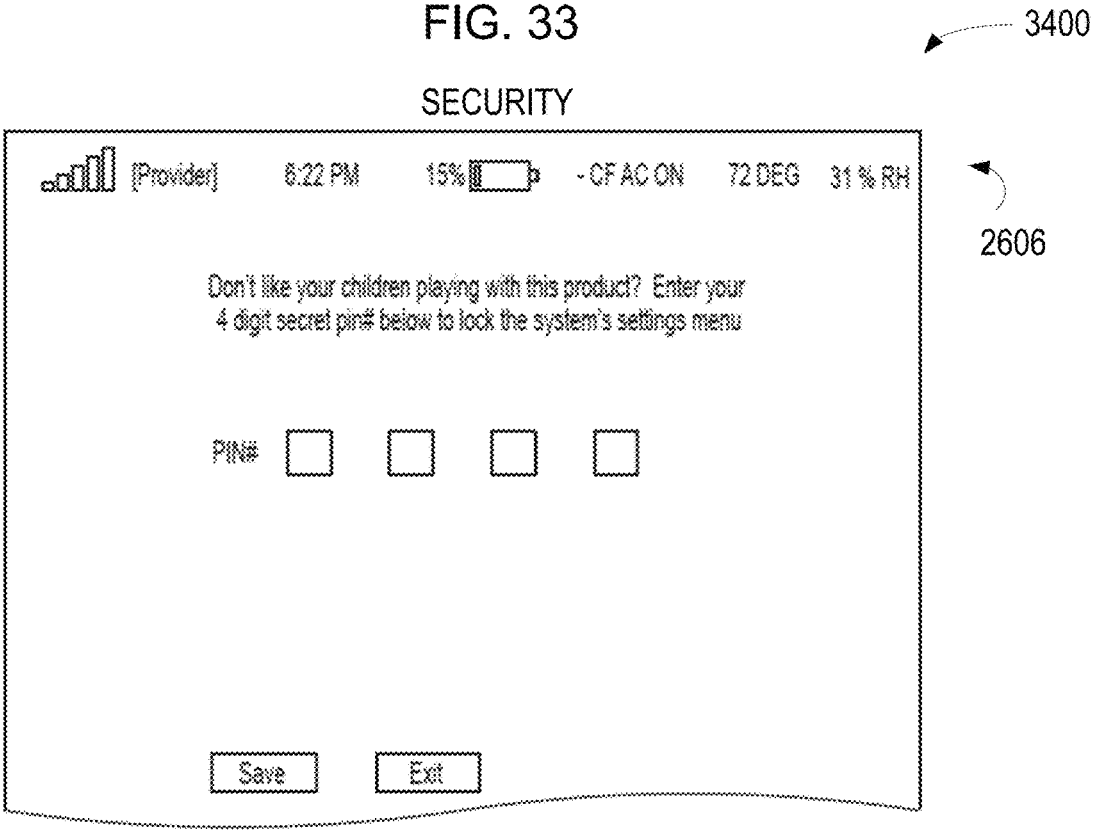
FIG. 34 is an example of a security screen.

FIG. 34 is an example of a security screen 3400. The security screen allows a user to set a personal identification code. A request for the personal identification code may be generated whenever a user first accesses the system, or when a predetermined period of time, such as 15 minutes has expired since the identified registered user last interacted with the whole home water appliance system.

Figure 35:
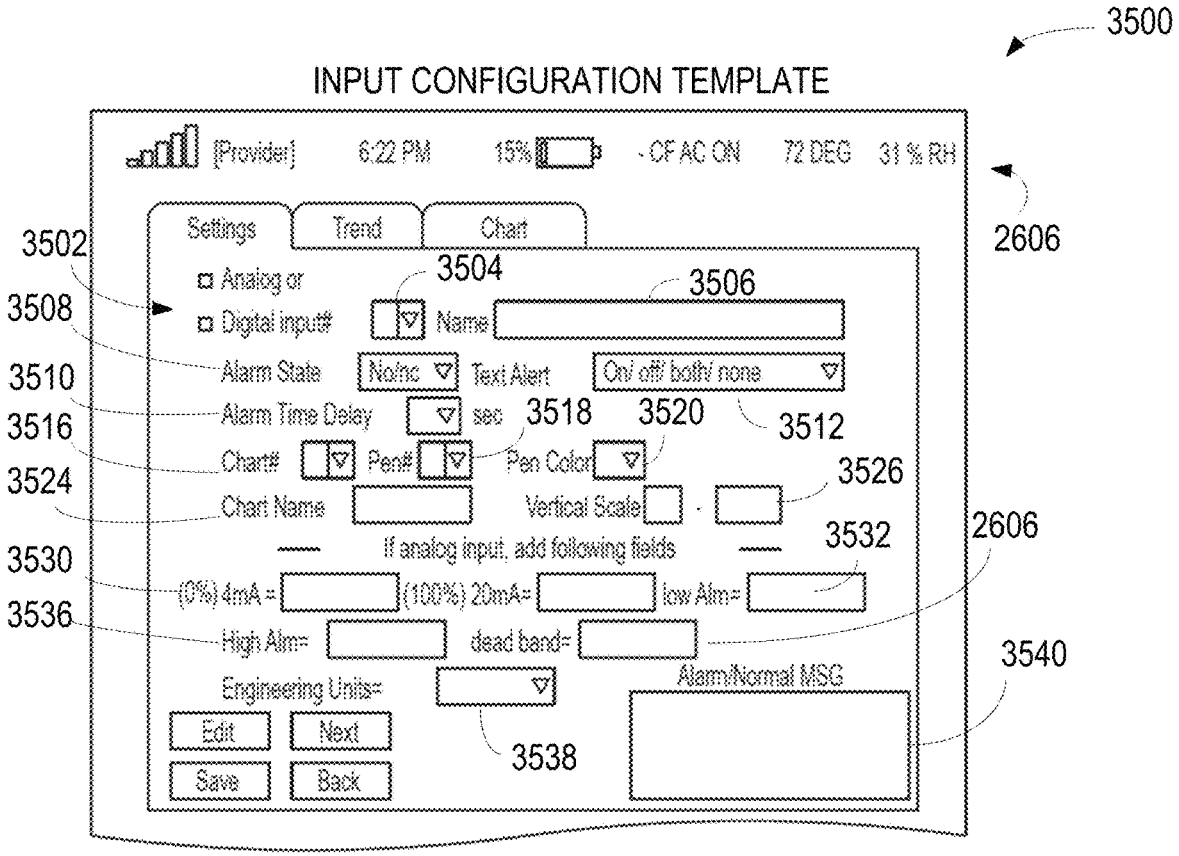
FIG. 35 is an example of an input configuration template user entry screen.

FIG. 35 is an example of an input configuration template user entry screen 3500. The input configuration template user entry screen 3500 may be used configure operational parameters received as inputs to the whole home water appliance system via the I/O circuitry 2218 (FIG. 22). The operational parameters may be provided from sensors and other devices included in the external frame of the whole home water appliance system (internal inputs), or may be received from devices external to the whole home water appliance system.

A user may identify an input type 3502 of the operational parameter as an analog or digital input via check box, and identify an input number 3504 upon which the signal is received. In an example embodiment, the I/O circuitry includes terminations #1-8 for analog inputs and terminations #1-8 for digital inputs, and a pull down selection of #1-8 is provided. The user may also provide a name 3506 for each input, which will be displayed in reports, status screens and other graphic screens where the operational parameter is provided.

For operational parameters that are digital inputs, an alarm state 3508 of normally open (NO) or normally closed (NC) may be selected. Also, an alarm time delay value 3510 may be selected from a pull down to avoid repetitively receiving the same alarm due to noise, contact bounce, or contact chatter, and whether the alarm should produce a text message, a local alarm, both text message and local alarm or no alarm is selectable from a text alert 3512 pull down.

For those input which are used in a user configurable trend graph report 2800 (FIG. 28), a chart number 3516 (e.g. number assigned by system when created), a pen number 3518 (e.g. Name 1, Name 2, or Name 3), and a pen color 3520 may be selected from pull down menus; and a chart name 3524 and vertical scaling range 3526 may be input.

For operational parameters that are analog inputs, low (0%) and high (100%) units values 3530, a low alarm value 3532, a high alarm value 3534, a dead band 3536 and engineering units 3538 may be entered. Also, for both analog and digital inputs, an alarm message and normal message 3540 may be entered by the user. The utility of the trend graphs now becomes apparent in that three variables of any type and scale can be plotted against each other on a single graph. This applies even to a digital on/off style signal being plotted against two analog variables onto a single graph. For example, if the user wanted to plot the on/off run status of the primary pump vs pump amps, and domestic water pressure, these variables can all be assigned to the same graph. The vertical scale of the graph will contain three vertical scales of different colors and scaling. The associated line graph for each variable will match the color of the corresponding vertical scale. This applies even for the digital on/off signal. This digital signal will look merely like a step-function square wave transitioning on and off based on the time it is running vs stopped, and then corresponding pump amps and water pressure can be observed against this square ware line graph to ensure all parameters are functioning correctly and in the correct timeframe. Anomalies and trends can be easily spotted graphing different scale variables on a single graph.

Figure 36:
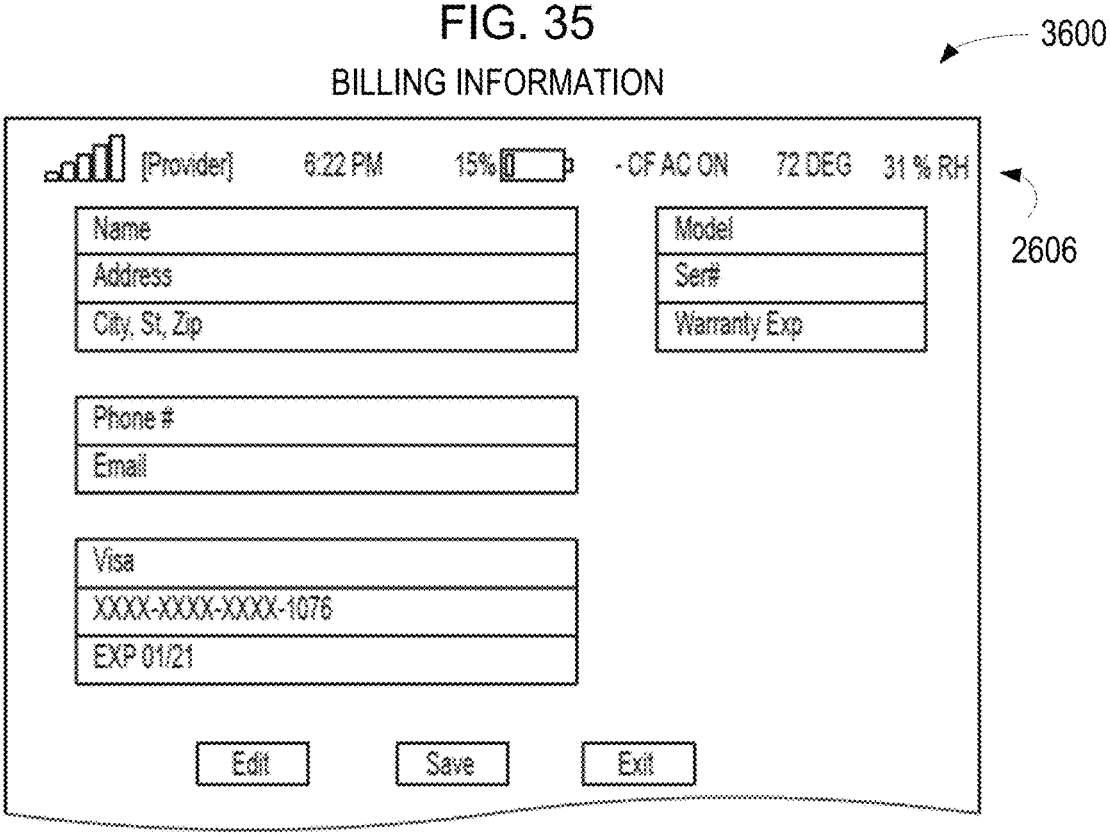
FIG. 36 is an example of a billing information input screen.

FIG. 36 is an example of a billing information input screen 3600 where a user may enter information for purchase made through the whole home water appliance. Purchase may include, for example, consumables, such as desiccant, equipment replacement parts, equipment upgrade parts such as a multi-function communication PCB providing cellular and WIFI communication capability, and services, such as in home repair services, technical support, troubleshooting and the like.

Figure 37:
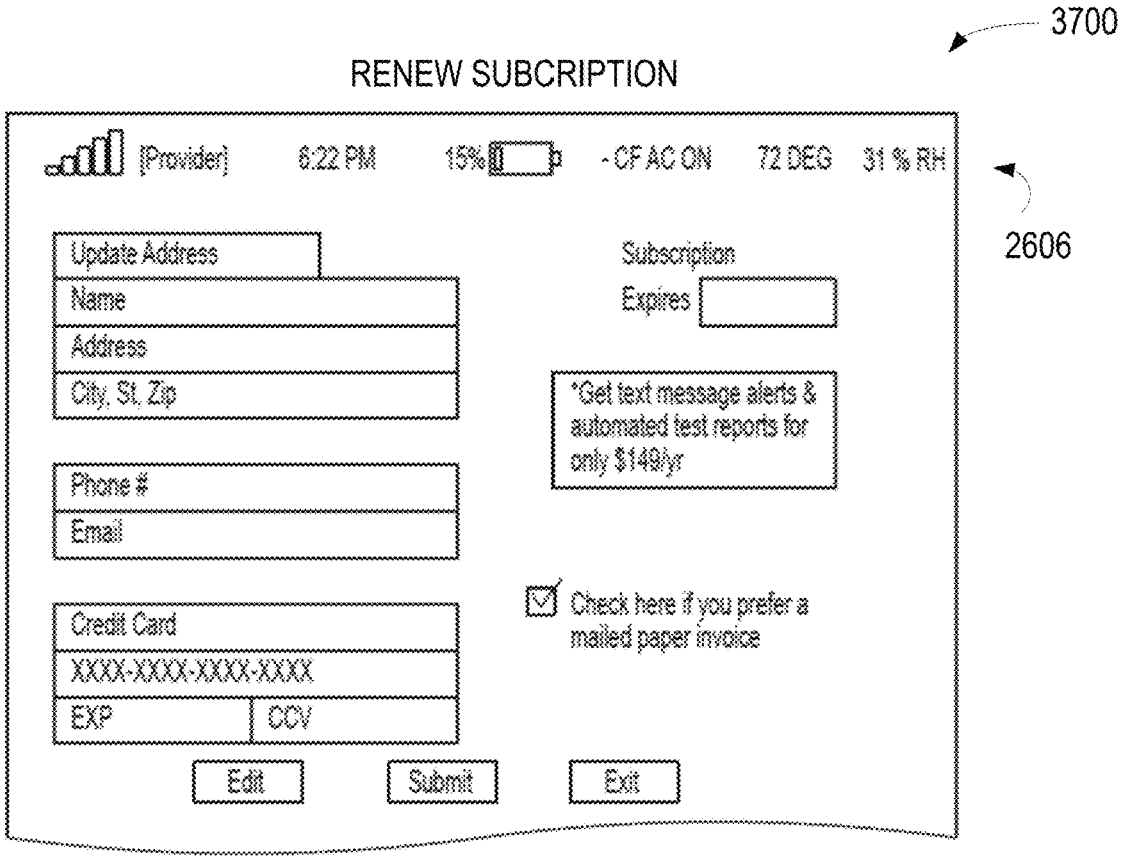
FIG. 37 is an example of a subscription renewal screen.

FIG. 37 is an example of a subscription renewal screen 3700. The subscription renewal screen may be used to upgrade or renew wireless communication services by entering billing information. Wireless communication services may be provided via satellite or cellular to send and receive, for example, text messages.

Figure 38:
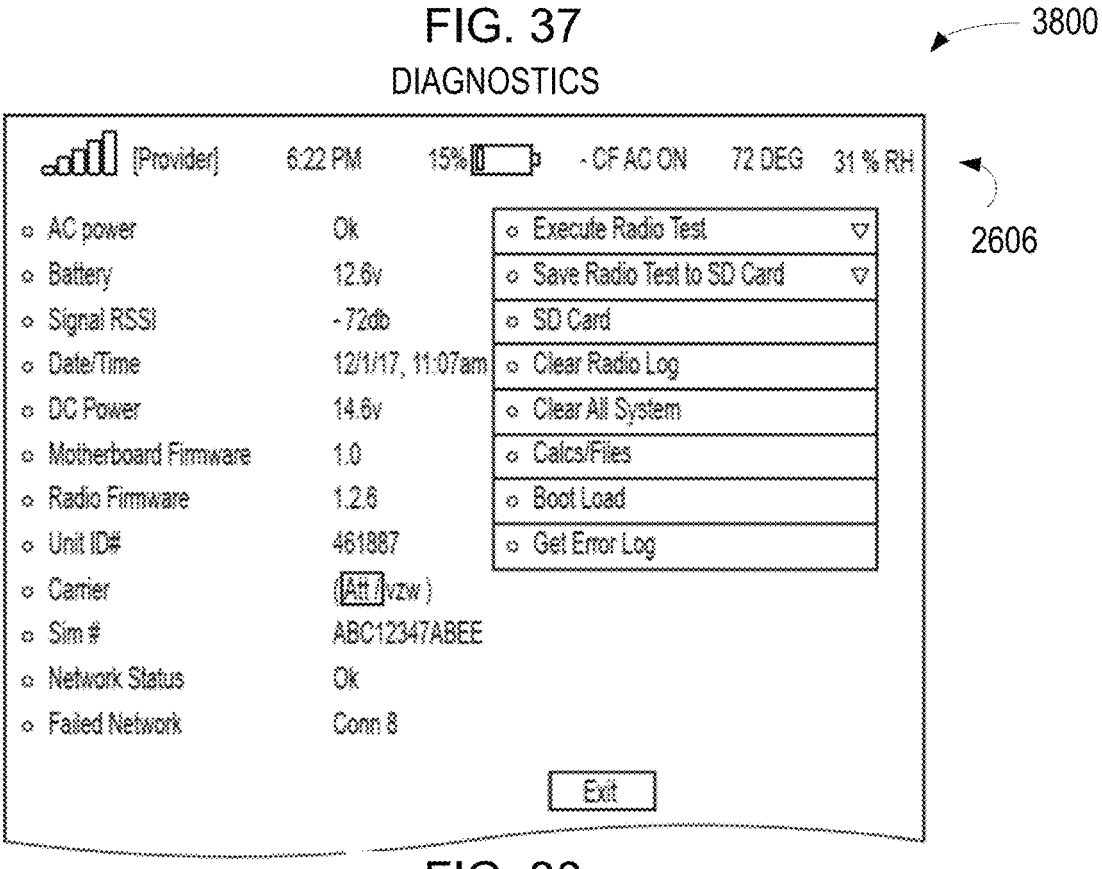
FIG. 38 is an example of a diagnostics screen.

FIG. 38 is an example of a diagnostics screen 3800. The diagnostic screen 3800 may be automatically presented to the user upon completion of diagnostic testing by the controller circuitry. Alternatively, or in addition, a user may retrieve the diagnostic screen via submenu in menu screen 2700 (FIG. 27) or by selecting a link in an alarm message. The example diagnostic screen 3800 may include an diagnostic test values section 3802 and an actions section 3804.

The diagnostic test values section 3802 includes test results for various systems that were tested and system specific information for the whole home water appliance system. The actions sections 3804 provides various actions that a user can initiate. In the example of FIG. 38, an execute radio test is available to test the wireless communications. Where multiple wireless communications are available, such as cellular, satellite, short range, and WIFI, the user may select individual services to be tested. An option to save results of a radio tests to a storage medium, such as an SD card, thumb drive, laptop, or other memory device connected with the system may be used to, for example, obtain assistance from the service provider with troubleshooting. In alternative examples, selection of another wireless communication service may be selected to obtain radio tests results may be selected. For example, a user may select short range communication (such as Blue Tooth™ to transfer the radio test results to the users cell phone while the user is in the basement within a short distance of the whole home water appliance system.

A clear radio log selection is also available to remove the log of previous radio communication, and a clear all systems/calculations selection may empty the memory of all operational parameters and stored calculations (e.g. system reset). A boot/load selection may be used to re-boot the whole home water appliance system, and a get error log selection may be used to retrieve an error log for download via the communication circuitry or to a storage medium connected with the system. In other examples, additional diagnostic test related activities may be included in the diagnostics screen 3800.

Figure 39:
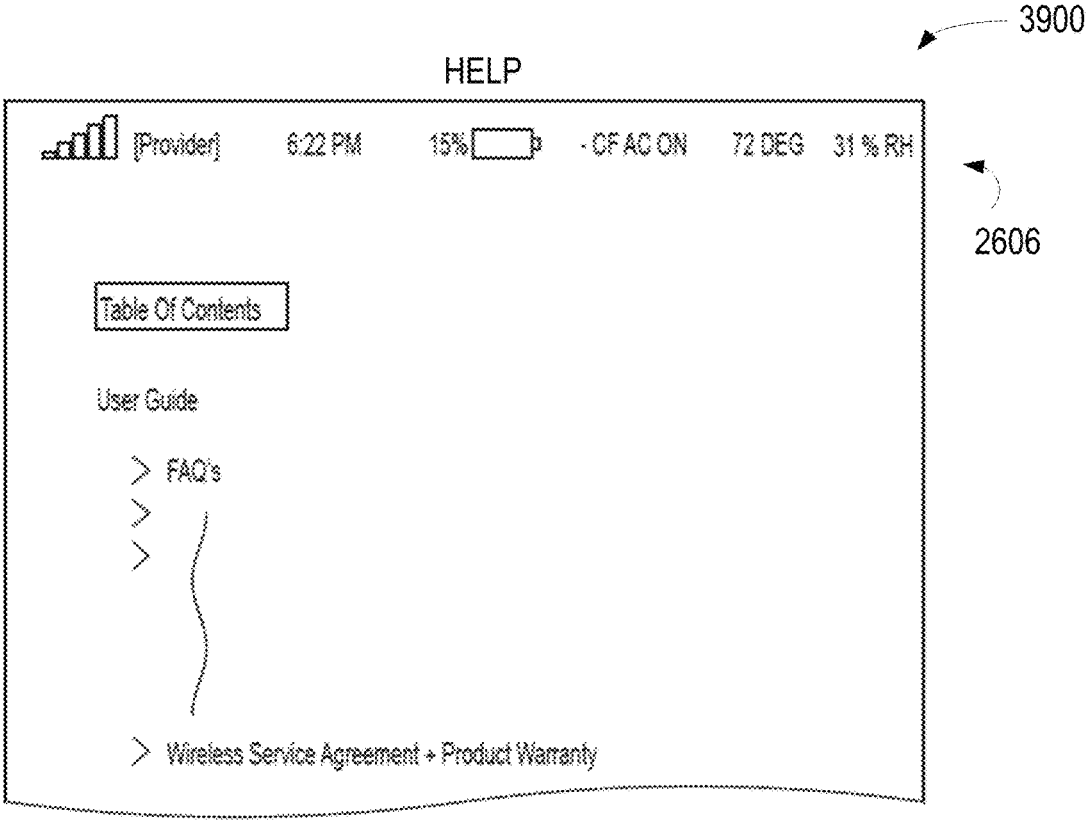
FIG. 39 is an example of a help screen.
Figure 40:
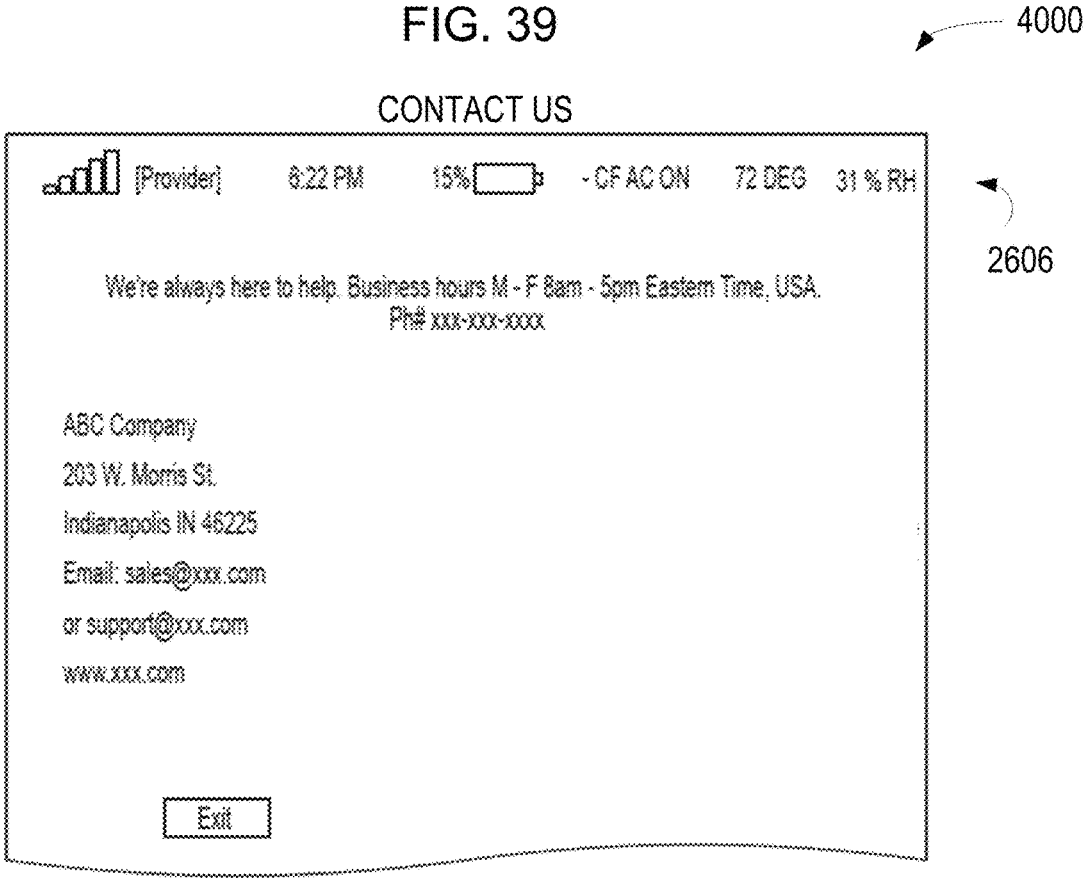
FIG. 40 is an example of a contact us screen.
Figure 41:
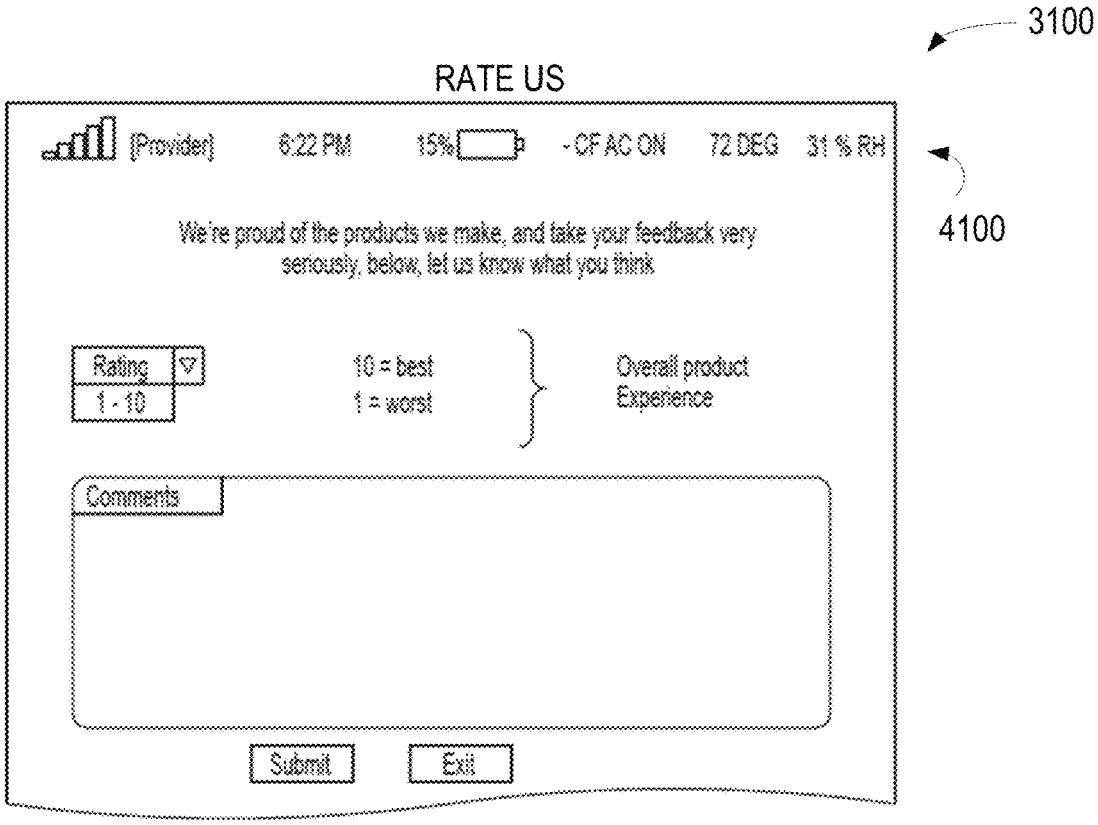
FIG. 41 is an example of a consumer rating screen.
Figure 42:
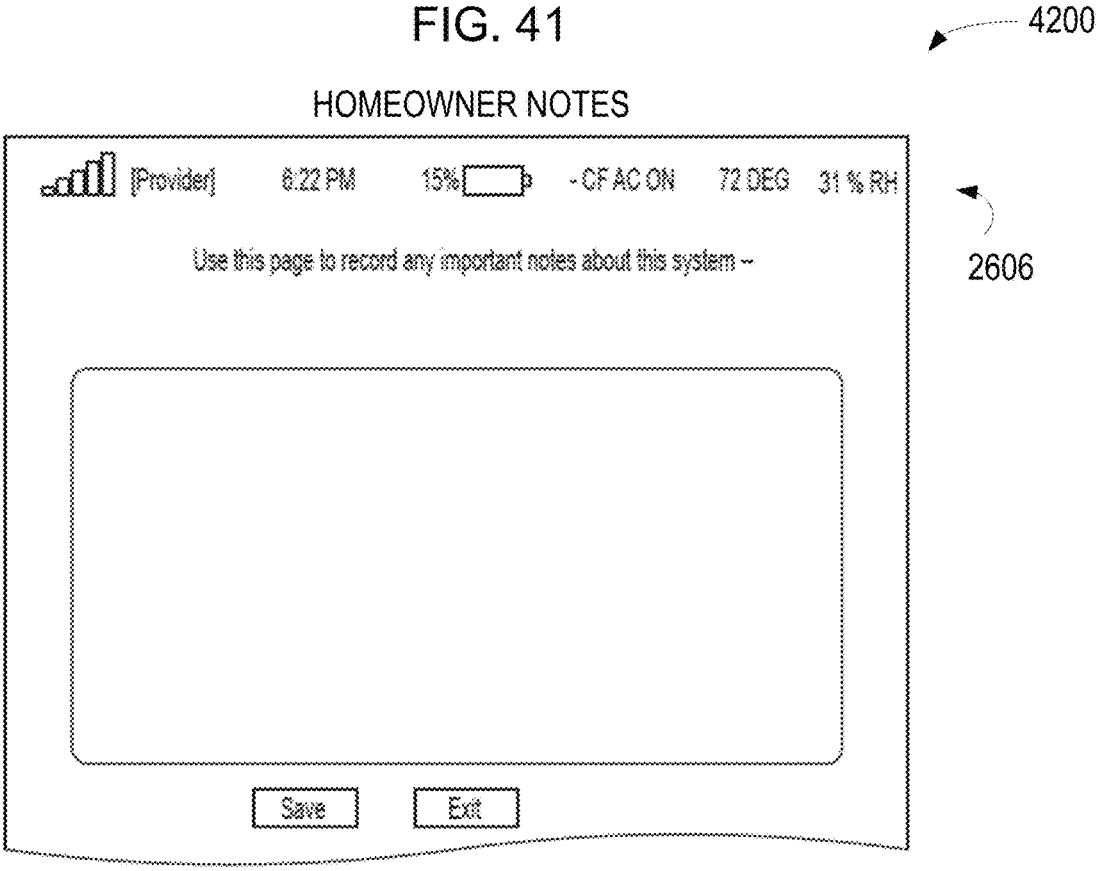
FIG. 42 is an example of a notes page.

FIG. 39 is an example of a help screen 3900. The help screen 3900 may display a table of contents of a user's guide for the whole home water appliance system, which may include frequently asked questions, troubleshooting information, and the like. FIG. 40 is an example of a contact us screen 4000, FIG. 41 is an example of a consumer rating screen 4100, and FIG. 42 is an example of a notes page where a user may store system related information. The WHWA can play full motion instructional videos with sound to make product use easy to understand without the need to read lengthy manuals. The videos may be stored in the WHWA and may be selectable via one or more of the screens, or may be accessible via links on the screens, or may be accessible via the communication circuitry or the I/O circuitry by an external device, such as mobile phone. Control of audio volume, pause, play, forward and other functionality may be available via the screens. Such videos may also be downloaded to the WHWA via the communication circuitry, such as via the short range transceiver or the I/O circuitry. Accordingly, product updates and feature enhancements can be provided as program updates, with an accompanying video to explain the reasons for the updates and/or the modified or enhanced functionality the update provides.

The previously discussed whole home water appliance is not limited to the configurations described. In addition, the features described in the examples may be used in different configurations in which features described in one example form a part of another example, features may be interchanged among the different examples, and/or features of different examples may be cooperatively used in examples of the whole home water protection system.

In addition, the described examples of the whole home water protection system include a number of interesting features, which include: a dehumidification and aroma emission cartridge included in the shroud, and a fan configure to move air across the cartridge.

Another interesting feature relates to the single appliance structural frame which includes a primary electric powered centrifugal pump with its water discharge piped in parallel with a second water powered venturi pump where the pumps can be run separately, or together, and when running together achieve at least 1.5× system pumping rate of the primary pump or the secondary pump operating alone.

Yet another interesting feature relates to the single appliance structural frame which includes a primary electric powered centrifugal pump with its water discharge piped in parallel with a second water powered venturi (eductor) pump where the pumps can be run separately, or together, and when running together achieve 1.5× system pumping rate of the primary pump or the secondary pump operating alone, which is discharged through a single common outlet discharge pipe.

Still another interesting feature relates to the single appliance structural frame which includes a primary electric powered centrifugal pump with its water discharge piped in parallel through a sump pump discharge system that includes a merge pipe fitting, with a second water powered venturi pump. The primary and secondary pumps can be run separately, or together, and when running together to each independently supply a flow of liquid to a single common outlet achieve 1.5× system pumping rate of the primary pump or the secondary pump operating alone.

Another interesting feature relates to the single appliance structural frame which, includes a primary electric powered centrifugal pump with its water discharge piped in parallel through a merge pipe fitting, with a second water powered venturi pump where the pumps can be run separately, or together, and when running together to each independently supply a flow of liquid to a single common outlet achieve 1.5× system pumping rate of the primary pump or the secondary pump operating alone due to the effect of the merge pipe fitting and the balanced operation of the primary and secondary pumps to feed the common outlet.

Another interesting feature of the single appliance structural frame, which includes a primary electric powered centrifugal pump with its water discharge piped in parallel through a merge pipe fitting, with a second water powered venturi pump where the pumps can be run separately, or together, and when running together to each independently supply a flow of liquid to a single common outlet achieve a 50% system pumping rate increase when compared to of the primary pump or the secondary pump operating alone due to the effect of the merge pipe fitting and the balanced operation of the primary and secondary pumps to feed the common outlet.

Another interesting feature of the single appliance structural frame which contains a primary electric powered centrifugal pump with its water discharge piped in parallel through a merge pipe fitting, with a second water powered venturi pump where the pumps can be run separately, or together to supply a flow of liquid to a single common outlet, and when running together allow either pump to be started when one pump is already running, and achieve a 50% system pumping rate increase due to the merge pipe fitting and the balanced independent operation of the primary pump and secondary pump to each independently supply a flow of liquid to the single common outlet.

Another interesting feature of the whole home water appliance system relates to the minimized number of external connections for the system. In an example, the external connections to system may include only 1) an electric power input, 2) a utility water supply inlet, 3) a utility water supply outlet feeding a water supply system of the structure in which the system is installed, and 4) a common outlet for discharge of liquid from a sump pit within which the structural frame is positioned.

Another interesting feature of the whole home water appliance system relates to a utility connection wall box included in the system. The utility connection wall box includes quick connection and disconnection fittings, such as snap fittings, compression fittings and the like to interconnect the elements included in the structural frame with the utility wall connection box. The quick connection and disconnection fittings may be unique for each connection to eliminate interconnection errors. The utility connection wall box may be wall mounted in close proximity to a sump pit where the whole home water appliance system so as to provide water terminals, electric power terminals, and a common outlet terminal for landing or otherwise connecting a municipal utility water source and utility water network outlet main, a utility electric power feed, and a common outlet water discharge. The utility water network outlet main may supply a municipal water source to a domestic water network within the structure in which the whole house home water protection appliance is installed, and the common outlet water discharge may provide a flow path out of the structure for liquid extracted by the system from the sump pit. Corresponding quick connection and disconnection fittings may be accessible at the shroud of the system, and in some examples, interconnecting lines and cables may be included as part of the system.

Another interesting feature of the whole home water appliance is that the system includes in the structural frame a domestic water meter and shutoff valve configured to detect abnormal water usage anywhere in the domestic water network system of the structure. In addition, the domestic water meter and shutoff valve may automatically close the shutoff valve to turn off the supply of water from the municipal utility thereby preventing a flood, water damage, or high water bill.

Another interesting feature of the whole home water appliance system relates to a dehumidification system included in the system. The dehumidification system may include a calcium chloride desiccant, such as a pouch, with scented beads. An inlet air fan is also included in the dehumidification system and place to allow ambient air to be drawn in through the shroud into the calcium chloride desiccant for dehumidification of the local ambient air, and discharge of scented air from the shroud back into the surround air space for a fresh smelling basement or crawlspace.

Another interesting feature of the whole home water appliance system relates to communication circuitry included in the system. The communication circuitry may provide wireless telemetry capable of communicate via wifi, cellular, or satellite to remote locations across the Internet, and can report to a mobile device. The mobile device may include a stand-alone smart phone app, such as the Nest™ network, or the Amazon Echo™ appliance to display, store and/or provide a user interface for a user of the mobile device.

Another interesting feature of the whole home water appliance system relates to a refrigeration type dehumidification unit included in the structural frame. An inlet air fan is also contained in the appliance for drawing-in ambient air into the dehumidification unit for dehumidification of the local ambient air, and discharging this dehumidified air back into the space surrounding the system for a fresh smelling basement or crawlspace.

Another interesting feature of the whole home water appliance system relates to the appliance including a controller circuitry, a water actuator control device in communication with the controller circuitry; and a water flow meter. The controller circuitry is configured to receive a flow indication from the water flow meter, and detect leaks in a water distribution system network of a building structure based on the flow indication. The controller circuitry may also control the water actuator control device to turn off a municipal utility water source being supplied.

Another interesting feature of the whole home water appliance relates to the appliance including a water flow meter configured to measure a flow of water in a domestic water distribution network system of a home, and a water control device mounted in the structural frame of the system to control a flow of water in a water inlet pipe to the home or other structure based on the measured flow of water.

Another interesting feature of the whole home water protection application system relates to a micro-hydropower generator that may be included in the structural frame. The micro-hydropower generator may be deployed in a liquid line such as municipal water utility supply line so as to be rotated by a flow of water therethrough. The micro-hydro power generator may output AC or DC power to charge an energy storage device such as a battery or capacitor. In addition, or alternatively, the micro-hydro generator may supply power to the controller circuitry, the display and/or other electronic devices included in the system.

Although specific components are described above, methods, systems, and articles of manufacture described herein may include additional, fewer, or different components. For example, controller circuitry may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same apparatus executing a same program or different programs. The components may be resident on separate hardware, such as separate removable circuit boards, or share common hardware, such as a same memory and processor for implementing instructions from the memory. Programs may be parts of a single program, separate programs, or distributed across several memories and processors.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An appliance comprising:

a plurality of pumps included in a structural frame, the pumps driven by an electric power source to selectively extract a flow of drainage liquid from a sump basin in which the structural frame is inserted and discharge the flow of drainage liquid at an outlet, the structural frame positioned within the sump basin;

a shroud positioned above the sump basin forming an upper portion of the structural frame;

a controller circuitry disposed in the shroud positioned above the sump basin and configured to control cooperative operation of the pumps; and a smart meter disposed in the shroud, the smart meter comprising a water control actuator and a flow meter in communication with the controller circuitry, wherein the controller circuitry is configured to control the water control actuator to provide a supply of domestic water to a domestic water distribution network in accordance with a flow profile of the domestic water distribution network, and the controller circuitry is further configured to close the water control actuator in response to a flow signal from the flow meter indicative of a flow of water outside the flow profile.

2. The appliance of claim 1, further comprising communication circuitry included in the shroud, the controller circuitry configured to monitor an emergency bypass of the outlet, wherein the emergency bypass discharges drainage liquid external to the sump basin; and the controller circuitry is configured to direct the communication circuitry to wirelessly output an emergency bypass alarm message in response to the flow of drainage liquid in the outlet being detected in the emergency bypass.

3. The appliance of claim 1, further comprising communication circuitry having a radio, an onboard antenna and being configured for coupling with an external antenna positioned away from the appliance, wherein at least one of the controller circuitry and the communication circuitry is configured to monitor signal strength of a signal received by the radio via the onboard antenna, the at least one of the controller circuitry and the communication circuitry is further configured to automatically check a signal strength of a signal received via the external antenna and switch between the onboard antenna and the external antenna in response to the signal strength of the signal received via the onboard antenna falling below a predetermined minimum value and the signal strength of the signal received via the external antenna being above the predetermined minimum value.

4. The appliance of claim 1, further comprising a touch screen graphical user interface coupled with the controller circuitry and mounted in the shroud.

5. The appliance of claim 1, further comprising a sump basin liquid level sensing system, the sump basin liquid level sensing system including a main level sensor and a backup level sensor, the main level sensor providing an analog level signal to the controller circuitry for control of the pumps and the backup level sensor providing a digital level signal to the controller circuitry for control of the pumps.

6. The appliance of claim 5, wherein the backup level sensor includes a first magnetic float and a second magnetic float sildably coupled with a shaft, and a magnetic sensor positioned to detect a proximity of the first and second magnetic floats and provide digital signals to the controller circuitry indicative of respective threshold drainage liquid levels in the sump basin, the digital signals comprising a first digital signal indicative of a first threshold drainage liquid level provided via the first magnetic float, and a second digital signal indicative of a second threshold drainage liquid level provided via the second magnetic float.

7. The appliance of claim 1, further comprising a level test actuator coupled with the supply of domestic water, wherein the controller circuitry is configured to control the level test actuator to automatically fill the sump basin with domestic water and dynamically test a draw down capability of at least one of the pumps, the controller circuitry further configured to monitor an emergency bypass sensor on the outlet during dynamic testing.

8. The appliance of claim 1, further comprising a display screen and a motion detector mounted on the appliance, wherein the controller circuitry is configured to receive a motion signal from the motion detector and control the display screen to display a status message in response to the motion signal, the motion signal indicative of activity of a user in a vicinity of the appliance.

9. An appliance comprising:

a structural frame positionable in a sump basin;

a plurality of pumps internally mounted in the appliance on the structural frame;

a shroud separated from the sump basin by a cover, the cover positioned over an opening into the sump basin, and the shroud positioned on the cover;

a controller circuitry internally mounted in the appliance in the shroud and configured to control operation of the pumps to extract drainage liquid from the sump basin;

a smart meter included in the shroud and in communication with the controller circuitry, the smart meter comprising a water control actuator and a flow meter sequentially positionable in a main water line supplying domestic water, at least one of the smart meter or the controller circuitry configured to learn a flow profile of domestic water consumption via the main water line and automatically operate the water control actuator to turn off a flow of domestic water through the water control actuator in response to the flow of domestic water failing to match the flow profile of domestic water consumption; and communication circuitry configured to provide wireless communication with devices external to the appliance, the controller circuitry configured to direct the communication circuitry to wirelessly transmit a message to a user in response to the operation of the water control actuator to turn off the flow of domestic water.

10. The appliance of claim 9, wherein the controller circuitry is configured to operate the smart meter for domestic water leak detection in accordance with the flow profile of domestic water consumption in a home mode, an away mode or a disabled mode, a sensitivity of domestic water leak detection being higher in the away mode than in the home mode, and the domestic water leak detection being off in the disabled mode.

11. The appliance of claim 10, wherein the controller circuitry is configured to receive a signal indicative that a home security system has been armed, and the controller circuitry is configured to transition from the home mode to the away mode in response to receipt of the signal indicative that the home security system has been armed.

12. The appliance of claim 9, further comprising a level sensor and a level test actuator coupled with the main water line supplying domestic water and controlled by the controller circuitry to discharge the main water line supplying domestic water into the sump basin, wherein the controller circuitry is configured to estimate a flow rate of the pumps based on a level indication from the level sensor after the sump basin is filled with domestic water by the level test actuator and drawn down by the pumps.

13. The appliance of claim 12, wherein the controller circuitry is configured to compare the estimated flow rate of the pumps with a table of predetermined flow rates of the pumps to confirm performance of the pumps, and the controller circuitry is further configured to automatically message a user, the message including a pump health report indicating a test performance of the pumps.

14. The appliance of claim 9, wherein the pumps include a first pump and a second pump, the controller circuitry is configured to select between energization of the first pump, or the second pump, or both the first pump and the second pump based on operational factors, the operational factors comprising an effective flow rate of the first pump and an effective flow rate of the second pump.

15. The appliance of claim 9, wherein the smart meter comprises a backup battery such that the flow meter will provide a flow signal, and the water control actuator may be actuated during a loss of external power event.

16. The appliance of claim 9, wherein the communication circuitry comprises a short range packet communication network configured to communicate wirelessly with a mobile device within wireless communication range of the short range packet communication network, the communication circuitry configured to establish communication with the mobile device and transmit and receive data over the short range packet communication network, the data comprising a programming update for an operating system executed by the controller circuitry.

17. An appliance comprising:

a shroud positioned above an opening of a sump basin on a cover of the sump basin, the cover positioned in the opening;

a controller circuitry positioned in the shroud and a display screen positioned on the shroud;

a smart meter positioned in the shroud, the smart meter in communication with the controller circuitry, the smart meter comprising a fluid meter and a valve actuator, the fluid meter configured to measure a flow of domestic water in a main water supply line to a home and provide a flow signal to the controller circuitry, and the valve actuator configured to actuate a valve in the main water supply line between an open and a closed position in accordance with a control signal provided by the controller circuitry;

a plurality of pumps disposed in the sump basin, the pumps selectively energized by the controller circuitry to discharge drainage liquid extracted from the sump basin at an outlet spaced away from the appliance; and a level sensor configured to provide a level signal to the controller circuitry, the level signal indicative of a level of drainage liquid in the sump basin, the control circuitry configured to energize one or more of the pumps in accordance with the level signal;

wherein the controller circuitry is configured to display a status screen on the display, the status screen displaying the flow of domestic water, a position of the valve actuator, energization of the pumps, and the level of the drainage liquid in the sump basin.

18. The appliance of claim 17, further comprising a communication circuitry configured to communicate over a wireless network, the controller circuitry configured to cause the display screen to display an operational condition, and execute the communication circuitry to transmit a message indicative of the operational condition over the wireless network.

* * * * *